US009392891B2

(12) United States Patent
Littlejohn et al.

(10) Patent No.: US 9,392,891 B2
(45) Date of Patent: Jul. 19, 2016

(54) RIGID-BUCKLING-RESISTANT-FLUTED PAPERBOARD CONTAINER WITH ARCUATE OUTER REGION

(71) Applicants: Mark B. Littlejohn, Appleton, WI (US); Eric J. Berg, Appleton, WI (US)

(72) Inventors: Mark B. Littlejohn, Appleton, WI (US); Eric J. Berg, Appleton, WI (US)

(73) Assignee: DIXIE CONSUMER PRODUCTS LLC, Atlanta, GA (US)

( * ) Notice: Subject to any disclaimer, the term of this patent is extended or adjusted under 35 U.S.C. 154(b) by 205 days.

(21) Appl. No.: 14/183,407

(22) Filed: Feb. 18, 2014

(65) Prior Publication Data

US 2014/0224866 A1 Aug. 14, 2014

Related U.S. Application Data

(63) Continuation of application No. 12/728,316, filed on Mar. 22, 2010, now Pat. No. 8,651,366.

(60) Provisional application No. 61/211,273, filed on Mar. 27, 2009.

(51) Int. Cl.

| | |
|---|---|
| ***B65D 1/34*** | (2006.01) |
| ***B65D 1/44*** | (2006.01) |
| ***A47G 19/03*** | (2006.01) |
| ***B31B 43/00*** | (2006.01) |

(52) U.S. Cl.

CPC ..... *A47G 19/03* (2013.01); *B31B 43/00* (2013.01); *B65D 1/34* (2013.01); *B31B 2201/223* (2013.01)

(58) Field of Classification Search

None

See application file for complete search history.

(56) References Cited

U.S. PATENT DOCUMENTS

| | | | |
|---|---|---|---|
| 1,865,742 | A | 7/1932 | Chapman |
| 2,027,296 | A | 1/1936 | Kimberly et al. |
| 2,109,955 | A | 3/1938 | Carson |
| 2,348,725 | A | 5/1944 | Chaplin |
| D154,216 | S | 6/1949 | Reofsynder |
| 3,097,780 | A | 7/1963 | Witmer |
| 3,229,886 | A | 1/1966 | Grogel |
| D215,330 | S | 9/1969 | Mair |
| 3,684,633 | A | 8/1972 | Haase |
| 3,938,727 | A | 2/1976 | Andersson |
| D239,686 | S | 4/1976 | Anderson |
| D250,928 | S | 1/1979 | Franklin |
| 4,606,496 | A | 8/1986 | Marx et al. |
| 4,609,140 | A | 9/1986 | Van Handel et al. |
| 4,721,499 | A | 1/1988 | Marx et al. |
| 4,721,500 | A | 1/1988 | Van Handel et al. |
| 5,088,640 | A | 2/1992 | Littlejohn |
| 5,230,939 | A | 7/1993 | Baum et al. |
| 5,326,020 | A | 7/1994 | Cheshire et al. |
| 5,904,643 | A | 5/1999 | Seeberger et al. |

(Continued)

OTHER PUBLICATIONS

U.S. Appl. No. 09/418,851, filed Oct. 15, 1999.

*Primary Examiner* — Gary Elkins

(57) ABSTRACT

Disposable platters are provided. In at least one embodiment, a disposable platter can include a bottom panel made of paper, a sidewall that can extend upwardly from the bottom panel, an outer flange that can extend outwardly from the sidewall, a first transition that can extend upwardly and outwardly from the bottom panel to a first end of the sidewall, and a second transition that can extend outwardly from a second end of the sidewall to a first end of the outer flange, defining a radius of curvature, R2, therebetween. In some examples, the platter can have at least two sides of different lengths, a characteristic diameter, D, that is an average length of the sides, and a ratio of R2/D that is 0.0125 or less.

20 Claims, 44 Drawing Sheets

(56) References Cited

U.S. PATENT DOCUMENTS

| | | | | |
|---|---|---|---|---|
| 5,938,112 | A | 8/1999 | Sandstrom | |
| D429,446 | S | 8/2000 | Toussant et al. | |
| 6,113,986 | A | 9/2000 | Shanton et al. | |
| 6,120,863 | A * | 9/2000 | Neculescu | B29C 47/6087 220/4.21 |
| 6,474,497 | B1 | 11/2002 | Littlejohn et al. | |
| 6,571,980 | B2 | 6/2003 | Littlejohn et al. | |
| 6,585,506 | B1 | 7/2003 | Johns et al. | |
| 6,585,630 | B2 | 7/2003 | Dai | |
| 6,589,043 | B1 | 7/2003 | Johns et al. | |
| 6,592,357 | B1 | 7/2003 | Johns et al. | |
| 6,663,925 | B1 | 12/2003 | Swoboda | |
| 6,666,673 | B2 | 12/2003 | Johns et al. | |
| 6,715,630 | B2 | 4/2004 | Littlejohn et al. | |
| 6,783,720 | B2 | 8/2004 | Johns et al. | |
| 6,893,693 | B2 | 5/2005 | Swoboda et al. | |
| 6,908,296 | B2 | 6/2005 | Johns et al. | |
| 6,932,753 | B1 | 8/2005 | Smith et al. | |
| D513,683 | S | 1/2006 | Hayes et al. | |
| 6,988,654 | B2 | 1/2006 | Wnek | |
| D514,880 | S | 2/2006 | Hayes et al. | |
| D518,682 | S | 4/2006 | Hayes et al. | |
| 7,048,176 | B2 | 5/2006 | Littlejohn et al. | |
| D525,083 | S | 7/2006 | Hayes et al. | |
| 7,070,729 | B2 | 7/2006 | Johns et al. | |
| D525,832 | S | 8/2006 | Hayes et al. | |
| D526,853 | S | 8/2006 | Hayes et al. | |
| D527,584 | S | 9/2006 | Hayes et al. | |
| D533,031 | S | 12/2006 | Hayes et al. | |
| 7,169,346 | B2 | 1/2007 | Johns et al. | |
| 7,229,274 | B2 | 6/2007 | Johns et al. | |
| D546,621 | S | 7/2007 | Hayes et al. | |
| D552,424 | S | 10/2007 | Hayes et al. | |
| D559,035 | S | 1/2008 | Hayes et al. | |
| 7,337,943 | B2 * | 3/2008 | Johns | B31B 43/00 206/459.1 |
| D576,840 | S | 9/2008 | Hayes et al. | |
| 7,419,462 | B1 | 9/2008 | Zelinski | |
| 7,482,053 | B2 | 1/2009 | Swiontek | |
| D625,201 | S | 10/2010 | Wichmann | |
| 7,980,450 | B2 * | 7/2011 | Swoboda | A47G 19/03 229/406 |
| 8,177,119 | B2 * | 5/2012 | Littlejohn | B65D 1/34 220/608 |
| 8,651,366 | B2 * | 2/2014 | Littlejohn | B31B 43/00 220/574 |
| 2001/0003341 | A1 | 6/2001 | Gentry et al. | |
| 2002/0113118 | A1 | 8/2002 | Littlejohn et al. | |
| 2003/0029874 | A1 | 2/2003 | Littlejohn et al. | |
| 2003/0173366 | A1 | 9/2003 | Littlejohn et al. | |
| 2003/0178431 | A1 | 9/2003 | Swiontek | |
| 2005/0019512 | A1 | 1/2005 | Swoboda et al. | |
| 2005/0233024 | A1 | 10/2005 | Johns et al. | |
| 2006/0208054 | A1 | 9/2006 | Littlejohn et al. | |
| 2007/0042072 | A1 | 2/2007 | Johns et al. | |
| 2007/0215678 | A1 | 9/2007 | Swoboda et al. | |
| 2007/0235514 | A1 | 10/2007 | Abayhan et al. | |
| 2008/0015098 | A1 | 1/2008 | Littlejohn et al. | |
| 2009/0173776 | A1 | 7/2009 | Swoboda et al. | |
| 2010/0247830 | A1 | 9/2010 | Hernandez | |

* cited by examiner 200
204
202

(Medium Weight Only in Prior Art)
Prior Art
242
253
254
256

242
253
254
256

Present Invention
58
60

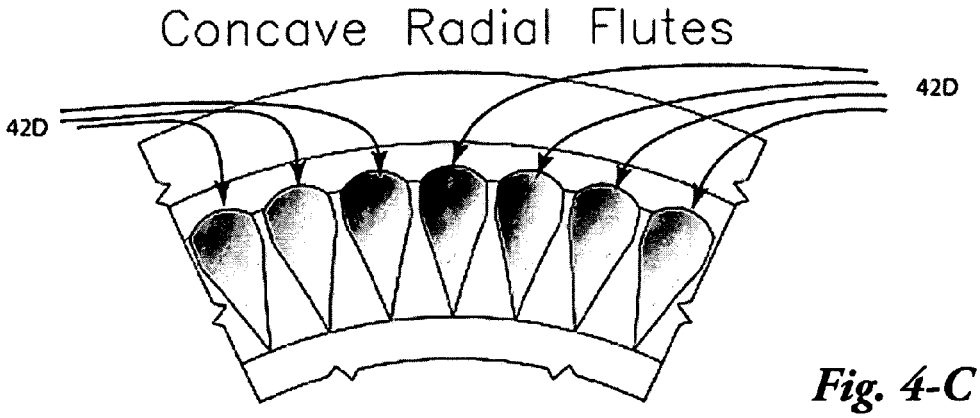
*Fig. 4-C*
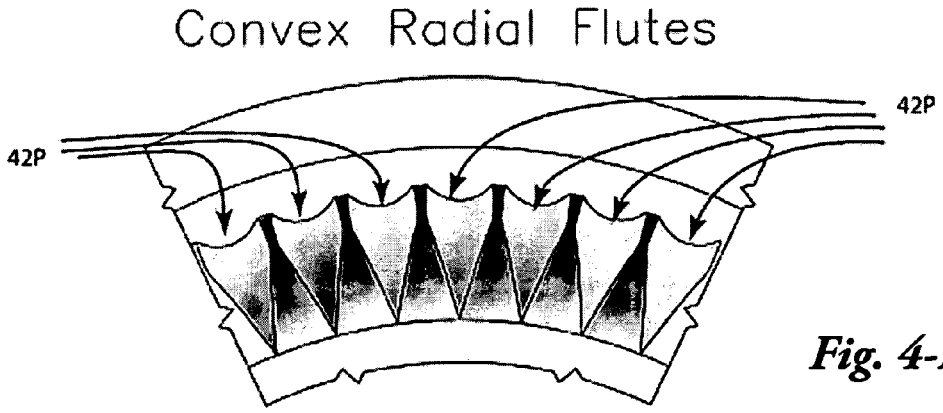
*Fig. 4-D*
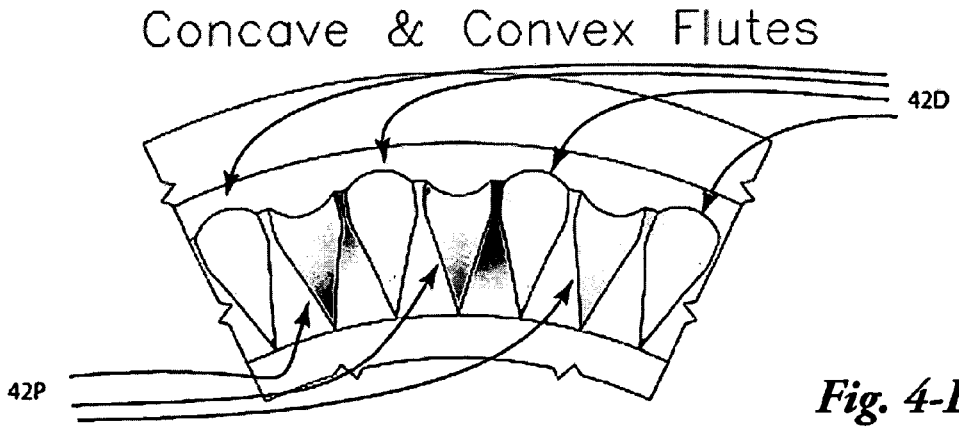
*Fig. 4-E*

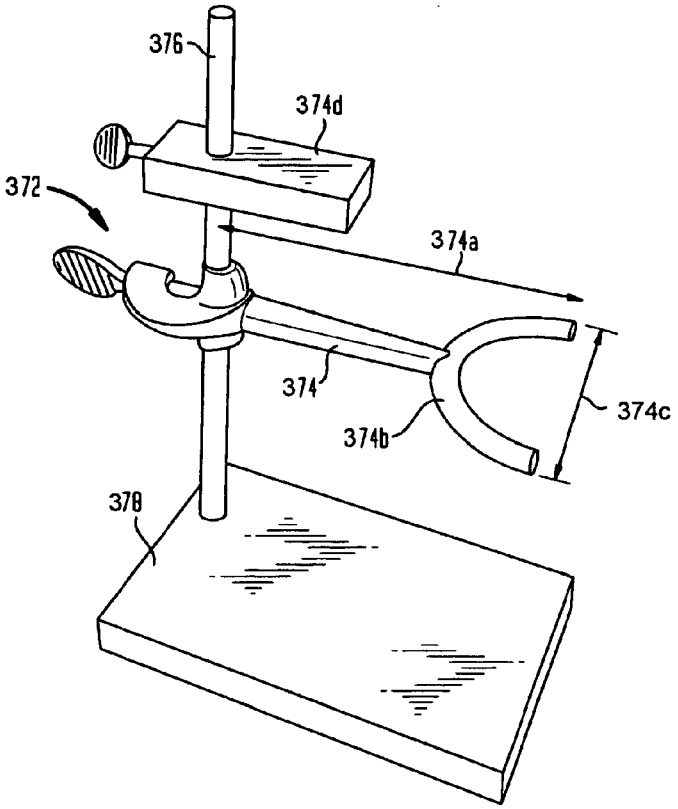
*Fig 22A*
*Fig 22B*
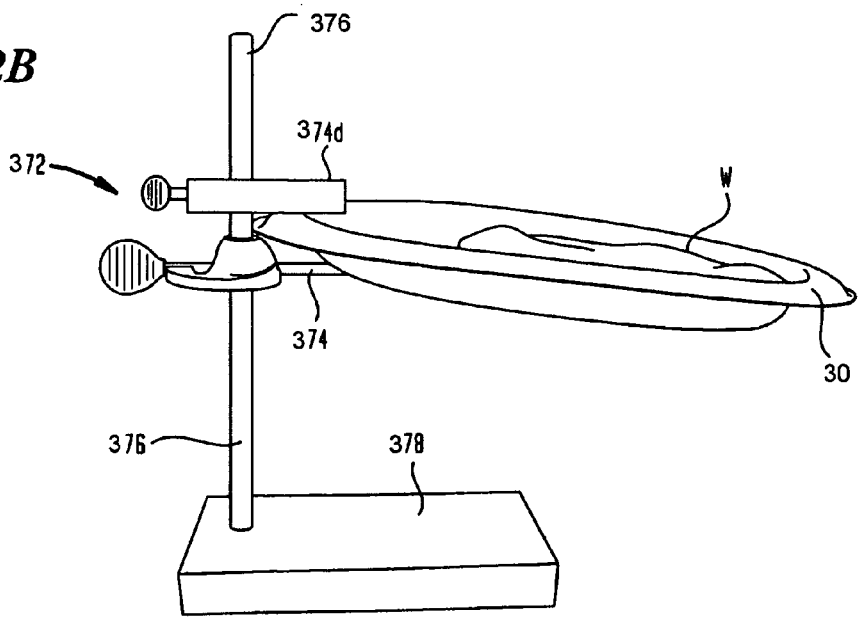

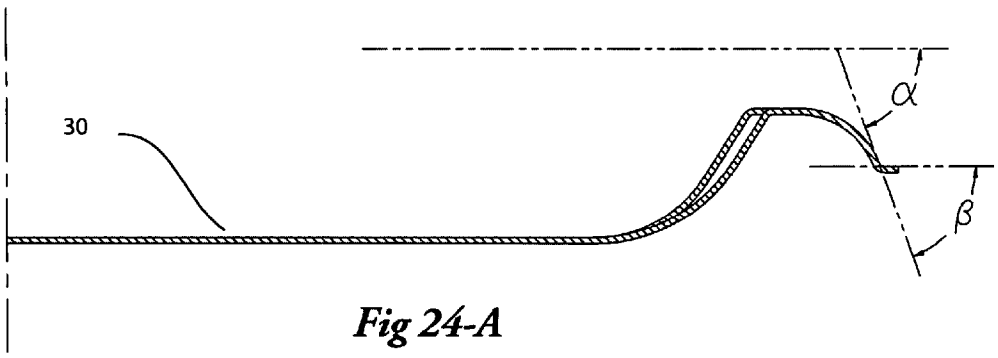
Fig 24-A
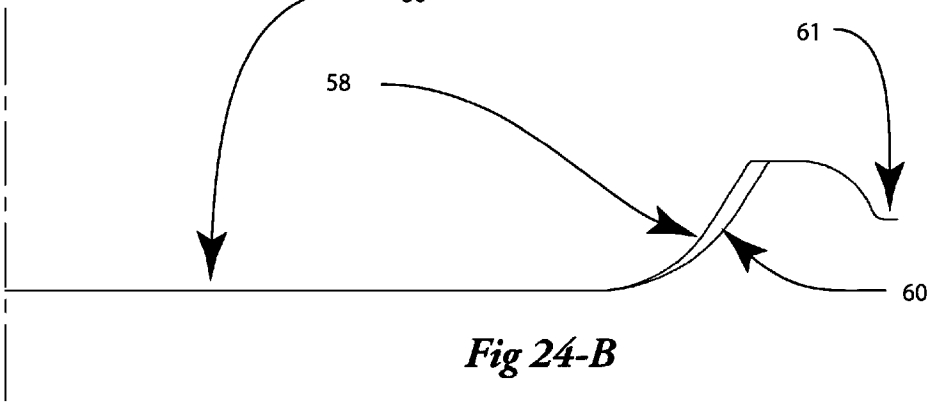
Fig 24-B

RIGID-BUCKLING-RESISTANT-FLUTED PAPERBOARD CONTAINER WITH ARCUATE OUTER REGION

CROSS-REFERENCE TO RELATED APPLICATIONS

This application is a continuation of U.S. patent application Ser. No. 12/728,316, filed Mar. 22, 2010, which claims benefits of U.S. Provisional Patent Application No. 61/211,273, filed Mar. 27, 2009, which are incorporated by reference herein in their entirety.

Paperboard plates are typically used only once but often carry fairly heavy loads. Many innovative designs for paperboard plates over the last several years featuring generally arcuate surfaces have steadily increased the load that plates can carry—even with decreasing board weights. However, as we have tried to implement similar designs with very low board weights, we have found that even though arcuate designs may measure better in terms of standard rigidity tests, in many cases, they are subject to sudden failure through buckling leading to pleat opening. Thus, as we have attempted to make paperboard plates more and more economical by continually decreasing board weight using evolutionary modifications of the recent arcuate surface of rotation designs that we have implemented so successfully in the past, we found that even these evolutionary arcuate surface of rotation designs tested extremely well but were not as practical as might be expected. In particular, it appears that failure modes of paperboard plates at very low board weights are quite different from those of plates made from sometimes only slightly higher board weights. In particular, if very lightweight plates are made in a shape which is an arcuate surface of rotation, these plates can be quite rigid—to a certain point—but then fail suddenly, as once the load reaches the buckling point, deflection increases extremely rapidly with even a very small incremental load. Fluted plates made from medium weight board can have good strength but are usually quite flexible, particularly when they assume a saddle shape under load. However this flexibility can make it difficult to contain a load like beans which are capable of flowing or slipping. However, fluted plates made from very lightweight board are typically both flexible and weak.

To surmount this phenomenon, we had to develop an entirely new design of very lightweight paperboard plate having an outer arcuate region surrounding an inner fluted region. In the course of developing this design, we made many prototypes from quite lightweight board using both arcuate plate shapes that were evolutionary to our earlier work and high strength designs of the present invention. We were able to construct high strength plates that, in actual use, proved quite superior to prototype plates with arcuate designs because these flexible plates do not suddenly collapse by buckling even though the high flexibility designs measure as inferior in rigidity in laboratory testing.

We are able to achieve this increased practicality by providing an economy paper plate having a flexible fluted sidewall and an outer down-turned portion to provide enhanced usable product strength, sturdiness and durability, especially at those lower paper or paperboard weights and calipers where pleating control and press forming becomes far more difficult. Desirably the outer down-turned section takes the shape of an arcuate surface of rotation or a combination of arcuate surfaces of rotation. In the present plate design, the number of flutes and the flute geometry are chosen such that the deep flutes in the sidewall area accommodate the "extra" paper resulting from reduction in circumference when the flat blank is pressed into a formed dish shaped plate contributing a flexible ring between the bottom of the plate and its outer periphery.

In our design, the pleats are largely confined to the arcuate outer portion and do not extend into the sidewall as the "extra" paper is gathered into the flutes in the interior sidewall region without tearing. Even though the fluted region has considerable flexibility, the plate has considerable resistance to very large deformation because the outer down-turned portion of the plate possesses significant hoop strength, anchoring the flutes and preventing extreme movements. Desired outer down-turned portions of the plates exhibit (i) significant vertical drop; (ii) an extended angular wrap; and (iii) pleats with substantial resistance to opening thereby imparting strength to the product. Particularly, desired outer down-turned regions take the shape of an arcuate surface of rotation. Paradoxically, it appears that flexibility of the fluted interior sidewall region serves to protect pleats in the outer arcuate region so that tendencies to sudden pleat opening are reduced as compared to very lightweight plates which are substantially in the shape of a surface of rotation. In turn, the significant hoop strength of the outer region limits deflection as the flutes flex under load. It is theorized that the flexible fluted region distributes the load experienced by the pleats.

To control paper gathering, the blank is desirably scored in regions corresponding to the upper horizontal and outer arcuate regions prior to plate forming so that as pleats are pressed during the forming operation, the shape is set and the product strengthened. Lightweight/low caliper paper plates with similar profile, but without sidewall flutes, have been shown to have somewhat higher laboratory rigidity, but often fail abruptly during use due to buckling and/or pleat opening. The partially fluted paper plate of this invention has both fair to good rigidity but surprisingly increased resistance to buckling during use thus providing practical strength and durability which is unexpected.

Typically, when the most economical pressed paperboard plates are formed, several layers of paperboard are pressed at a time in the forming die set. This makes it difficult to induce and control good pleat formation while also creating undesirable bonds between the plates after they are removed from the plate forming press. These bonds can make it quite difficult for the consumer to obtain only one plate when desired. Of course, when consumers use several plates instead of only one, this defeats the raison d'être of using such modest plates in the first place—low cost. Further, in our experience, when we have examined plates where it appeared that several plates were formed simultaneously with each stroke in a single die set, we have found these plates to be quite weak.

As the plates of the present invention are desirably formed using only a single blank in each die set during each stoke of the forming press, it is possible to avoid extreme adhesive forces such as those that often make it infuriating to try to separate very inexpensive plates from each other. The inventive plate can advantageously be produced on high-speed converting equipment with a single layer of coated or uncoated paperboard. Coated paper is desired since it resists water and grease penetration. If formed in this fashion, economy fluted plates of the present invention possess surprising strength and are individualized and readily separable from each other when dispensed from the stack, since they are formed from one layer of paper per die set per press stroke.

The paper plates of this invention constitute "value" paper plates providing advantages surmounting those of other very lightweight plates such as competitive economy fluted paper plates without the arcuate outer surround as well as foamed plastic plates.

Paper plates of this invention provide enhanced strength and durability versus other competitive fluted and/or pressed paper plates. Coated versions have enhanced grease and water resistance exhibiting less strength lost during use with wet foods. The plates of the present invention can be readily converted using high-speed pressware converting equipment with up to seven tools across as described in U.S. Patent Application Publication No. 2007/0042072. Importantly, whereas many conventional lightweight fluted plates have little rigidity, the present plates are relatively strong. Additionally, as compared to prototype designs made using arcuate surface of rotation profiles solely, the plates of the present invention have greatly reduced tendency toward drastic failure due to buckling. The prototype non-fluted shapes we manufactured tended to fail drastically in a sudden failure due to buckling and pleat opening.

Pressed paperboard plates currently on the market fall into two categories:

(1) high and medium performance pressed paperboard plates similar to those described in U.S. Pat. No. 6,715,630 and U.S. Patent Application Publication No. 2003/0173366 which are typically formed in a conventional plate-forming press from a single blank in each die set, and (ii) economy plates which are formed either by a punch through mechanism as disclosed in U.S. Patent Application Publication No. 2008/0015098 or by stacking several blanks in the die set of a plate forming press so that several, possibly interlocked, plates are formed from each die stroke.

In many cases, economy plates are referred to as "white-no-print" or "WNP" plates as they are typically formed either from uncoated paperboard having a basis weight of approximately 100 pounds per ream or from clay coated board having a basis weight of from 150 to 180 pounds per ream. Typically, white-no-print plates are gravely deficient in wet strength.

Even though the performance of the economy plates is typically very low in terms of rigidity (wet or dry) and ease-of-use, there is significant market demand for such very low cost plates. Despite economies resulting from use of multiple blanks in each die set, considerable wastage of paperboard can occur in manufacturing as, even though there are typically economies involved in web fed presses, web fed presses for economy plates typically accept several webs simultaneously, each being supplied from an individual roll of paperboard. These webs are typically blanked together; then fed into die sets as stacked arrays of blanks which are subsequently formed into stacks of finished paper plates with a single stroke of the press. As mentioned, this process often links the plates together making it difficult, or at least inconvenient, for a consumer to obtain only a single plate from a stack. Further, starting and stopping a press-forming operation is usually quite costly as expensive capital equipment is idled while the process of changing out the supply rolls is fairly labor-intensive. Thus rather than stopping the press each time a single roll is exhausted out of the many rolls being used, it is common to change some or all of the rolls of paperboard at one time rather than waiting for each to be exhausted individually thus potentially creating many wasteful stub rolls.

The purpose of this invention is thus to provide a plate which can be formed quite economically from rather light board, but which, in measured rigidity, practical strength and ease-of-use, surpasses white-no-print plates, even many of those made from far heavier board. This new design appears to surmount phenomena making it difficult to make highly usable lightweight plates using arcuate profiles as the present fluted design is less subject to dramatic failure due to buckling. In some embodiments, the plates of the present invention will not only surpass lightweight white-no-print plates in dry strength but will also possess considerable wet strength and grease resistance making them far more suitable for use with common foods like beans, chili and the like.

In particular, in those embodiments where the board is coated with polypropylene or another grease and water resistant coating, these plates provide a far superior alternative to economy white-no-print paper plates exhibiting a surprising combination of enhanced dispensability, grease and water resistance with strength and durability in actual use. Alternatively, the plates can be advantageously formed from board coated with multiple layers of a styrene-butadiene-rubber/calcium carbonate emulsion as described in pending U.S. patent application Ser. No. 09/418,851, filed Oct. 15, 1999, to Swoboda, entitled A Paperboard Container Having Enhanced Grease Resistance and Rigidity and Method Of Making Same (incorporated herein by reference) or U.S. Patent Application Publication No. 2005/0019512; of Swoboda, et al.; "High Gloss Disposable Pressware".

The fluted white-no-print plate of this invention is not only aesthetically appealing, but also has enhanced utility being well suited to be produced on high speed converting equipment with an additional two nominal 9" plate tools across the press width as described in US 2007/0042072, on a 70" wide press utilizing narrow tool technology. Press speeds in the range of from 50 to 60 cycles per minute are attainable with state of the art plateforming presses.

In some embodiments, a horizontal upper flange may be provided between the fluted interior side wall and the arcuate outer rim portion to produce a pressware paper or paperboard product having a fluted interior sidewall and an arcuate outer rim portion with a substantial vertical drop surrounding said fluted interior sidewall resists shape buckling and pleats opening during use. Similarly, an outwardly deflected evert may be added at the outer periphery of the downwardly and outwardly extending arcuate outer rim to further enhance usable strength as described in U.S. Patent Application Publication No. 2006/0208054, Pressed Paperboard Servingware with Improved Rigidity And Rim Stiffness, Littlejohn et al.; Sep. 21, 2006, based on Provisional application No. 60/512,811, filed on Oct. 20, 2003, incorporated herein by reference.

The combination of the interior fluting and an outer arcuate region enhances the plate's strength in use. At the transition between the fluted sidewall and the outer arcuate region, a controlled upper inside radius desirably between about 0.0025 D and about 0.010 D, more desirably between about 0.0025 D and about 0.015 D, is formed, "D" being the overall diameter of the finished plate. This controlled radius is especially believed to greatly contribute to product strength. Even though fluting the sidewall region decreases the plate's strength tested rigidity, it apparently contributes to enhanced flexibility and seems to increase the plates durability, especially with lower basis weight/caliper paper, allowing for good real-life utility during use without shape buckling and pleats opening. It is hypothesized that the increased flexibility helps the plate adapt to bear a load without forcing the pleats to open. It is also believed that the fluted sidewall contributes to strength by making it easier to achieve a "taller" plate in lightweight board. Throughout the interior sidewall, care is desirably exercised to ensure that the region is pressed into the desired shape without "wasting" too much of the forming force on the fluted region as the benefit to intense pressing on the outer arcuate region is far greater. This is desirably achieved by controlling the respective clearances so that the forming pressure is concentrated on the arcuate outer region.

In one sense, the plate of the present invention can be viewed as a hybrid or combination of two plate shapes. It can be viewed as a plate having an arcuate shape with scallops formed into the interior sidewall or it can be viewed as a fluted plate having lands with an arcuate profile formed therearound. Hence, if the profile is taken along one radius extending through a land, the plate exhibits a profile much like that of an arcuate plate. If that radius is displaced by a few degrees so that it passes through a scallop, the profile, up to the area where the outer arcuate region begins, is similar to that of a fluted plate.

BRIEF DESCRIPTION OF THE DRAWINGS

FIGS. 22A and 22B illustrate the holder used for load to failure testing and illustrate how it is used to support sample plates for testing as herein described.

FIGS. 24A-24D illustrate plates of the present invention having an outwardly extending evert for further reinforcement.

TEST METHODS AND DEFINITIONS

Figure 1:
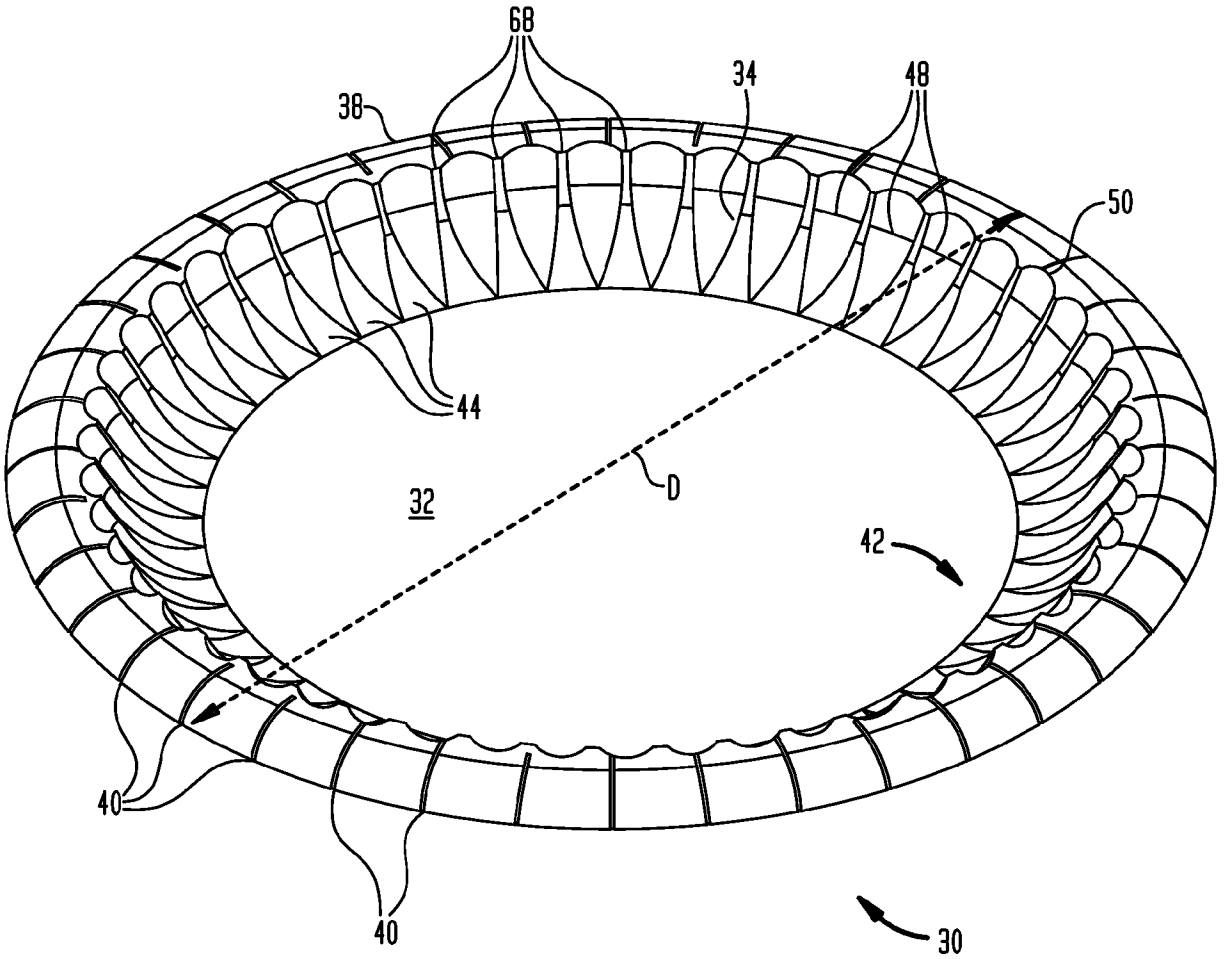
FIG. 1 is a schematic perspective illustrating a pressed paperboard plate of the present invention.

The invention is described in detail below with reference to numerous embodiments for purposes of exemplification and illustration only. Modifications to particular embodiments within the spirit and scope of the present invention, set forth in the appended claims, will be readily apparent to those of skill in the art.

As used herein, terminology is given its ordinary meaning unless a more specific definition is given or the context indicates otherwise. Disposable containers of the present invention generally have a characteristic diameter, "D". For circular bowls, plates, platters and the like, the characteristic diameter is simply the outer diameter of the product. For other shapes, average diameter should be used; for example, the arithmetic average of the major and minor axes should be used for oval or elliptical shapes, whereas the average length of the sides of a rectangular shape is used as the characteristic diameter and so forth. Sheet stock refers to both a web or roll of material and to material that is cut into sheet form for processing. Unless otherwise indicated, "mil", "mils" and like terminology refers to thousandths of an inch and dimensions appear in inches. Likewise, caliper is the thickness of material and is expressed in mils unless otherwise specified. Basis weight is expressed in lbs per 3000 square foot ream, while "ream" refers to 3000 $ft^2$, similarly 90 lb board should be understood to mean paperboard having a basis weight of 90 lb per 3000 sq. ft. ream.

Dimensions, radii of curvature, angles and so forth are measured by using conventional techniques such as laser techniques or using mechanical gauges including gauges of curvature as well as by other suitable technique. While a particular arcuate section of a container may have a shape which is not perfectly arcuate in radial profile, perhaps having some other generally bowed shape either by design or due to off-center forming, or due to relaxation or springback of the formed paperboard, an average radius approximating a circular shape is used for purposes of determining radii such as R1, R2 R3, RF1 or RF2 for example. A radius of curvature may be used to characterize any generally bowed shape, whether the shape is arcuate or contains arcuate and linear segments or comprises a shape made up of joined linear segments in an overall curved configuration. In cases where directional variation around the container exists, average values are measured in a machine direction (MD) of the paperboard, at 90° thereto, the cross-machine direction (CD) of the paperboard as well as at 180° to MD and 180° to CD. The four values are then averaged to determine the dimension or quantity.

While the distinction between a pressware "bowl" and "plate" is sometimes less than sharply defined, especially in the case of "deep dish" containers, a bowl generally has a height to diameter ratio of 0.15 or greater, while a plate has a height to diameter ratio of less than 0.1 in most cases. A "platter" is a large shallow plate which may be oval or any shape other than round. Typically, platters are somewhat larger than plates which have a characteristic diameter of between 6 and 11 inches. By far the most common size for plates is the 9" nominal size, ranging between 8.5 and 9.5" in diameter.

"Rigidity" refers to FPI Rigidity in grams at 0.5" deflection as hereinafter described. The Instron® Plate Rigidity is measured rigidity over a range of deflections, see FIGS. 16A-16H.

Rigidity

Plates can be evaluated for FPI Rigidity. FPI Rigidity is expressed in grams/0.5" and is measured with the Foodservice Packaging Institute Rigidity Tester, available from or through the Foodservice Packaging Institute, 150 S. Washington Street, Suite 204, Falls Church, Va. 22046. This test is designed to measure the rigidity (i.e., resistance to buckling and bending) of paper and plastic plates, bowls, dishes, and trays by measuring the force required to deflect the rim of these products a distance of 0.5" while the product is supported in the tester. Specifically, the plate specimen is restrained by an adjustable bar on one side and is center supported. The rim or flange side opposite to the restrained side is subjected to 0.5" deflection by means of a motorized assembly equipped with a load cell, and the force (grams) is recorded. The test simulates in many respects the performance of a container as it is held in the hand of a consumer, supporting the weight of the container's contents. FPI rigidity is expressed as grams per 0.5" deflection. A higher value is desirable since this indicates a more rigid product. All measurements are done at standard TAPPI conditions for paperboard testing, 73.4±1.8° F. and 50.0±2.0% relative humidity. Geometric mean averages (square root of the MD/CD product) values are reported herein.

For Wet Rigidity the specimen is supported as above, then filled with water at 160° F. for 30 minutes, drained and tested. For 9" plates, 100 ml of hot water is used, while, 130 ml of hot water is used for 10" plates. The % moisture pickup is determined by weighing a specimen before and after treatment with hot water for 30 minutes as specified.

Load to Failure Testing

Plates of the present invention and various conventional plates were tested for their ability to support a simulated food load in a situation closely simulating holding of a loaded plate with one hand as a user might while going through a buffet line. Load to failure testing involved securing the plate at one side while supporting its bottom panel at center (also referred to as: 1 hand hold test) and loading the plate with weights to simulate a food load until failure occurred. The load causing failure is reported as the maximum load; "failure" being determined as the point at which the plate buckled or otherwise could not support the load. The test is better understood with reference to FIGS. 22A and 22B.

The apparatus 372 used to measure load to failure includes a supporting arm 374 which is clamped to a post 376 which is mounted on a base 378 as shown in FIG. 22A. Supporting arm 374 extends outwardly a distance 374*a* from post 376 of about 4⅛". The arm further defines a supporting fork 374*b* which has a supporting span 374*c* across the fork of about 2⅝" (center to center). Further provided is a clamping member 374*d* used to secure a plate such as plate 30 in apparatus 372.

In FIG. 22B, plate 30 is shown in mounted in apparatus 372 wherein fork 374*b* supports plate 30 in its central area and the plate abuts post 376. To determine load-bearing capability, weights such as weight W are used to simulate a food load on an outer portion of the generally planar bottom 32 of plate 30. Weights are added in small increments (¼ lb) until the plate fails. The load just before the load causing failure (lbs) is recorded as the 1 Hand Hold Maximum Dry Weight for this test. Typically the test is repeated for at least two sample plates and the result reported as the average.

While this test is somewhat more qualitative than those noted above for Rigidity, Instron® Plate Rigidity, results again show that the plates of the invention are significantly stronger than plates of like basis weight of the prior art.

Grease Resistance

Where the grease resistance of a plate is measured in the following text, it should be understood to have been measured in accordance with the following procedure using dyed corn oil.

1. 3.8 ml of Oil Red Dye (Red HF Liquid (Organic Dye in Naphthenic Oil); available from: DuPont, Chemical and Pigments Dept.; Wilmington, Del. 19898; 800-441-9442) is transferred by pipette into one gallon of Mazola corn oil and mix thoroughly for a concentration of 0.1%.
2. A sample lot of three to five plates, trays, platters, or bowls is selected of each sample to be tested. Unconditioned samples can be used.
3. A quantity of dyed corn oil is Heated in a 3000 ml round bottom flask to 65-68° C. (150-155° F.); and maintained at this temperature throughout testing.
4. Specimens to be tested are placed on a flat, level table or counter surface covered with clean paper toweling.
5. Heated oil is poured into the first specimen to a depth of 3 mm (⅛ inch) and a timer started,
6. After one minute (or two minutes,) heated oil is poured into the second specimen to a depth of 3 mm (⅛ inch). Additional specimens are filled to this depth at one-minute (or two-minute) intervals, returning the flask of oil to the heat source after each filling to maintain the oil at a temperature of between 150-155° F. (Using one-minute intervals allows for 20 specimens to be tested as a series but if there is excessive through penetration, using two-minute intervals allows for testing 10 specimens as a series.)
7. Twenty minutes after the first specimen has been filled, the oil is poured from the first specimen into a waste container. Residual oil is scraped away with a rubber spatula, then the remaining oil is wiped off with paper toweling.
8. The back side of the specimen is immediately inspected for through penetration. If penetration has occurred, the areas of penetration are outlined with a pen or pencil and saved for evaluation. It is also noted if any oil has soaked through the specimen and wet the underlying paper toweling.
9. The above procedure is repeated with the remaining specimens in the series at one-minute (or two-minute) intervals, using the same sequence that was used in filling the specimens so that each specimen is examined after 20 minutes.

Figure 23:
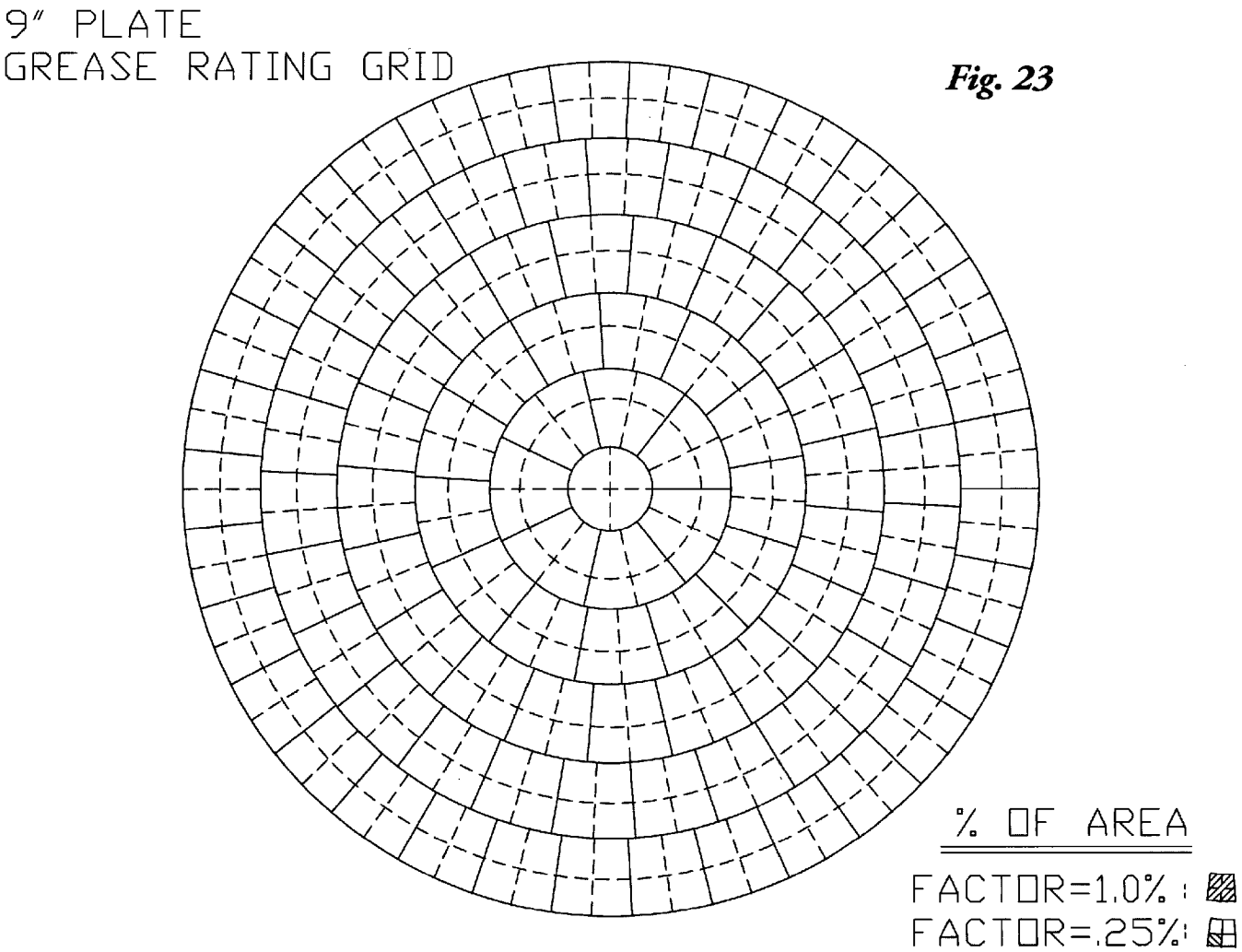
FIG. 23 illustrates the grid used for measuring the percent grease failure used in testing paperboard plates for suitability for use with greasy foods.
Figure 24C:
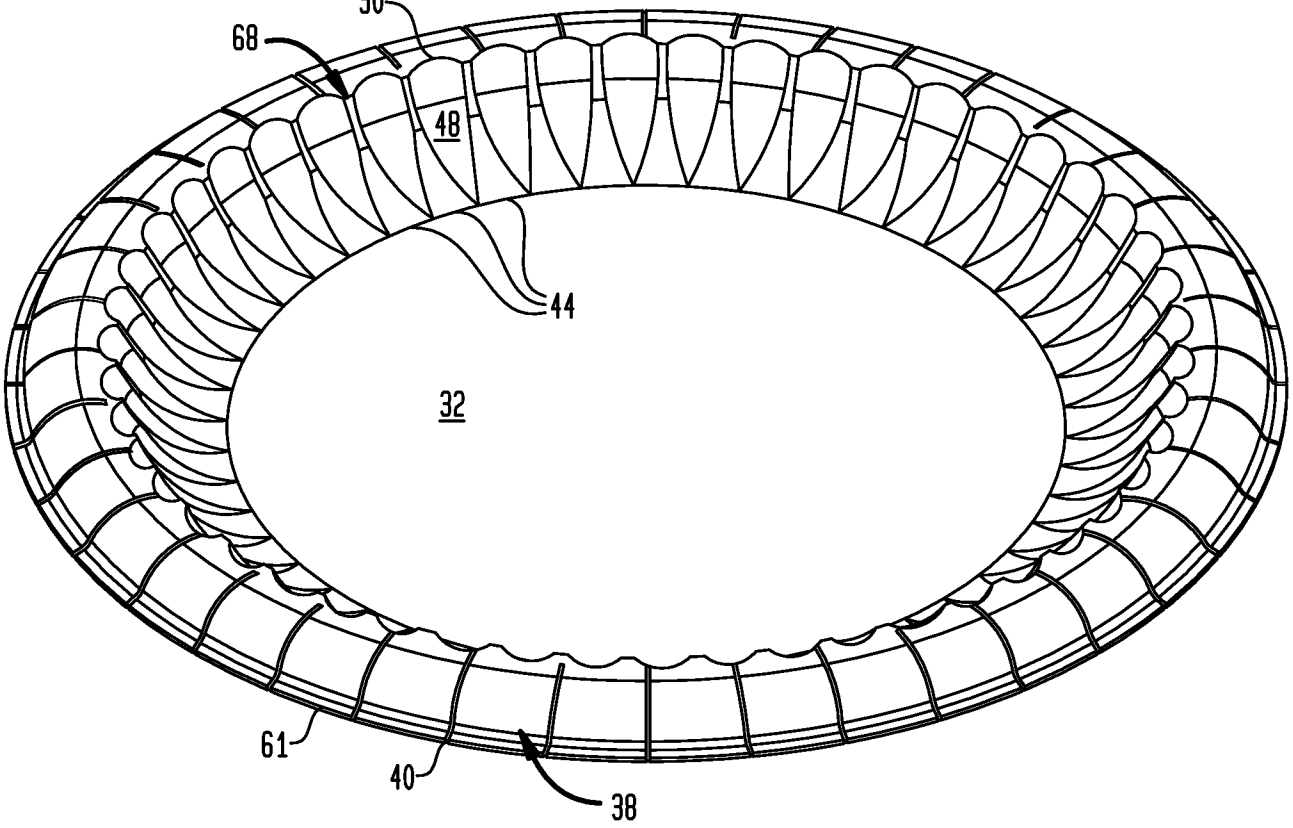
Figure 24D:
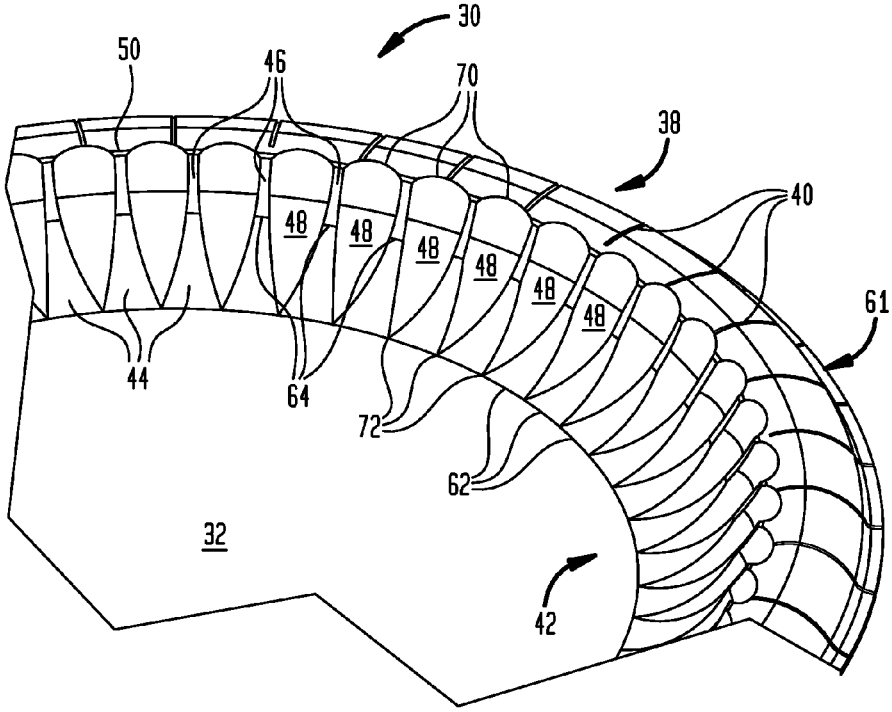

10. The percent failure of each specimen tested is determined by placing an appropriate PCCI grid as shown in FIG. 23 on the back side of the specimen and counting the number of blocks which show oil as outlined by the pen or pencil, the scale of the PCCI grid being adjusted to match the size of the specimen tested.

11. The percentage failure is calculated by multiplying the total number of blocks counted which show penetration by the factor noted on the PCCI grid without counting any wicking outside the marked area.

12. For each sample, the average, standard deviation, and minimum and maximum percent failure are reported to the nearest 1.0% along with the number of replicate measurements and the number of specimens in which any soak-through has occurred.

Instron® Rigidity

In order to further assess performance of the disposable containers of the invention a series of disposable plates was evaluated using an apparatus similar to the FPI rigidity tester described above in connection with an Instron® tester to obtain continuous load versus deflection curves as opposed to the FPI rigidity test described above which only provides a load reading at one deflection, typically at a 0.5 inch deflection. Here again, all measurements were done at standard TAPPI conditions for paperboard testing, 73.4±1.8° F. and 50.0±2.0% relative humidity, reporting separately the averages for the machine direction (MD) and cross machine direction (CD). Different containers were used for the various MD and CD tests so that the larger deflections did not influence the measurements. That is, a given container was tested for CD characteristics and another container was tested for MD characteristics. As in the FPI rigidity test, the containers were restrained in a mounting apparatus about one side thereof and supported about their geometric centers while a probe advanced and deflected the container on its side opposite the side restrained in the mounting apparatus. The force required to deflect the flange of the container a given distance was recorded. Plots of the data appearing in FIGS. 16A-16H report the load at various deflection increments obtained in connection with Examples 11, 12 and 13 as well as Comparative Examples 8, 9 and 10 hereinafter.

The terminology "arcuate" profile refers generally to the geometry shown in connection with the profiles of containers where it is seen that the sidewall of the container is either curved or frustoconical in shape or most commonly composed of combinations of these two shape, it being understood that the terminology frustoconical referring to shapes having a "generally linear" profile is only a special case of arcuate surface of rotation profile (a straight line being an arc with infinite radius of curvature) which refers generally to the geometry shown in connection with the profiles of the inventive containers between the scallops. In some cases, the term "arcuate" will be used as short hand for "arcuate surface of rotation" in which the container takes the shape of a surface of rotation generated by rotating a profile about an axis of rotation. In some cases, a container will be formed by combining portions of several surfaces of rotation as in the case of ovals or other non-circular shapes.

Sheet stock refers to both a web or roll of material and to material that is cut into sheet form for processing.

Unless otherwise indicated, "mil", "mils" and like terminology refers to thousandths of an inch and dimensions appear in inches. Likewise, caliper is the thickness of material and is expressed in mils unless otherwise specified.

The term major component, predominant component and the like refers to a component making up at least about 50% of a composition or that class of compound in the composition by weight as the context indicates; for example, a filler is the predominant filler in a filled plastic composition if it makes up more than about 50% by weight of the filler in the composition based on the combined weight of fillers in the composition.

"Rigidity" refers to FPI rigidity (grams/0.5 inches) unless the context indicates Instron® rigidity.

Basis weights appear in lbs per 3000 square foot ream unless otherwise indicated.

DETAILED DESCRIPTION

A fluted press formed plate 30 of the present invention is shown in FIG. 1, in which generally planar central bottom portion 32 is surrounded by upwardly and outwardly flaring fluted interior wall 34 which in turn is surrounded by outwardly and downwardly extending arcuate annular region 38 having pleats 40 with substantial resistance to opening formed therein. Upwardly and outwardly flaring fluted interior wall 34 is comprised of three main features: (i) upwardly and outwardly extending triangular lands 44; (ii) upwardly extending cylindrical lands 46 (FIG. 5); and (iii) upwardly and outwardly flaring scallops 48. Both upwardly extending cylindrical lands 46 and upwardly and outwardly flaring scallops 48 adjoin outwardly and downwardly extending arcuate annular region 38 at transition line 50 having radius 52 defined therealong. In FIG. 1, each flute 42 corresponds to a single scallop 48 in the form of an elongated, rounded groove as shown. More generally, "flutes" and like terminology refers to furrows, channels, canals, corrugations, indentations, depressions, grooves, and/or other undulations formed into the interior of the sidewall defining an axially extending concavity therein. Typically, the axial extent of the flute will be comparable to the height of the sidewall while the depth in the radial dimension will be a small fraction of an inch while the width (circumferential extent of the flute) will also be a fraction of an inch as is seen in the various embodiments illustrated herein. Inasmuch as flutes in the sidewall desirably take up excess paperboard in the interior wall region without greatly increasing its rigidity or hoop strength, the flutes are generally wider and/or deeper nearer the top of the sidewall and conversely shallower and thinner closer to the bottom although it is possible to form flutes with constant width and increasing depth from bottom to top, or constant depth with increasing width or any other configuration in which the arc length of the flute is sufficient to compensate for the reduction in diameter resulting from the forming operation. In most cases, the depressions constituting flutes on the interior wall will correspond to ridges or lands between flutes on the exterior wall, while the lands on the interior wall will correspond to flutes on the exterior. Even though pleats can be tolerated in the sidewall, it is highly desirable that they have little resistance to opening and desirable that they be easily extensible so that the hoop strength of the sidewall is less than the hoop strength of the outer arcuate region.

Figures 2, 2A, 2B, 2C, 2D:
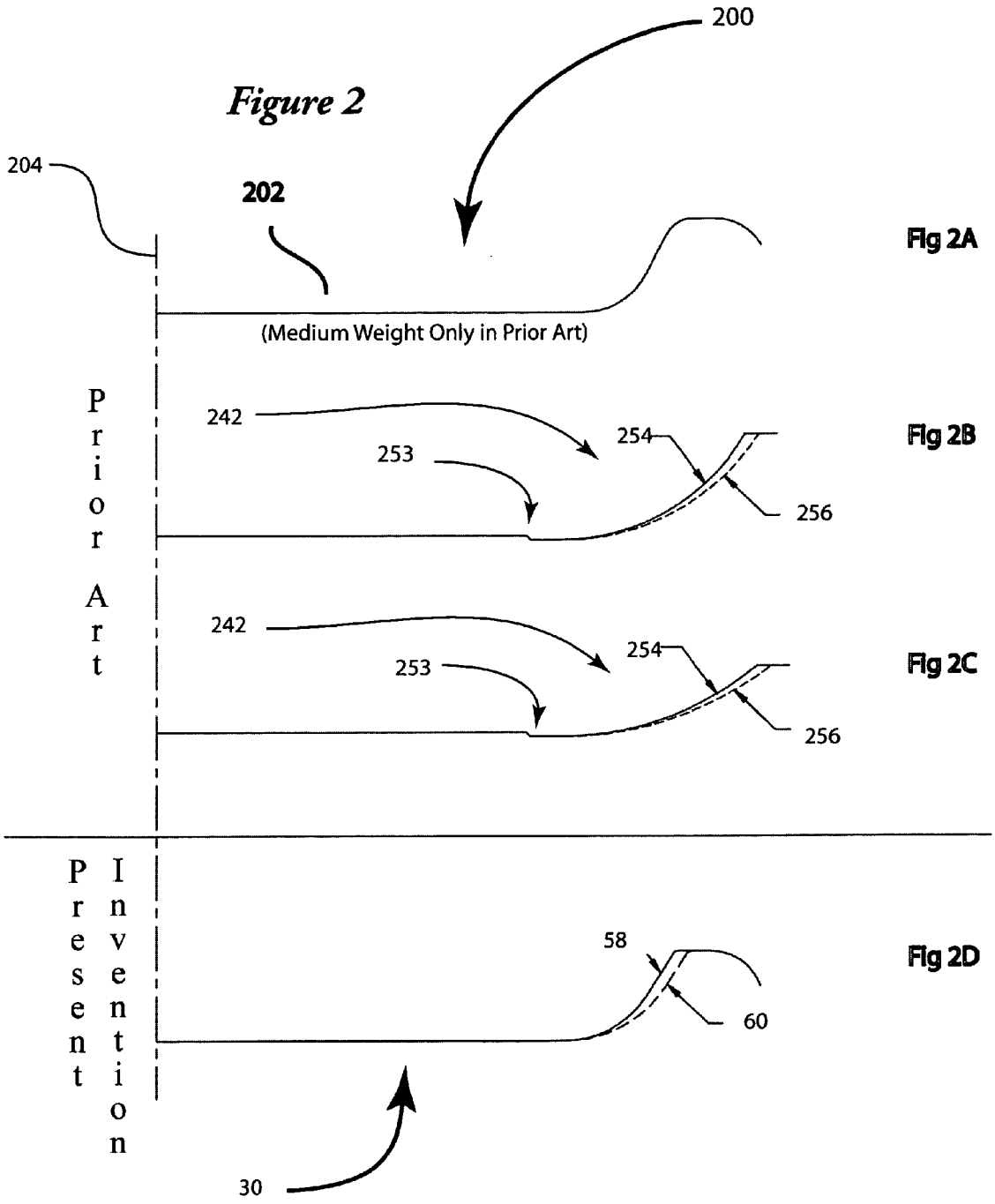
FIGS. 2A-2D are sectional views which compare prior art plate profiles with the profile of the plates of the present invention combining a fluted inner region with an arcuate outer region.

In FIGS. 2A-2D, details of the profiles of the upwardly and outwardly flaring fluted interior wall are shown and compared to profiles of prior art plates. FIG. 2A illustrates the profile of a pressed paperboard plate 200 similar to that described in Littlejohn et al., U.S. Patent Application Publication No. 2003/0173366, Disposable Food Container with A Linear Sidewall Profile and An Arcuate Outer Flange, Published Sep. 18, 2003. On pressed paperboard plate 200, surface 202 is a generally arcuate surface of rotation defined about a central vertical axis 204. In our opinion, this profile along with the other technology presented in that application represents the state-of-the-art in plate forming where the substrate used has substantial basis weight typically over about 155 pounds per 3000 ft.$^2$ ream. However, when we attempt to apply this technology to very lightweight board, we have found that the plates formed are subject to sudden catastrophic failure when loaded to their buckling point. Typically, very lightweight plates will have profiles more similar to those shown in FIGS. 2B and 2C wherein solid line 254 represents the inner surface of the flute 242 while dashed line 256 represents the outer surface of the flute. In our experience, the performance of such fluted plates has ranged from marginal to disappointing.

FIG. 2D illustrates a profile usable in plate 30 of the present invention in which solid line 58 represents the inner surface of the lands 46 separating flutes 42 from each other while dashed line 60 represents the outermost extent of scallops 48 formed in upwardly and outwardly flaring fluted interior wall 34. As applied to very lightweight board in FIG. 2D, outwardly and downwardly extending arcuate annular region 38 surrounds upwardly and outwardly flaring fluted interior wall 34 with the two appearing to interact in such a fashion that upwardly and outwardly flaring fluted interior wall 34 allows outwardly and downwardly extending arcuate annular region 38 to deform without becoming so overstressed as to lead to buckling and failure from pleat opening while outwardly and downwardly extending arcuate annular region 38 appears to provide sufficient hoop strength to prevent flutes 42 from flattening out. This surprising interaction is completely unexpected and contrary to the understandings achieved in manufacturing higher performance plates with heavier board.

Figure 3:
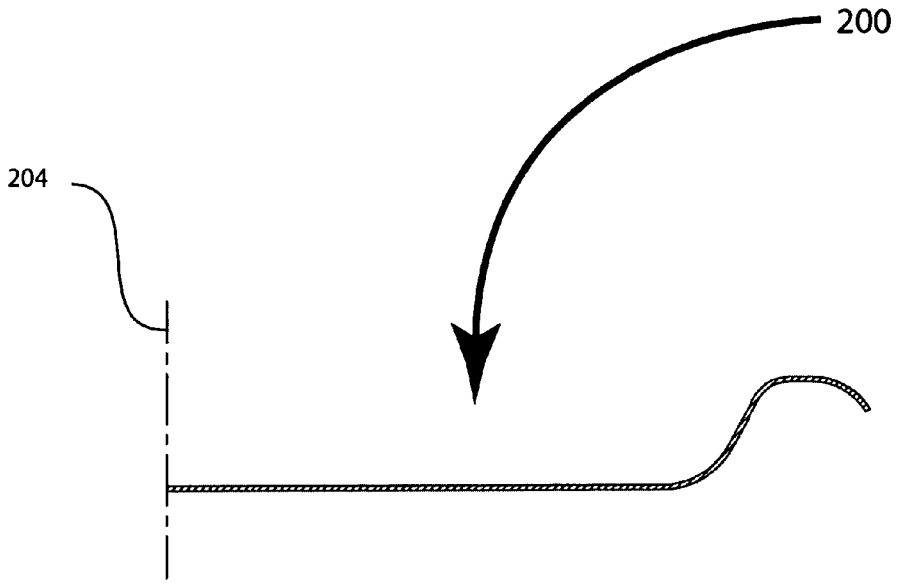
FIGS. 3A and 3B are sectional views taken along line 3-3 in FIG. 5 which illustrate the profile of a plate of the present invention, showing the resemblance to a plate having a generally arcuate profile if viewed a long a radius taken between scallops.
Figure 3:
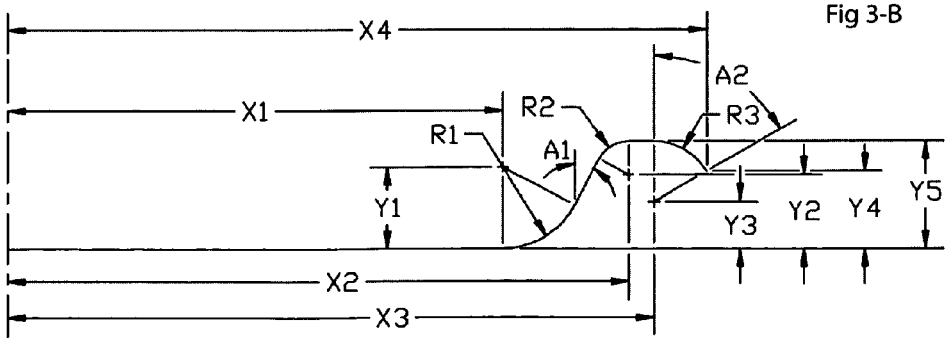
Figure 4:
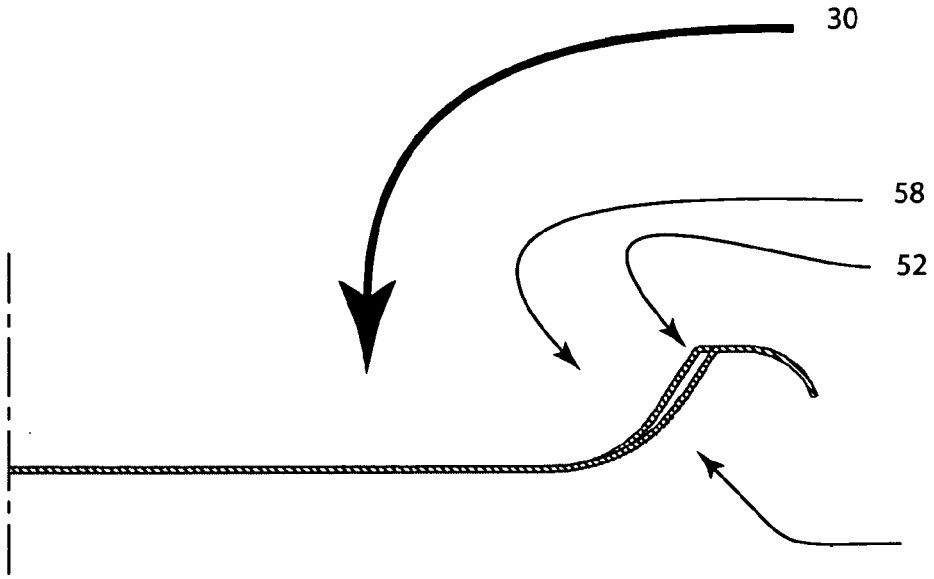
FIGS. 4A and 4B are schematic sectional views taken along line 4-4 in FIG. 5 which illustrate the geometry of the fluting in the interior sidewall of the pressed paperboard plate of the present invention.
FIGS. 4C-4E are isometric perspectives illustrating alternative geometry for the fluting in the interior sidewall of the pressed paperboard plate of the present invention.
FIGS. 4F-4H are schematic sectional views illustrating alternative geometry for the fluting in the interior sidewall of the pressed paperboard plate of the present invention corresponding respectively to FIGS. 4C-4E.
Figure 4:
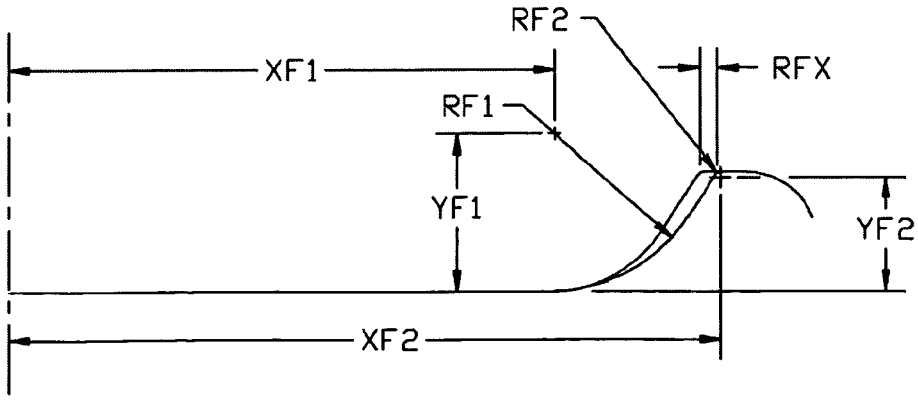
Figure 5:
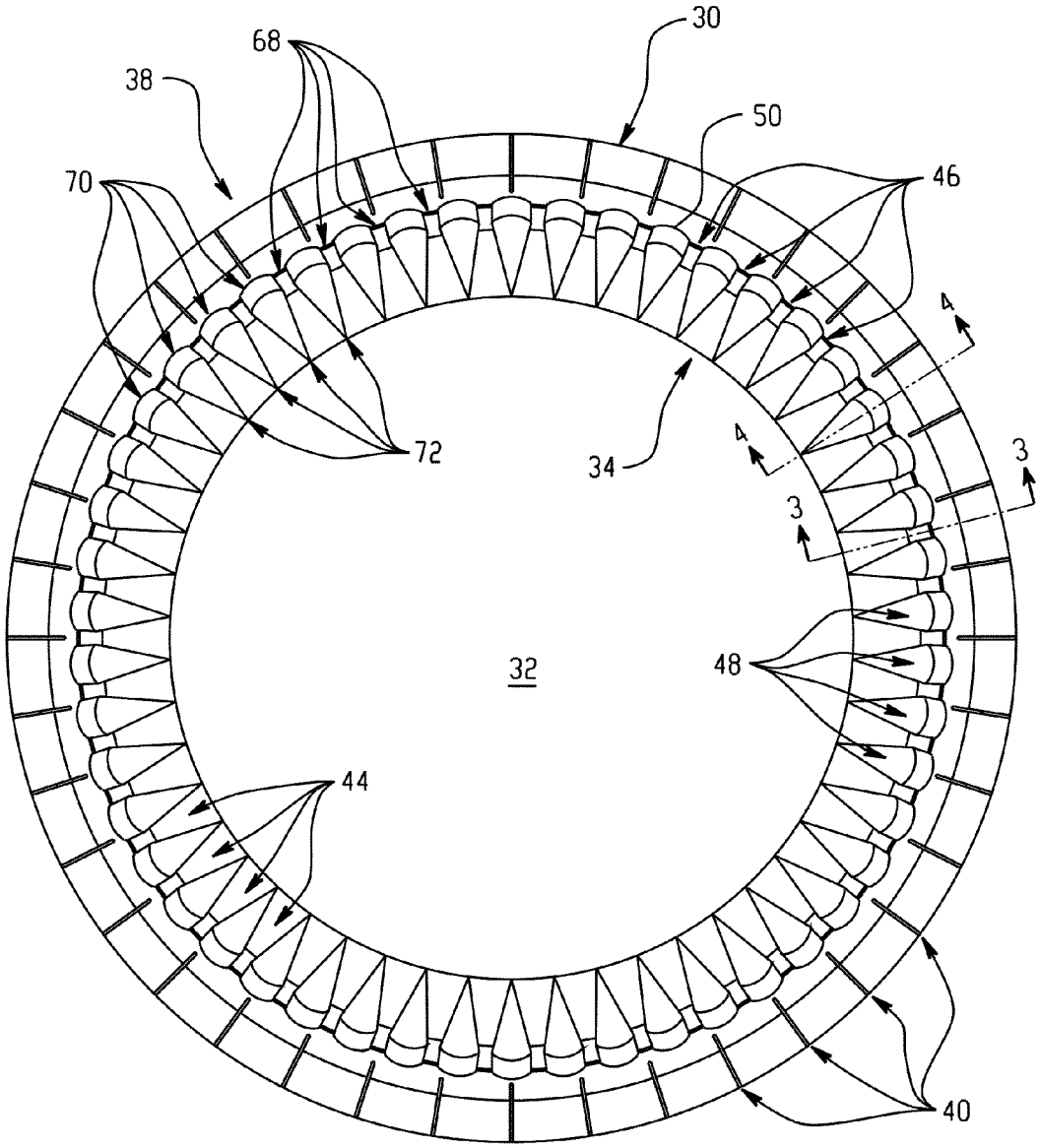
FIG. 5 is a plan view schematic of a pressed paperboard plate of the present invention.

FIGS. 3A and 3B, illustrate the dimensions which have previously been used for the medium weight plate illustrated in FIG. 2A and are presently used in this invention for the profile of the plate passing through the lands between the flutes while FIGS. 4A and 4B illustrate the geometry of fluted portions of the upwardly and outwardly flaring interior sidewall of the desired plate of the present invention. FIG. 5 is a plan view of a desired plate of the present invention in which generally planar central bottom portion 32 is surrounded by upwardly and outwardly flaring fluted interior wall 34 which in turn is surrounded by outwardly and downwardly extending arcuate annular region 38 having pleats 40 with substantial resistance to opening formed therein. Upwardly and outwardly flaring fluted interior wall 34 is comprised of three main features: (i) upwardly and outwardly extending triangular lands 44; (ii) upwardly extending cylindrical lands 46; and (iii) upwardly and outwardly flaring scallops 48. Both upwardly extending cylindrical lands 46 and upwardly and outwardly flaring scallops 48 adjoin outwardly and downwardly extending arcuate annular region 38 at transition line 50 having radius 52 defined therealong.

Desirably, in plates of the present invention, R1 is between 0.500" and 0.75", X1 is between 2.75" and 3.25"; Y1 is between 0.500" and 0.75"; R2 is between 0.025" and 0.125"; X2 is between 3.5" and 3.9"; Y2 is between 0.5" and 0.725"; R3 is between 0.35" and 0.40"; X3 is between 3.75" and 4.25", Y3 is between 0.22" and 0.3"; X4 is between 4.0" and 4.5"; Y4 is between 0.375" and 0.425"; Y5 is between 0.6" and 0.7"; A1 is between 30.0° and 35.0°; A2 is between 65° and 75°; RF1 is between 0.75" and 1.0"; XF1 is between 2.75" and 3.25"; YF1 is between 0.75" and 1.0"; RF2 is between 0.015" and 0.085"; XF2 is between 3.6" and 4.0"; YF2 is between 0.5" and 0.62"; and RFX is between 0.05" and 0.15".

Figure 4F:
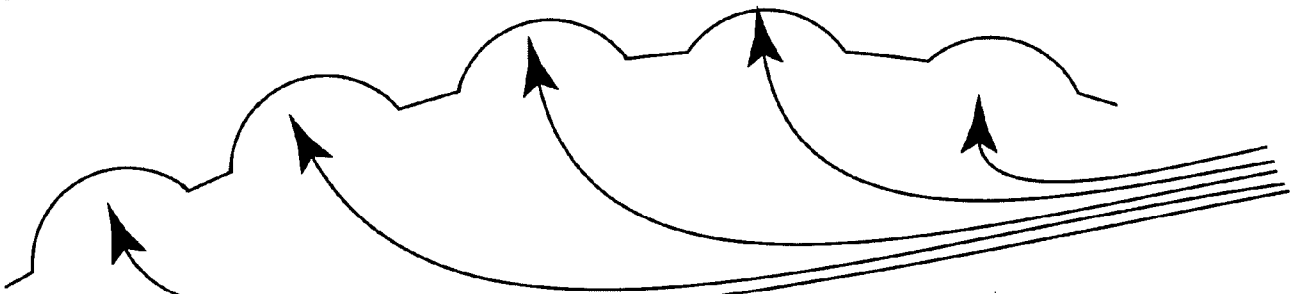
Figure 4G:
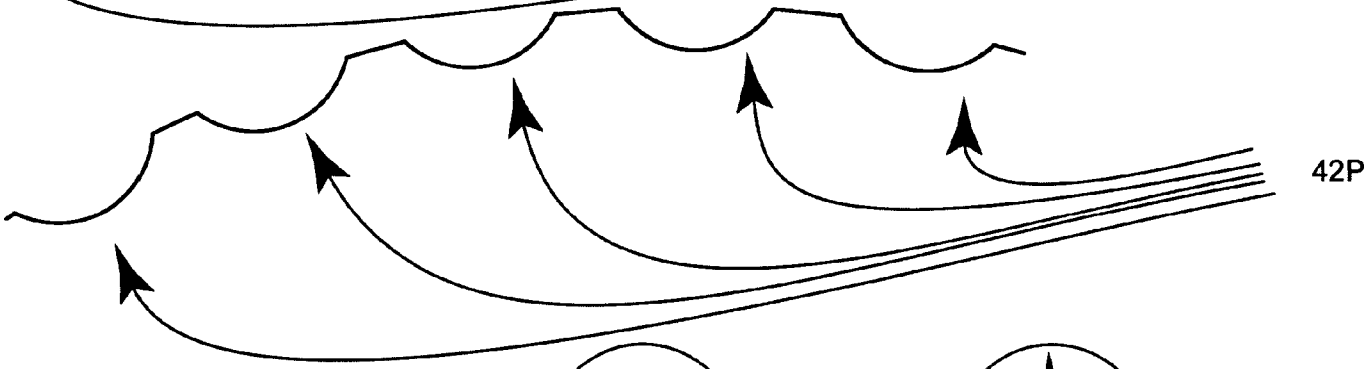
Figure 4H:
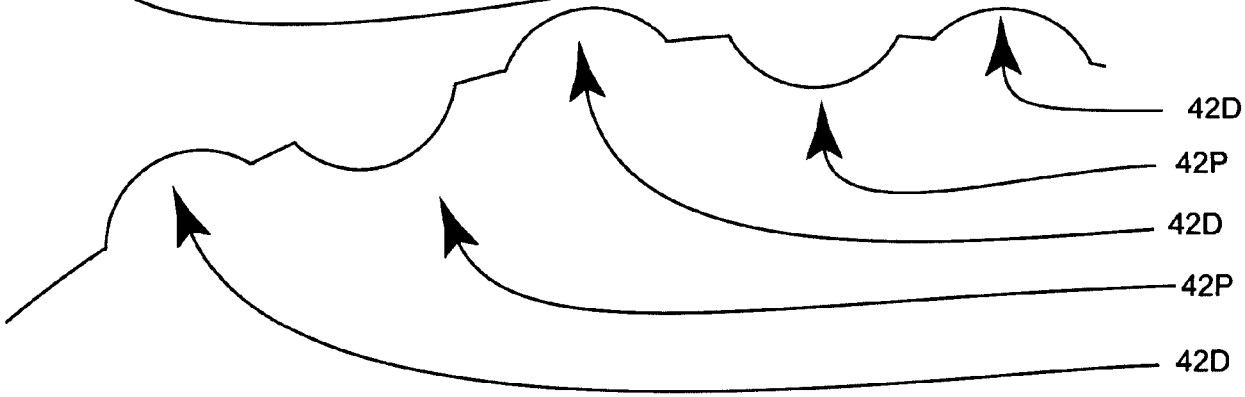

FIGS. 4C-4E are isometric perspectives illustrating various combinations of convex and concave fluting that can be used in forming plates of the present invention in which flutes 42P project inwardly from upwardly extending sidewall 34 into the eating area of the plate while flutes 42D are depressions projecting outwardly toward the exterior of the plate. FIGS. 4F-4H are sectional views from FIGS. 4C-4E respectively illustrating the profiles of the sidewall of the plates in FIGS. 4C-4E. Any combination of flute geometries can be used so long as it takes up the excess paper resulting from drawing the blank into the center of the die set used for forming the plate.

Figure 6:
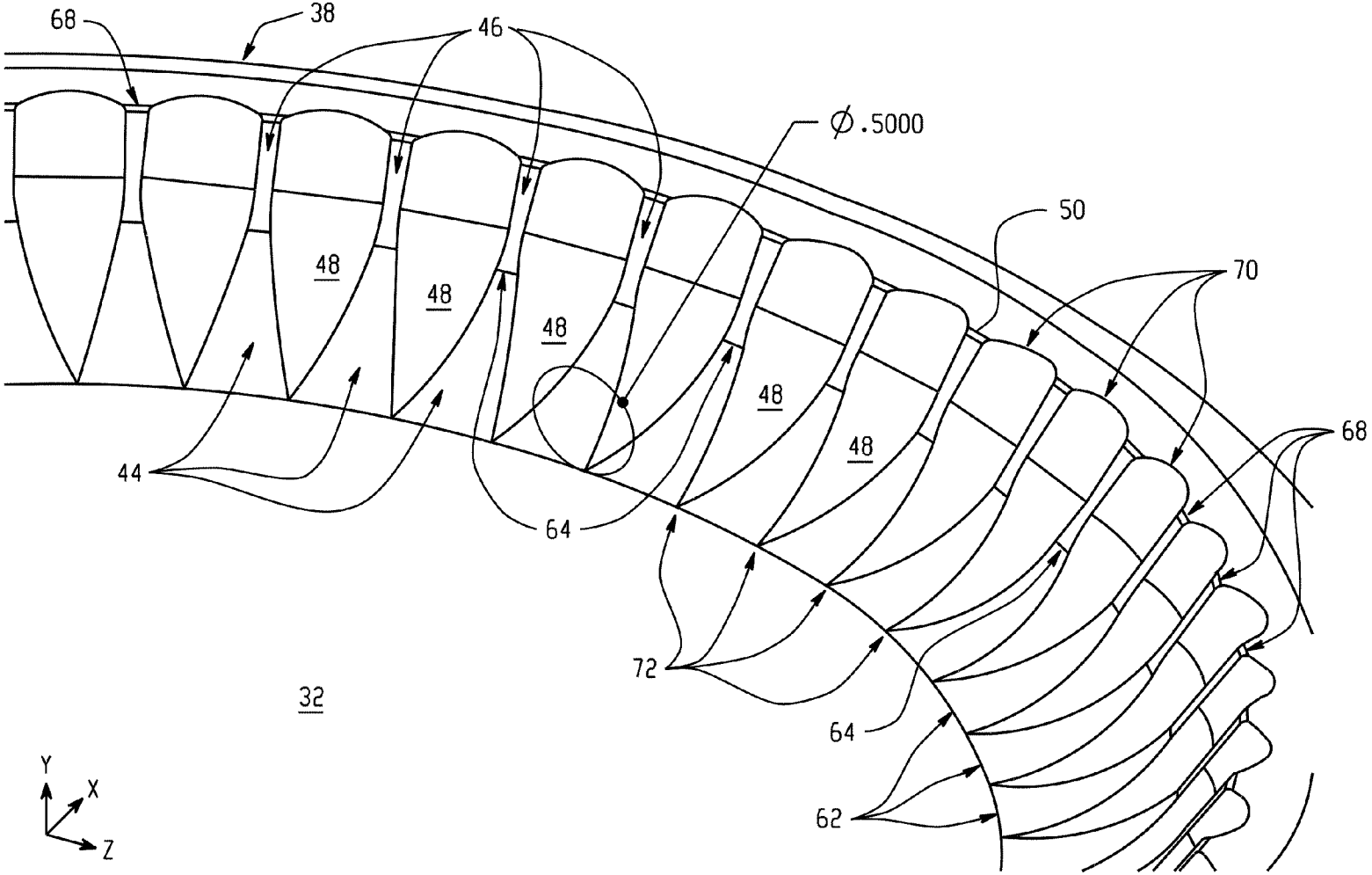
FIG. 6 is an enlarged schematic perspective illustrating the fluting geometry of a pressed paperboard plate of the present invention.

FIG. 6 illustrates detail in upwardly and outwardly flaring fluted interior wall 34 in which bases 62 of upwardly and outwardly extending truncated triangular lands 44 adjoin generally planar central bottom portion 32 adjacent vertices of upwardly and outwardly flaring scallops 48. Truncated triangular lands 44 extend upwardly and outwardly between upwardly and outwardly flaring scallops 48 and are truncated at vertices 64 where they adjoin upwardly extending cylindrical lands 46; and upwardly and outwardly flaring scallops 48. Both upwardly extending cylindrical lands 46 and upwardly and outwardly flaring scallops 48 adjoin outwardly and downwardly extending arcuate annular region 38 at transition line 50 having radius 52 defined therealong.

Each flute 42 in upwardly extending fluted region 34 is separated from adjacent flutes 42 by upwardly outwardly extending triangular land 44 each of which are generally frustoconical sections having a width of at least 0.0055 D at uppermost extremity 68. Desirably, each flute 42 in upwardly extending fluted region 34 flares upwardly and outwardly from generally planar bottom region 32 defining scallop-shaped concavity 48 having a width of at least about 0.03 D at its uppermost extremity 70. Desirably, each flute 42 in upwardly extending fluted region 34 flares upwardly and outwardly from generally planar bottom region 32 defining scallop-shaped concavity 48 increasing in width and depth from its lower terminus 72 near generally planar bottom region 32 and having a width of at least about 0.03 D and a depth of at least about 0.005 D at its uppermost extremity 70. In machining recesses in which scallops 48 are formed in die contour 104 of die ring 102, it may be convenient to use a small ball mill (not shown) having a diameter of between 0.25" and 0.75" to form concavities corresponding to scallops 48 in a single pass after the interior peripheral surface of the die contour has been created, usually by turning on a lathe in the case of plates having a circular shape. In the present case, flutes 42 such as those indicated at 42D in FIGS. 4C, 4D and 4E are formed by pressing scallops 48 into the interior wall 34 of plate 30 so that the flutes 42D correspond to depressions in the interior surface of upwardly extending fluted region 34. Accordingly, if flutes 42 take this form, they also correspond to projections on the exterior surface of upwardly extending fluted region 34. Conversely, equivalent structures could as well be formed by forming depression into the exterior wall on plate 30 or, if desired, alternating scallops, some projecting outwardly interspersed with scallops projecting inwardly could be used as shown at 42P in FIGS. 4C-4H. While the scallops in the presently desired embodiments are symmetrical about radial lines, spirals, arcs and helical shapes or any other shape which effectively takes up the excess board resulting from the plateforming operation. It is however desired that the shape chosen exhibit some flexibility, like a bellows or accordion, rather than being rigid like a shell or conic section. It is considered highly desirable that the hoop strength of upwardly extending fluted region 34 is considerably less than that of outwardly and downwardly extending arcuate annular region 38. This hoop strength can be measured by carefully cutting circumferentially extending portions from either section then tensile testing a small portion of the section removed taking care to align the circumferential direction of the sample with the axis of the tensile tester and ensuring that only undamaged regions are included between the clamps of the tensile tester. So long as the initial slope of the tensile curve obtained from the upwardly extending fluted region 34 is no more than half that for the outwardly and downwardly extending arcuate annular region 38, this condition can be deemed to be satisfied. Desirably the initial slope of the fluted section will be less than 0.2 lb/mil while the slope of the arcuate rim section will be greater than about 0.5 lb/mil of extension.

Figure 7:
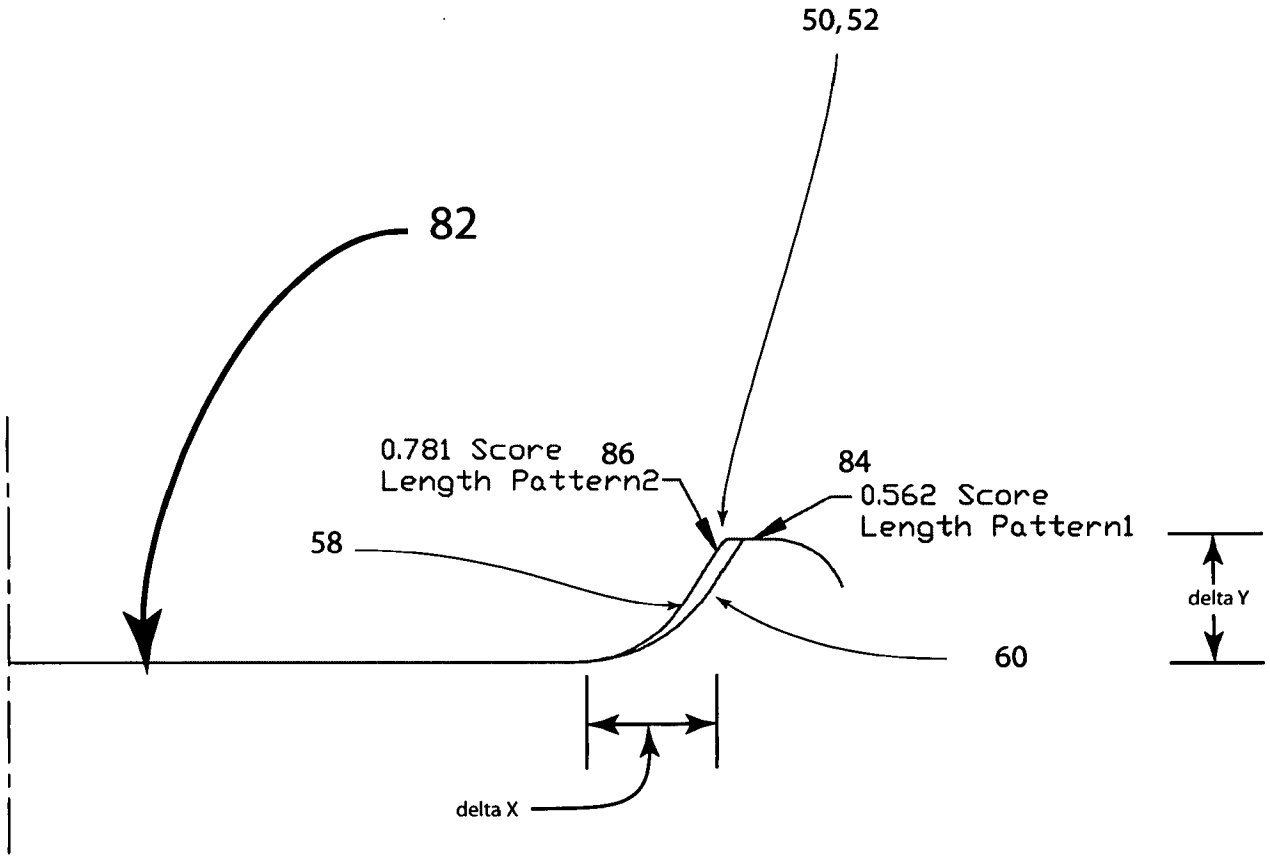
FIG. 7 is a sectional view illustrating the inter-relationship between the scoring of the blank with the fluting and pleats of the formed plate.
Figure 8:
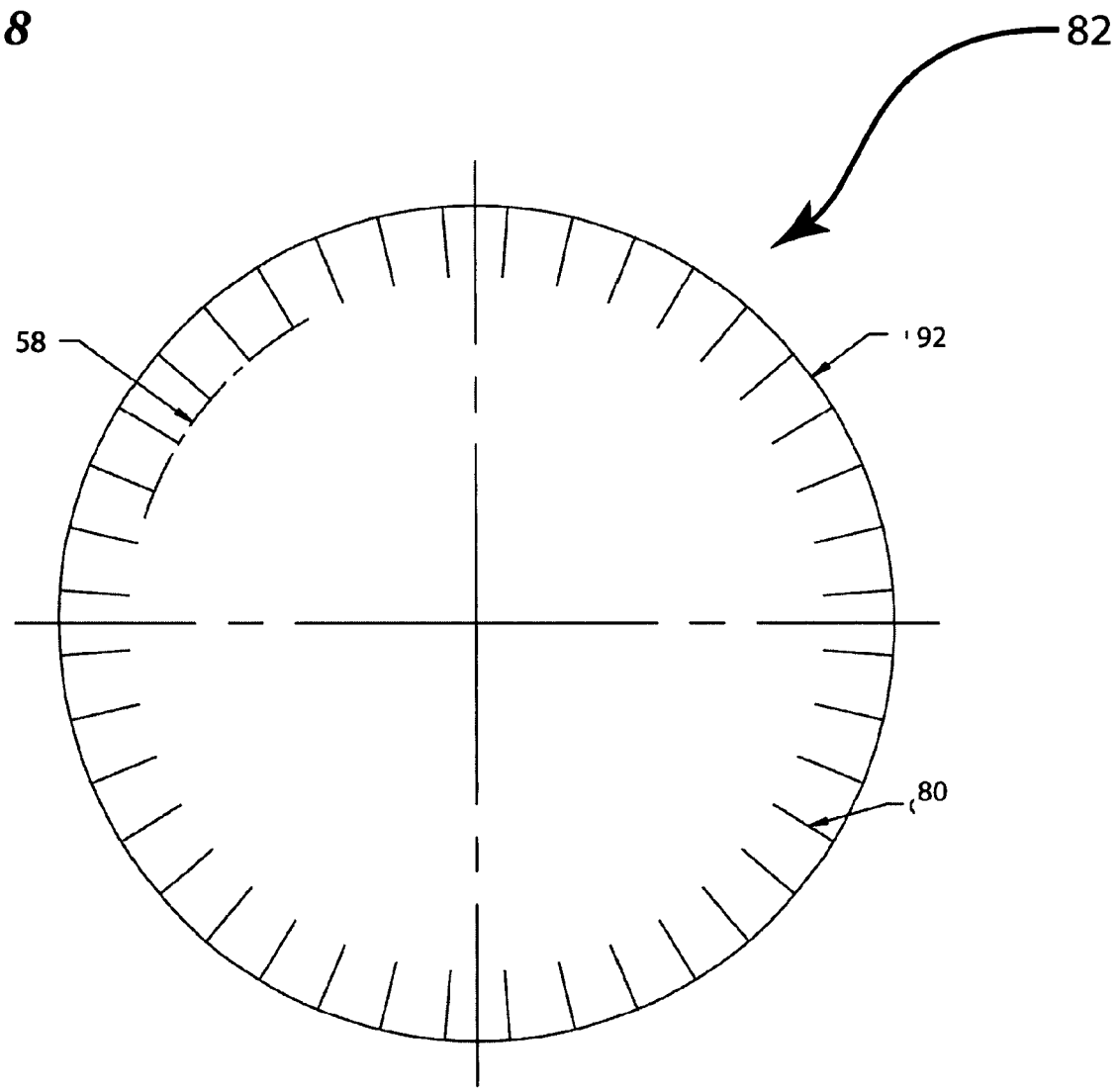
FIG. 8 is a plan view illustrating a scored blank prior to pressing.

FIG. 7 illustrates a cross-section through a flute of a plate of the present invention. If the length of scores 80 provided on blank 82 do not have sufficient length to extend into scallops 48 in fluted press formed plate 30, stopping for example at 84, it has been found that pleats 40 may not be aesthetically pleasing having a random or wandering character between the end of score line 80 and scallop 48. However, if scores 80 extend slightly past radius 52 separating arcuate outer region 38 from upwardly and outwardly flaring fluted interior wall 34, pleats 40 will generally extend radially leading to a tidier appearance. In particular, if scores 80 extend inwardly by only 0.562" to plate having the dimensions given in Table 1, the appearance is somewhat diminished from the case when scores 80 extend inwardly by 0.781" as indicated at 86. FIG. 8 illustrates scored blank 82 having a plurality of evenly spaced score lines 80 extending radially inwardly from the outer periphery 92 of blank 82. Generally planar central bottom portion 32 is desirably entirely planar, but may be crowned or have a "gravy ring" feature similar to that depicted in FIGS. 2A and 2B at 253.

Plates of the present invention benefit from the presence of a steep side wall which can make it somewhat easier to efficiently contain and control food stuffs on the plate. In one embodiment of plates of the present invention, the sidewall angle (of the straight portion) is desirably about 32 degrees from vertical for a rise (delta Y) of about 0.3" over a run (delta X) of 0.21". Many competitive coated plates do not have a well defined sidewall angle but will exhibit a rise (delta Y) of about 0.3" over a run (delta X) of 0.45". This relatively less defined sidewall can detract from the usable area of the plate particularly when semi-liquid food stuffs are disposed on the plate and are free to slip and/or slide on the surface of the plate. Desirably the rise of the plates of the present invention will be between about 0.2" and 0.5" occurring over a run of between 0.15" and 0.25".

In some cases, it will be advantageous to add an evert 61 to the overall shape of the plates of the present invention as shown in FIGS. 24A-24D, which may be added at the outer periphery of the downwardly and outwardly extending arcuate outer rim to further enhance usable strength as described in U.S. Patent Application Publication No. 2006/0208054, Pressed Paperboard Servingware with Improved Rigidity And Rim Stiffness, Littlejohn et al.; Sep. 21, 2006, based on Provisional application No. 60/512,811, filed on Oct. 20, 2003, incorporated herein by reference.

A wide range of paperboards may be used for manufacture of the plates of the present invention. However, even though strong, serviceable and attractive plates can be formed using paperboard of any weight, the present invention is most advantageous with respect to very light weight boards. It appears that previously known technology used for manufacturing plates from heavier weight board is not quite as advantageous for ultralight weight boards. Desirably, plates of the present invention can be formed with relatively low weight paper in the 85 to 150 lb/ream range although for economy reasons, the invention is most advantageous with board ranging from 90 to 130 pounds per ream with board in the range of 90 to 120 pounds per ream being more desired. We consider it highly remarkable that we have been able to achieve such an outstanding combination of rigidity and practical strength with board having a basis weight in the range of 95 to 120 pounds per ream. In many cases, the ability to use such light board makes it possible to use functional coatings which might otherwise be cost prohibitive and thus add greatly to the functionality of the plate while retaining an economy price.

Because this product is intended to be an economy product, in many cases, the cost of functional oil and water impermeable coatings may be significant or even prohibitive so board bearing only a clay coating on its upper surface may be used for some price points. Even though plates made from clay coated boards may not be as durable in wet conditions as plates coated with other variations such as polypropylene resin or Styrene Butadiene Rubber/Calcium Carbonate ($SBR/CaCo_3$) coatings, which produce a more impermeable, continuous barrier, clay-coated paperboard does provide considerable advantage to uncoated board. A 10-15 lb/ream application of polypropylene extrusion coating can provide a pin-hole free barrier to grease and water. At the lower end of this range, considerable care may be required to ensure that the coating is pinhole free. As shown later herein, even small pinholes seriously degrade the wet strength of the plate. However, in view of economic considerations, this extra care can be typically justified by the savings in polypropylene. Quite advantageously, polypropylene coated plates can be formed with heated die sets using temperatures up to about 320° F., while typically 260° to 280° F. die temperatures are desired to obtain a good balance between product formation and release. In this application, we desire use of a highly extrudable polypropylene such as Phillips Sumika (Marlex HMX-370 Modified Polypropylene homopolymer). It is not always necessary to extrusion coat the polypropylene film directly onto the paperboard. In many cases, pre-extruded or freestanding polypropylene film or any other suitable plastic extruded or laminated resin may also be employed; but desire use of board which is extrusion coated with a suitable polypropylene.

In any event, board used for this product can optionally be printed or coated with functional grease/water resistant barrier but is desirably is moistened prior to blanking and forming. A clay coating by itself resists grease and water, and is much better than an uncoated paper for wet use applications. In many cases, clay-coated paperboard may need additional moisture applied to it prior to forming to allow for shape formation, stretch without tearing/cracking, and pleat pressing/reformation. Typically, moistening to about 8 to 10% moisture is suitable although, in some cases particularly for deeper draws as in forming bowls, moisture contents in the range of as 12% or higher may be desirable.

If it is desired to print on the plate, the process must be adjusted depending upon which coating technique is desired. Uncoated paper may be printed prior to polypropylene extrusion coating, or may have a backside printed polypropylene film laminated to it if desired. Other suitable high temperature resins may be extrusion coated onto the paper or film laminated. Polypropylene coated paper also may benefit from application of additional moisture prior to forming.

Alternatively if $SBR/CaCo_3$ coatings are desired, the paper will normally be printed after application of $SBR/CaCo_3$ press applied coatings. Several layers of these coatings are desirably applied to obtain a pin-hole free barrier. Additionally, $SBR/CaCo_3$ coatings often require a functional grease/water resistant barrier over layer to prevent sticking to hot forming dies. In all cases, careful control of moisture content of the board prior to forming can be quite beneficial.

Figure 9:
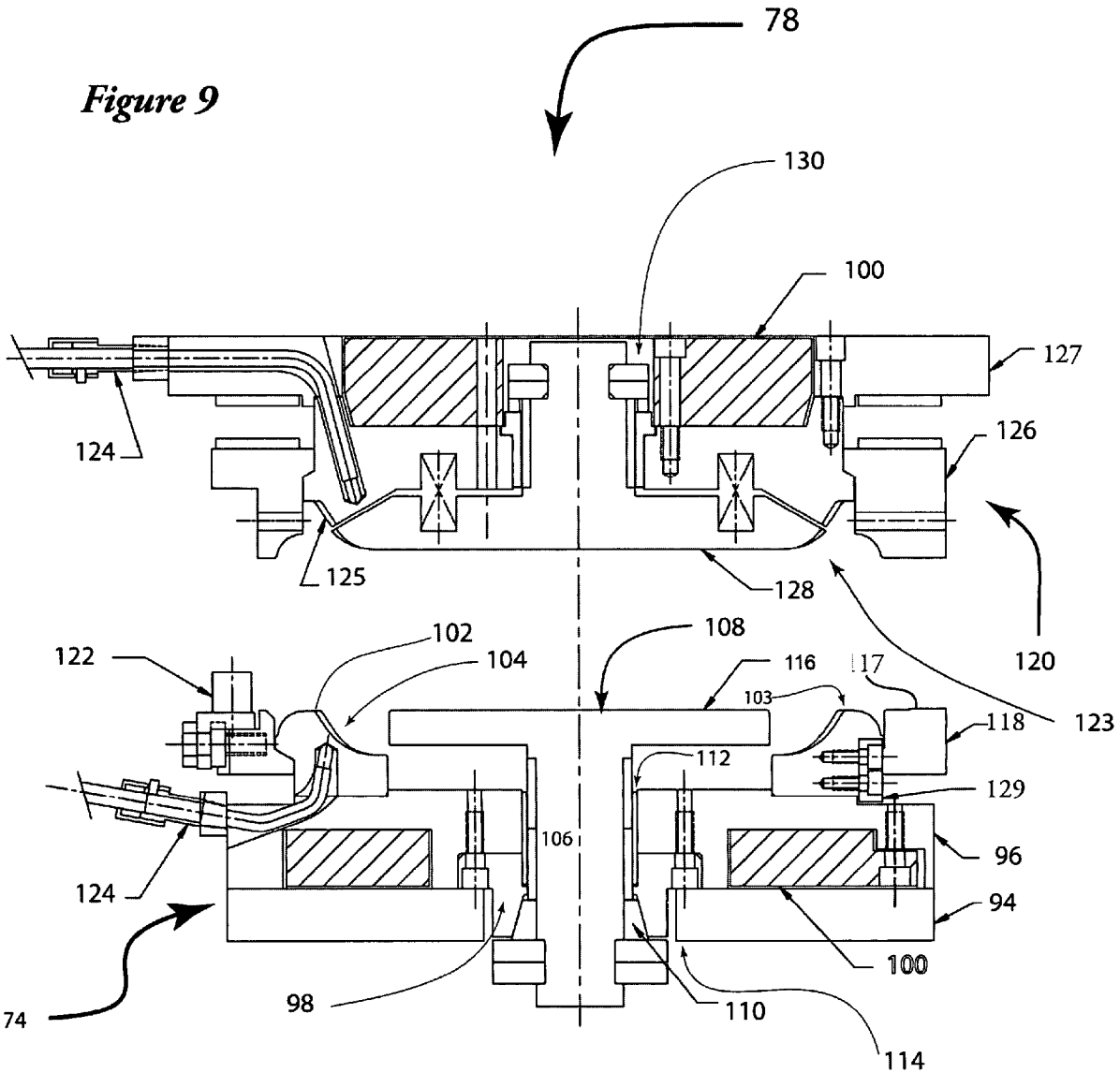
FIG. 9 is a sectional view illustrating a die set suitable for pressing of plates of the present invention in which the die set is in the open position.

FIGS. 9 through 12 illustrate a die set usable in the practice of the present invention. FIG. 9 is a sectional view looking in the cross machine direction illustrating die set 78 for press forming plates 30 of the present invention in the open position in which it is ready to accept blanks 82 for pressing. Annular spacer 94 has annular die base 96, female die knockout stop 98, cast heater 100, and annular die ring 102 bearing annular die contour 104, formed thereinto. Die knockout shaft 106 bearing die knockout 108 has male knockout stop 110 mounted thereabout and passes through opening 114 in annular spacer 94, female die knockout stop 98 and opening 112 in die base 96. Die knockout 108 is movable axially and as die set 78 operates retracts to the position shown in FIG. 10. As shown in FIG. 9, die knockout 108 is fully extended engaging conical knockout stop 98 with upper surface 116 substantially level with uppermost extremity 117 of draw ring 118, and uppermost extremity 103 of die contour 104 in surrounding die ring 102.

In operation, inertial blank stops 122 as disclosed in U.S. Pat. No. 6,592,357, arrest scored blank 82 as it slides into position resting upon draw ring 118, die contour 104 and upper surface 117 of draw ring 118 prior to initiation of the pressing sequence. Cast in heaters 100 serve to heat die assembly 78 to operating temperature as disclosed in U.S. Pat. No. 6,932,753. Side mount die thermocouple 124 protrudes into die contour 104 to facilitate accurate control of temperature during the forming process as disclosed in U.S. Pat. No. 6,585,506.

Punch assembly 120 comprises punch base 127 having punch body 125, and pressure ring 126 mounted thereupon with an optional captive punch knockout 128 retained by optional retainer rings 130 and punch body 125 being movable axially during the pressing operation. As above, cast in heaters 100 serve to heat punch assembly 120 to operating temperature while side mount punch thermocouple 124 protrudes into punch body 125 to facilitate accurate control of temperature during the forming process. Punch assembly 120 is an articulated punch in which the optional punch knockout 128, and pressure ring 126 retract relative to punch base 127 during the forming cycle so that scored die blank 82 resting against inertial pins stops 122 is first gripped between pressure ring 126 and draw ring 118 as die set 78 closes and then is pressed between punch contour 123 and die contour 104 when die set 78 is fully engaged. Clearances between die contour 104 and punch contour 123 are carefully controlled so that at full closing of die set 78, the bulk of the force applied by the press is exerted upon outer arcuate region 38 similar to the teachings of U.S. Pat. No. 4,609,140 to Van Handel et al. It is not necessary to apply as much force to the upwardly and outwardly flaring fluted interior sidewall, so long as sufficient force is applied to form fluted interior wall 34 into the desired shape. Even though pleat integration into substantially integrated fibrous structures is not required, it is highly desirable that formed pleats 40 in formed plate 30 have the ability to resist opening at least a moderate degree as discussed below.

Figure 10:
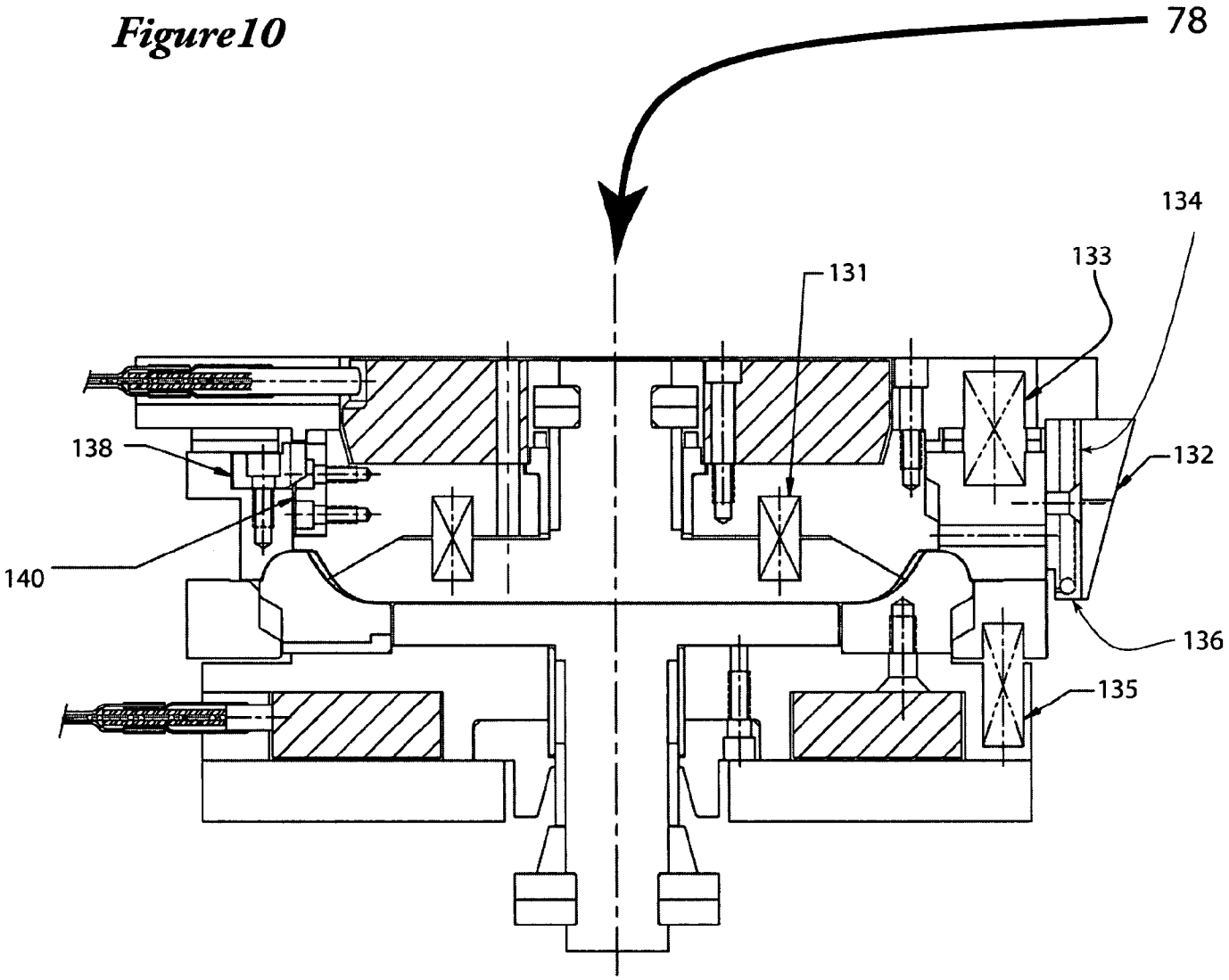
FIG. 10 is a sectional view illustrating a die set suitable for pressing of plates of the present invention in which the die set is in the closed position.

FIG. 10 is a sectional view looking in the cross machine direction illustrating die set 78 for press forming plates 30 of the present invention in the closed position in which the blank 82 (not shown in FIG. 10) is retained between punch contour 123 and die contour 104 for pressing. In FIG. 10, articulated punch knockout springs 131 are compressed as are pressure ring springs 133. Similarly draw ring springs 135 are also compressed. In FIG. 10, optional pressure ring mounted air ejection nozzle 132 is indicated whereby air passing through conduit 134 to nozzle 136 is directed against formed plate 30 and assists in removal of formed plate 30 from die set 78. In FIG. 10, optional wear inserts 138 and die anti-rotation keys 129 are also illustrated to prevent rotation of pressure ring relative to the punch base.

Figure 11:
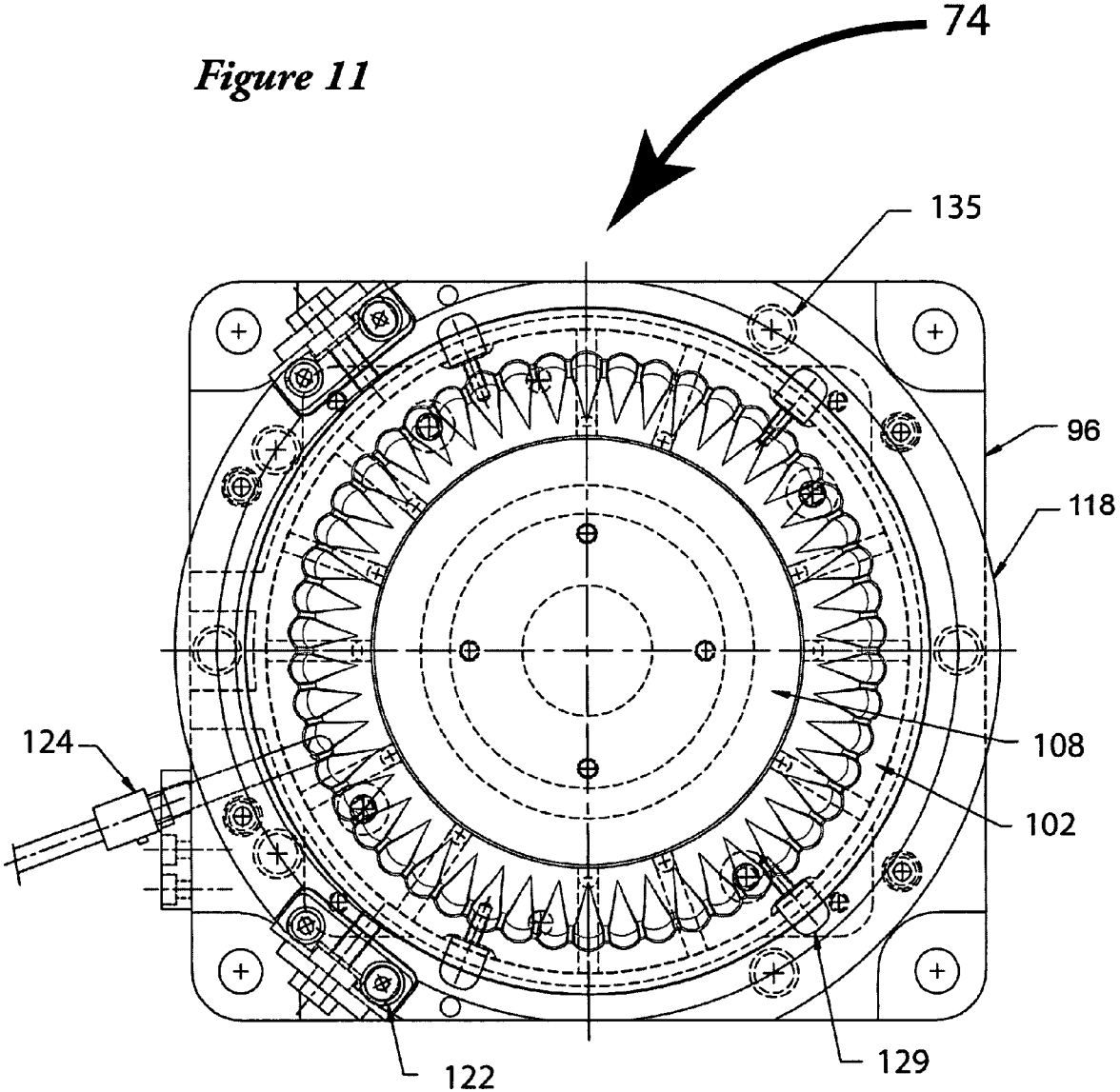
FIG. 11 is a plan view, illustrating some features in phantom, of a die assembly suitable for pressing of plates of the present invention.
Figure 12:
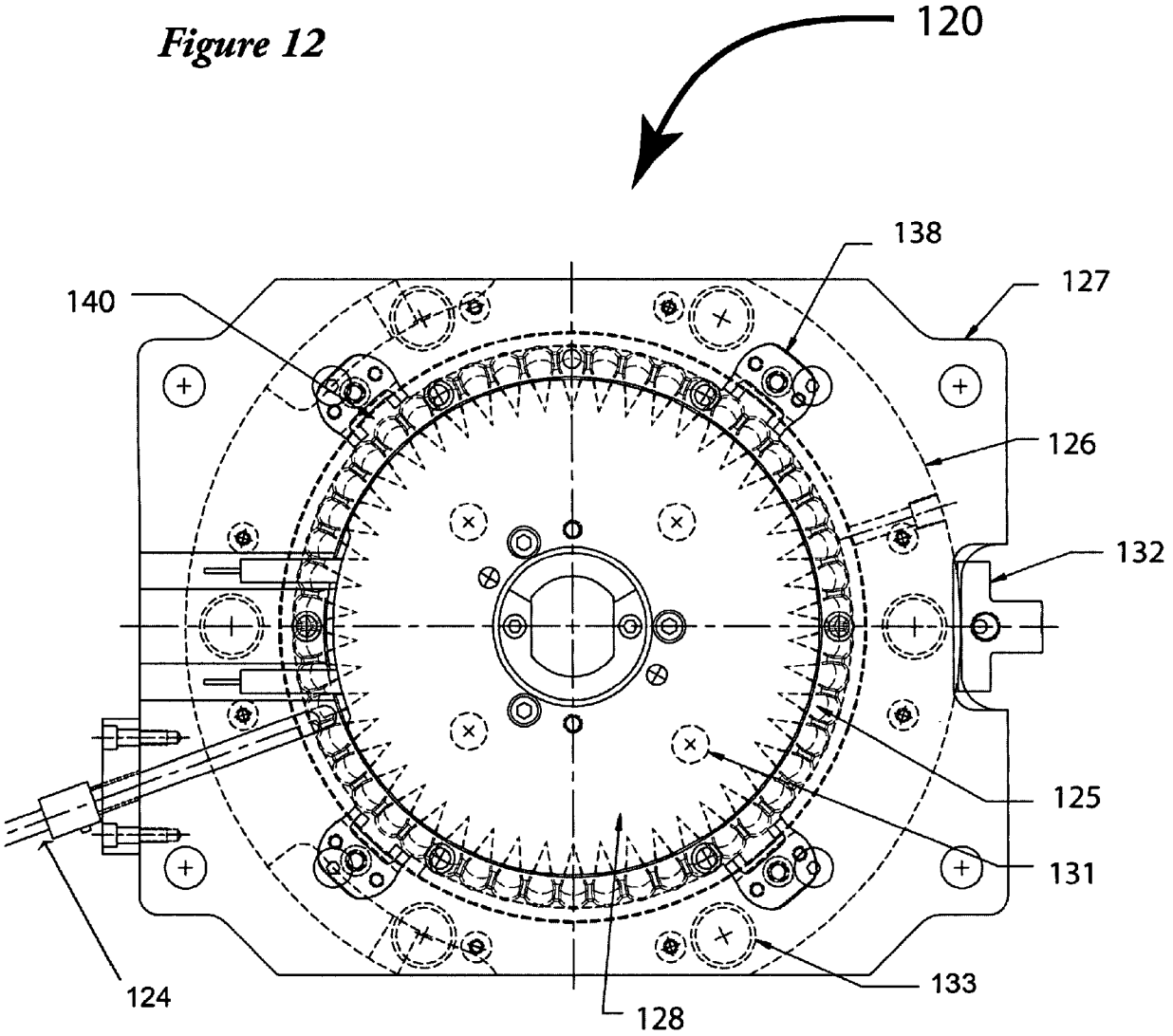
FIG. 12 is a plan view, illustrating some features in phantom, of a punch assembly suitable for pressing of plates of the present invention.

FIG. 11 is a sectional plan view of die assembly 74 in which the relative dispositions of inertial blank stops 122, die anti-rotation keys 129, side mount thermocouple 124 and draw ring springs 135 may be more fully appreciated. FIG. 12 is a sectional plan view of punch assembly 120 in which the disposition of wear inserts 138 anti-rotation keys 140 and pressure ring springs 133 may be more fully appreciated. Example dimensions for the die set for a plate having an overall finished diameter "D" of around 8.625" (9" nominal) are as set forth in Table 1 below wherein X4 is the radius of the plate or half of the diameter D.

TABLE 1

Example dimensions for 9" Nominal Plate Forming dies

| | Medium weight prior art profile | Base profile in cross-sections between flutes of a plate embodiment of the present invention |
|---|---|---|
| | Die Profile Dimensions: (Blank Diameter = 9.375") | |
| R1 | 0.4991" | 0.6740" |
| X1 | 3.0467" | 2.9178" |
| Y1 | 0.4991" | 0.6740" |
| R2 | 0.2095" | 0.0900" |
| X2 | 3.8226" | 3.7447" |
| Y2 | 0.4548" | 0.5500" |
| R3 | 0.3761" | 0.3721" |
| X3 | 3.9799" | 3.9424" |
| Y3 | 0.2882" | 0.2679" |
| X4 | 4.3044" | 4.2957" |
| Y4 | 0.4782" | 0.3849" |
| Y5 | 0.6643" | 0.6400" |
| A1 | 27.5° | 32.5° |
| A2 | 60.0° | 71.7° |
| | Die Flute Dimensions: (Base profile - flutes, measured at maximum depth of the scallop) | |
| RF1 | | 0.8250" |
| XF1 | | 2.9175" |
| YF1 | | 0.8250" |
| RF2 | | 0.0260" |
| XF2 | | 3.8039" |
| YF2 | | 0.6140" |
| RFX | | 0.0949" |

Desirably a 0.488" diameter ball mill is used to cut flutes.

Forces ranging from 6,000 to 15,000 pounds may be desired to form the higher basis weight products while lower forces ranging from 1500 to 8000 pounds may be desired to form the lower basis weight products.

Evaluating comparative performance of plates of this invention is made fairly difficult by the fact that there are very few, if any, competitive plates made from board having a basis weight of less than 150 pounds per 3000 square-foot ream that have rigidity comparable to the plate present invention. In particular, medium and high-performance plates are typically made from board having a basis weight in excess of 160 pounds per 3000 square-foot ream. In many cases, these medium and high-performance plates have remarkable rigidity. However, our attempts to design very lightweight plates using arcuate surface of rotation shapes similar to those shown in U.S. Pat. No. 6,715,630 yielded plates with remarkable stiffness which were unfortunately susceptible to sudden collapse when heavily loaded. In our experience, such plates were unlikely to provide consumers with a fully satisfactory experience. However, there is very little ground for comparing the plates of the present invention with typical lightweight fluted plates sold in commerce today as the lightweight fluted plates will typically have very little rigidity. Accordingly, we feel that the most meaningful comparisons are comparisons between the plates of the present invention and hypothetical arcuate surface of rotation plates made from very light board even though such plates are not commonly found on the market. In our opinion, the most meaningful question is not whether the plates of the present invention are markedly superior to competitive plates—the meaningful question is "why adopt the present design for very lightweight plates when the previously existing medium and heavyweight arcuate surface of rotation plates exhibit such remarkable rigidity?"

Figure 13A:
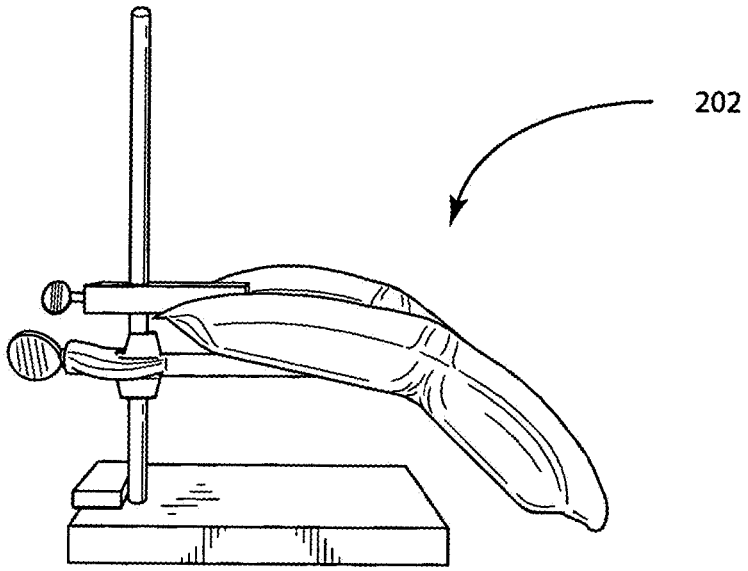
FIGS. 13A and 13B are schematics illustrating the performance of a lightweight arcuate surface of rotation plate under load.
Figure 13B:
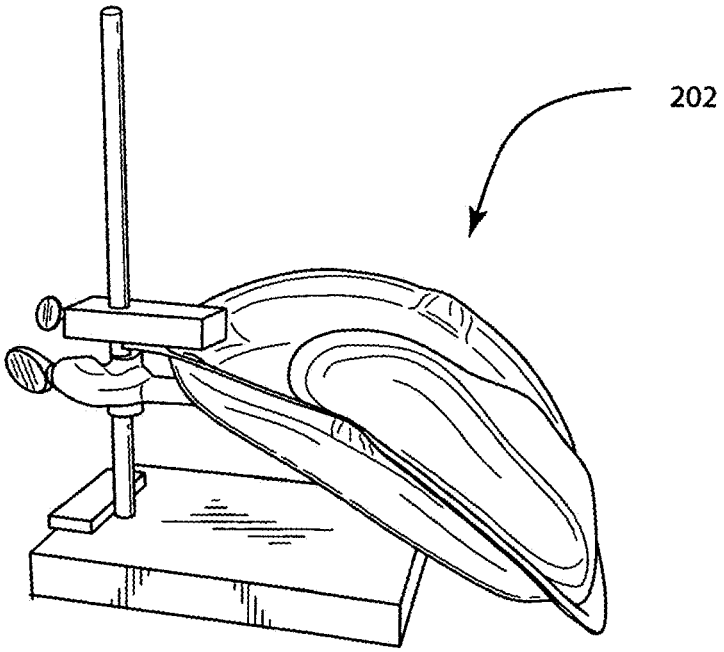
Figure 14A:
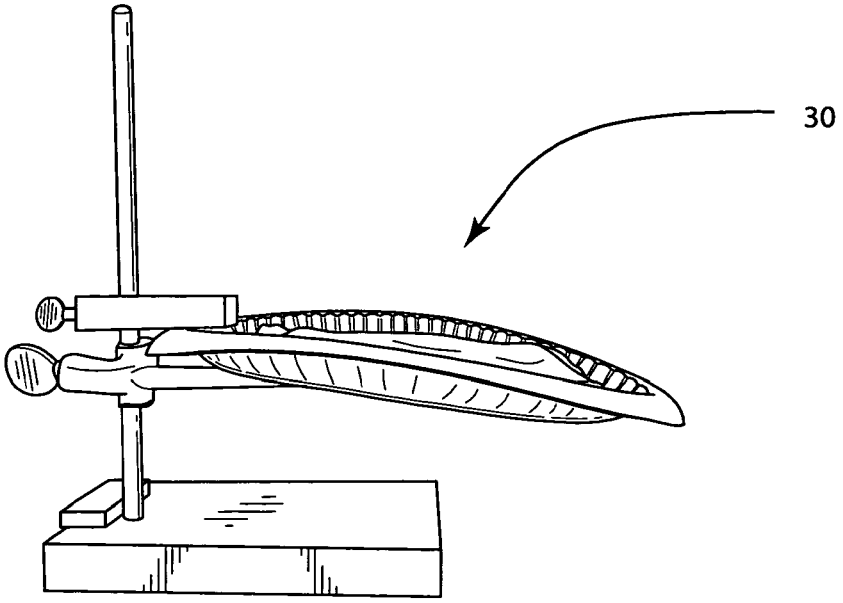
FIGS. 14A and 14B are schematics illustrating the performance of a lightweight plate of the present invention under load.
Figure 14B:
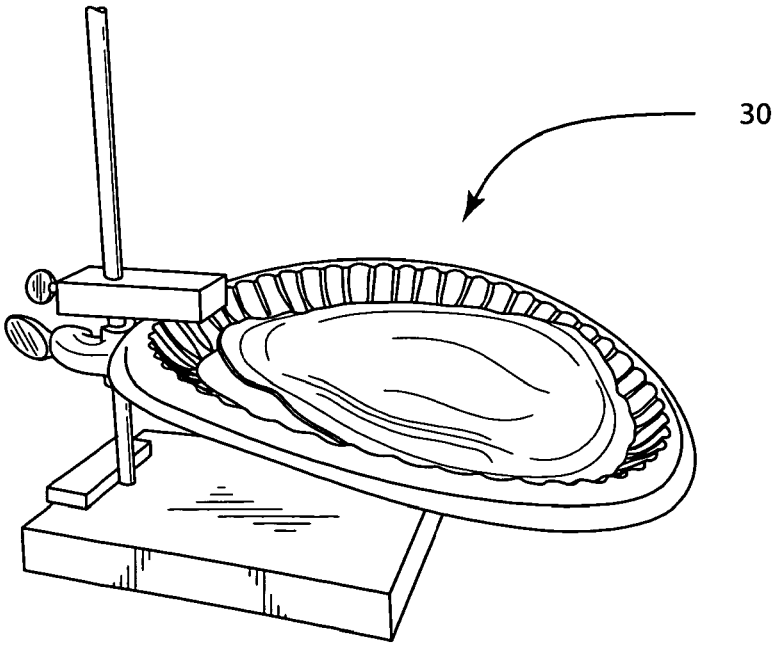

The answer to this question is best understood in viewing FIGS. 13A and 13B as compared to FIGS. 14A and 14B illustrating performance under a load of ¾ pound of two plates made from equivalent basis weight board, the plate of FIGS. 13A and 13B taking the form of an arcuate surface of rotation while the plate of FIGS. 14A and 14B embodies the present invention.

Figure 15:
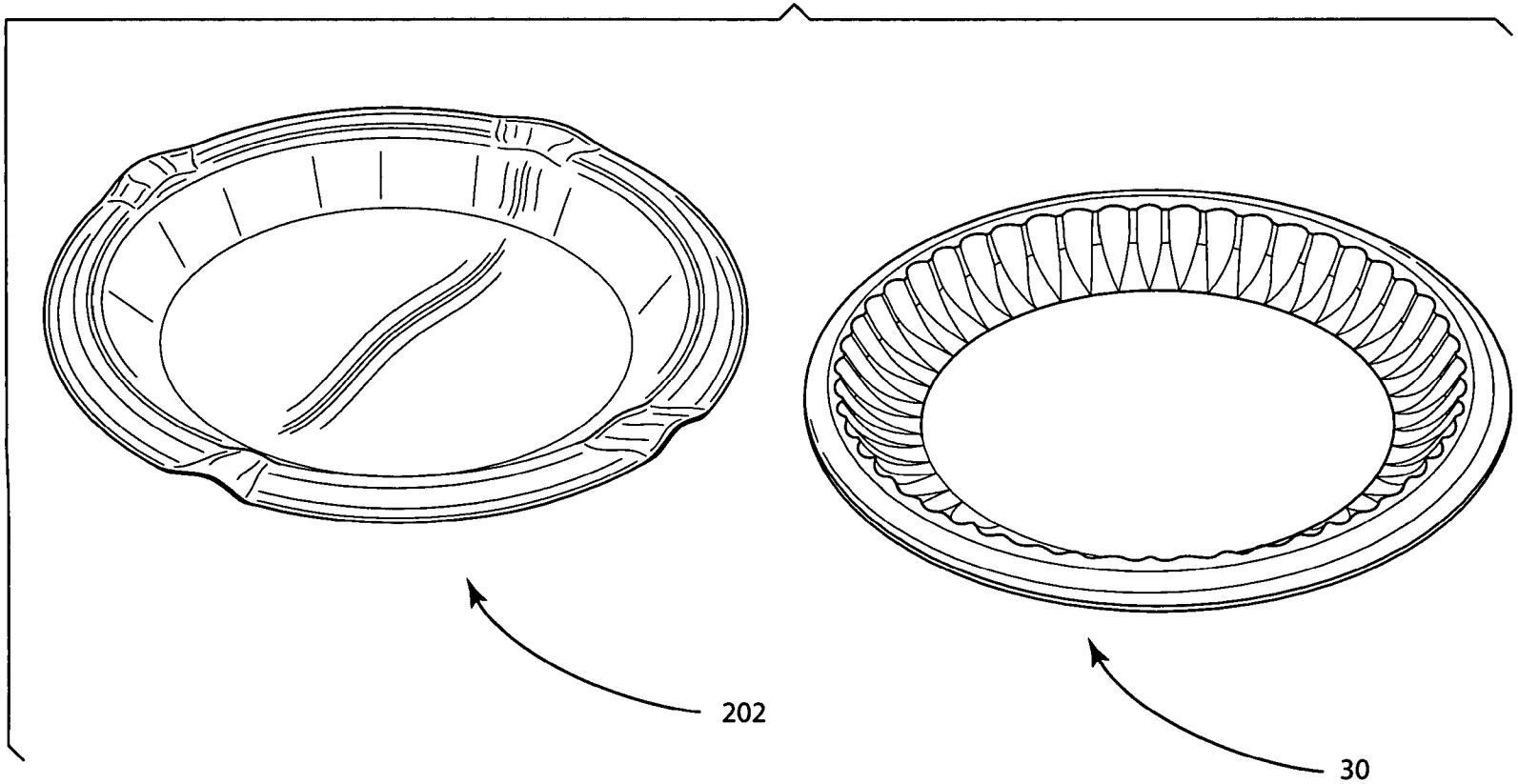
FIG. 15 compares the state after testing of the plate of FIGS. 14A and 14B with that of the plate of FIGS. 13A and 13B.

FIGS. 13A and 13B illustrate lightweight arcuate surface of rotation plate 202 having a profile similar to that shown in U.S. Pat. No. 6,715,630. In particular, as increasing loads are applied to plate 202 shown in FIGS. 13A and 13B, surprising rigidity is observed. However, once the load on the plate passes a critical value, plate 202 suddenly fails as shown in FIGS. 13A and 13B. In typical consumer usage, this sudden and unexpected failure is deemed likely to result in consumer dissatisfaction along with a big mess and loss of the foodstuffs being carried on the plate to the household pets. However, even though plate 30 of FIGS. 14A and 14B is not as rigid as the surface of rotation plate of FIGS. 13A and 13B, its ultimate load carrying capacity is significantly greater as seen in FIGS. 14A and 14B. In FIG. 15, the plate on the left is plate 202 of FIGS. 13A and 13B wherein it can be appreciated that the rim has failed and would exhibit almost no residual strength while plate 30 on the right from FIGS. 14A and 14B is largely intact and remains fully usable.

Figure 16A:
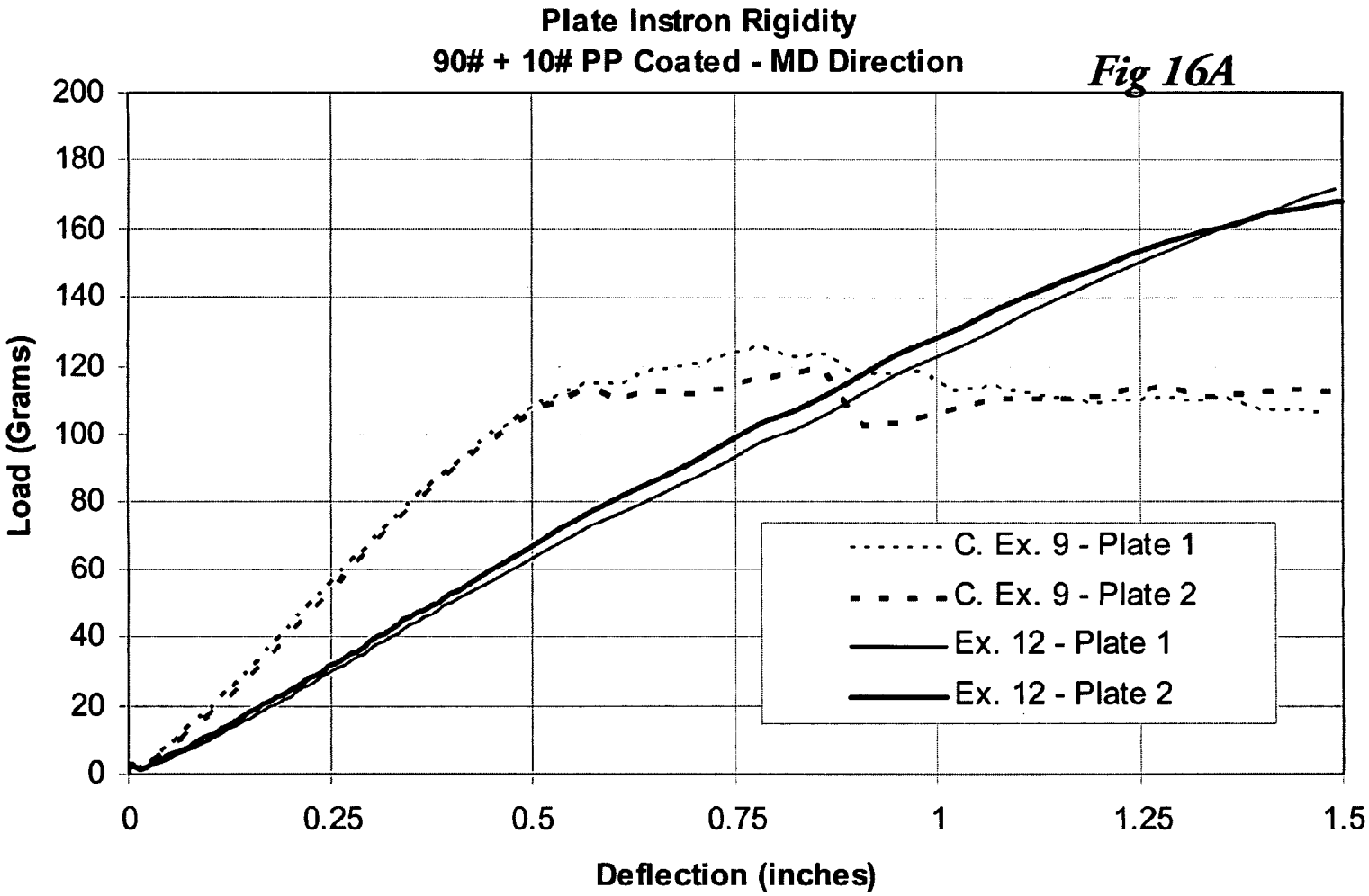
FIGS. 16A-16F illustrate the comparative Instron® rigidity of plates having an arcuate profile with that of plates of the present invention.
Figure 16B:
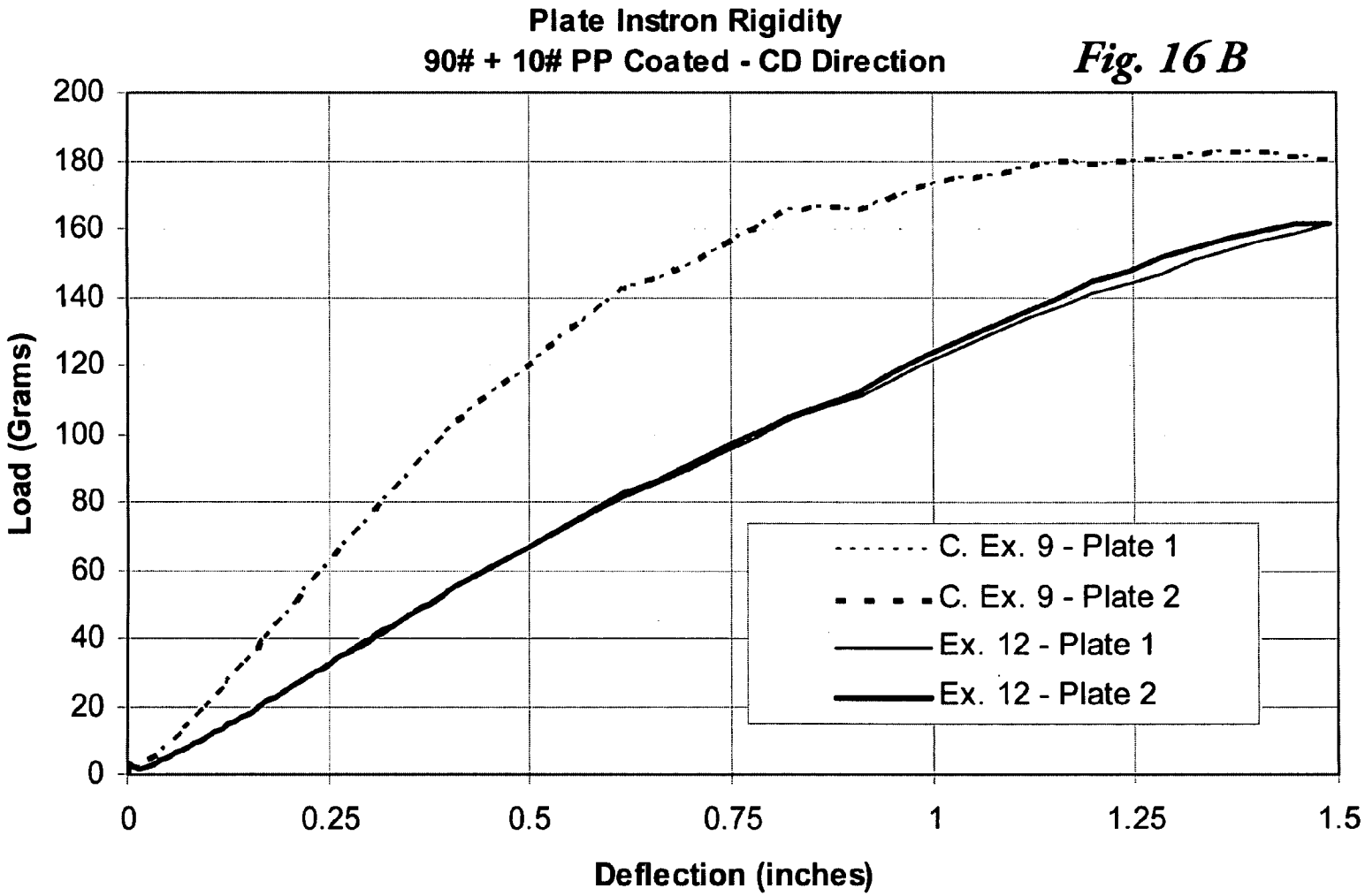

In more technical but less graphic terms, the relative performance of the plates of the present invention, as compared to arcuate surface of rotation plates, is illustrated in FIGS. 16A-16F. in each of these figures, it can be appreciated that, at low loads, arcuate surface of rotation plates exhibit remarkable rigidity surpassing that of plates of the present invention made from the same basis weight board. However, in FIGS. 16A and 16B, it can be appreciated that at some critical load of less than about 200 g (almost ½ pound), a very large increase in deflection results from even a tiny increase in the load on the arcuate surface of rotation plate indicated by the dotted lines. However, even though the plate of the present invention indicated by the solid lines is not as rigid, it can be appreciated that the deflection of the plate increases monotonically giving the consumer fair warning when an overload condition is being reached. Further, it can be noted that the strength of the arcuate surface rotation plate is strongly dependent upon how it is held so that its reliably usable load is actually less than that of the plate of the present invention which measures as being less rigid. As noted in the legend, the plates of FIGS. 16A and 16B, are made from 90 pound board coated with 10 pounds per ream of polypropylene.

Figure 16C:
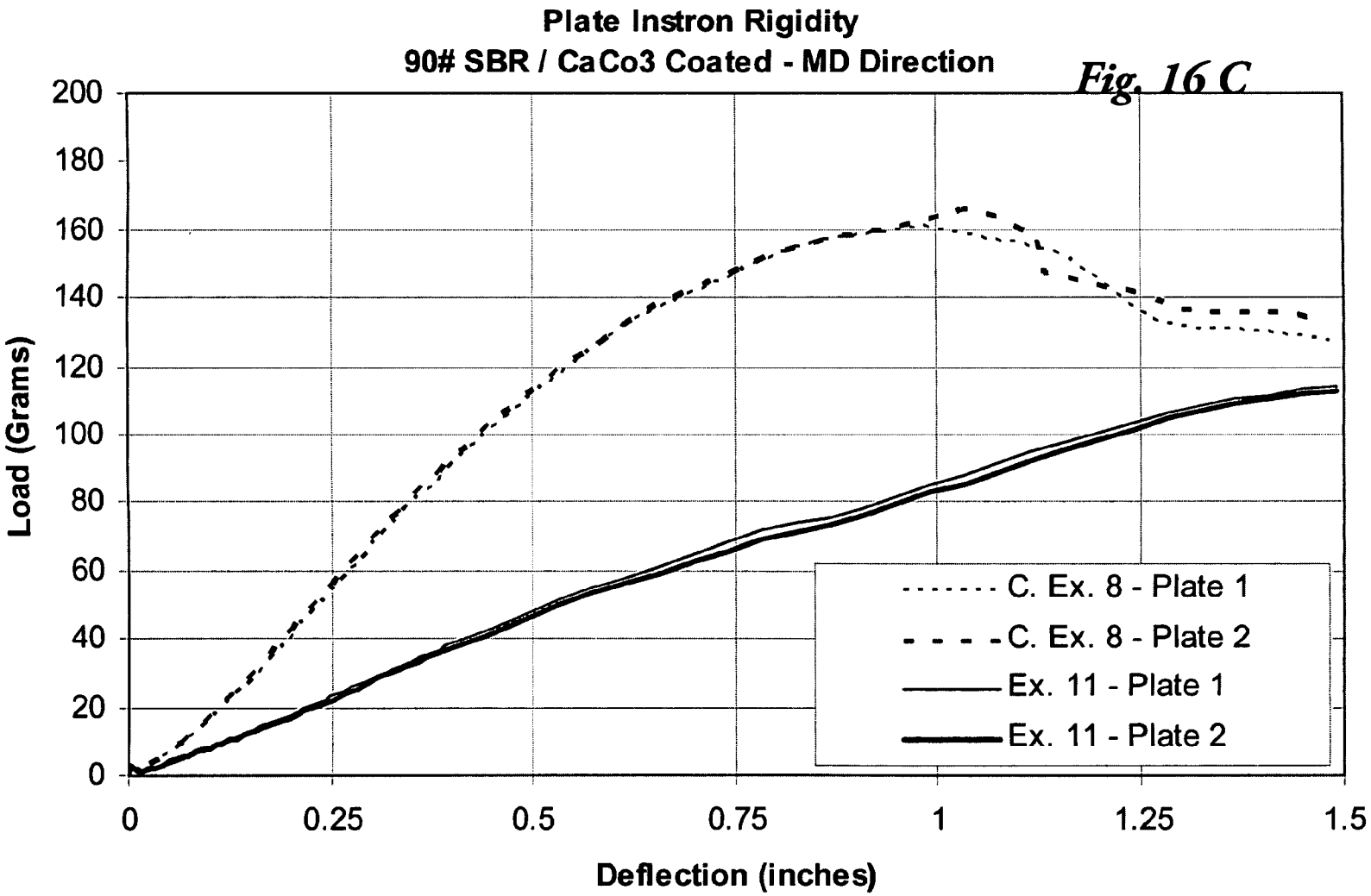
Figure 16D:
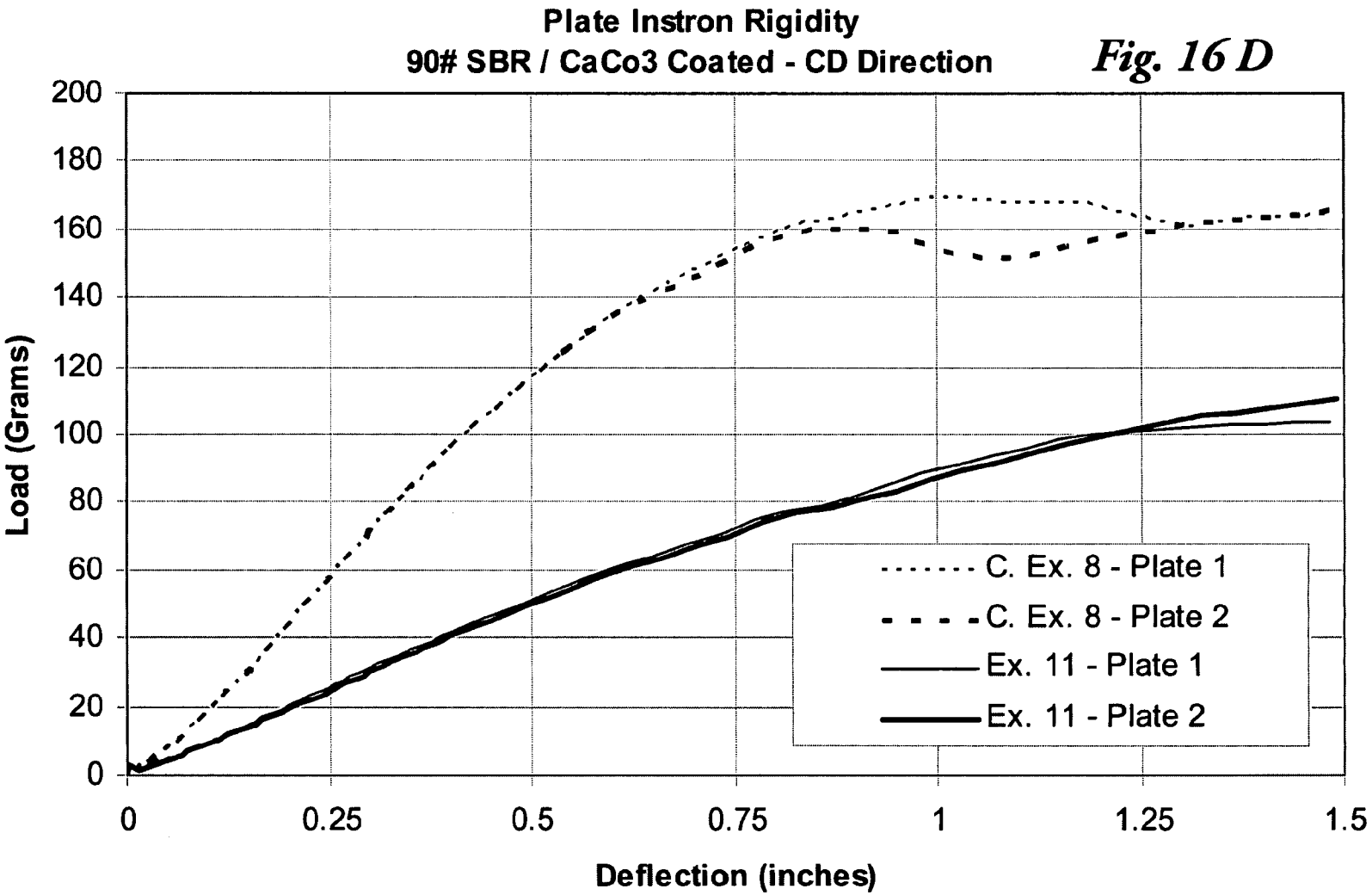

Similarly, in FIGS. 16C and 16D, we compare the performance of similar plates made from 90 pound board coated with an SBR/$CaCO_3$ emulsion illustrating essentially the same phenomenon except that the way that the plates were supported does not appear to be as critical as the CD and MD curves are very similar.

Figure 16E:
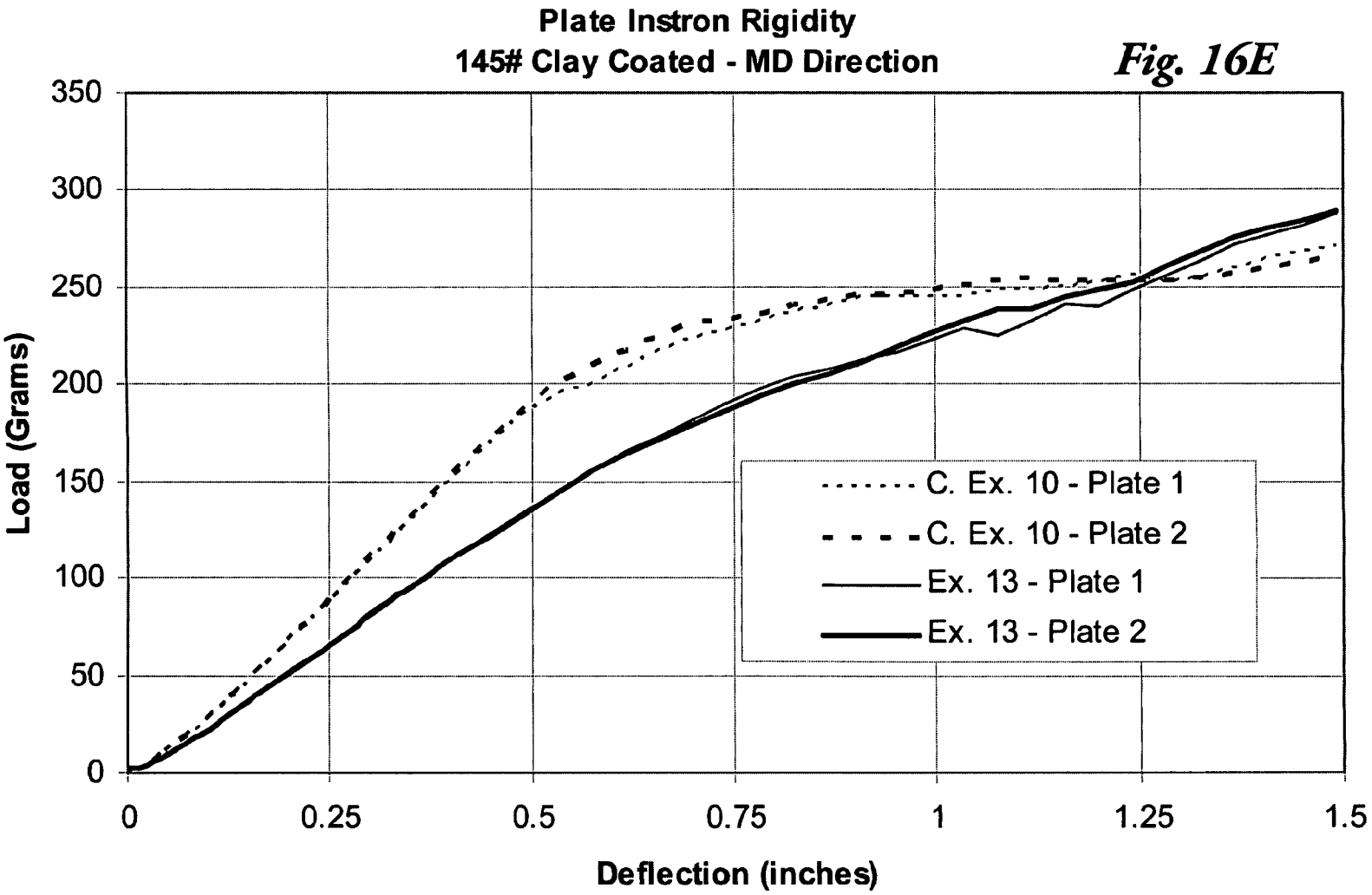
Figure 16F:
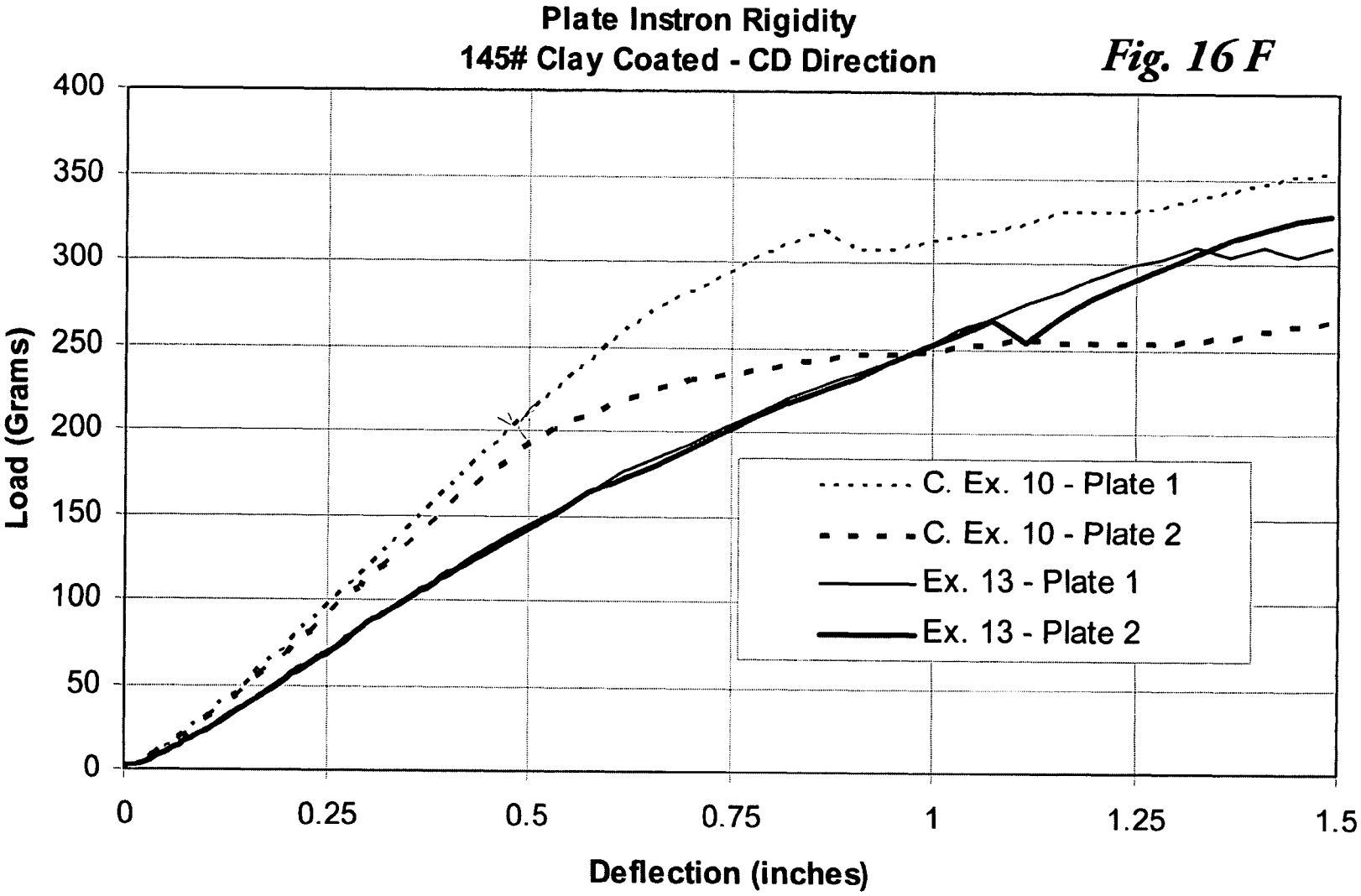

In FIGS. 16E and 16F, we compare the performance of plates made from 145 pound clay coated board. In this case, the same phenomenon is observed except that it appears that the critical buckling load is somewhat higher for the arcuate surface rotation plates.

Figure 16G:
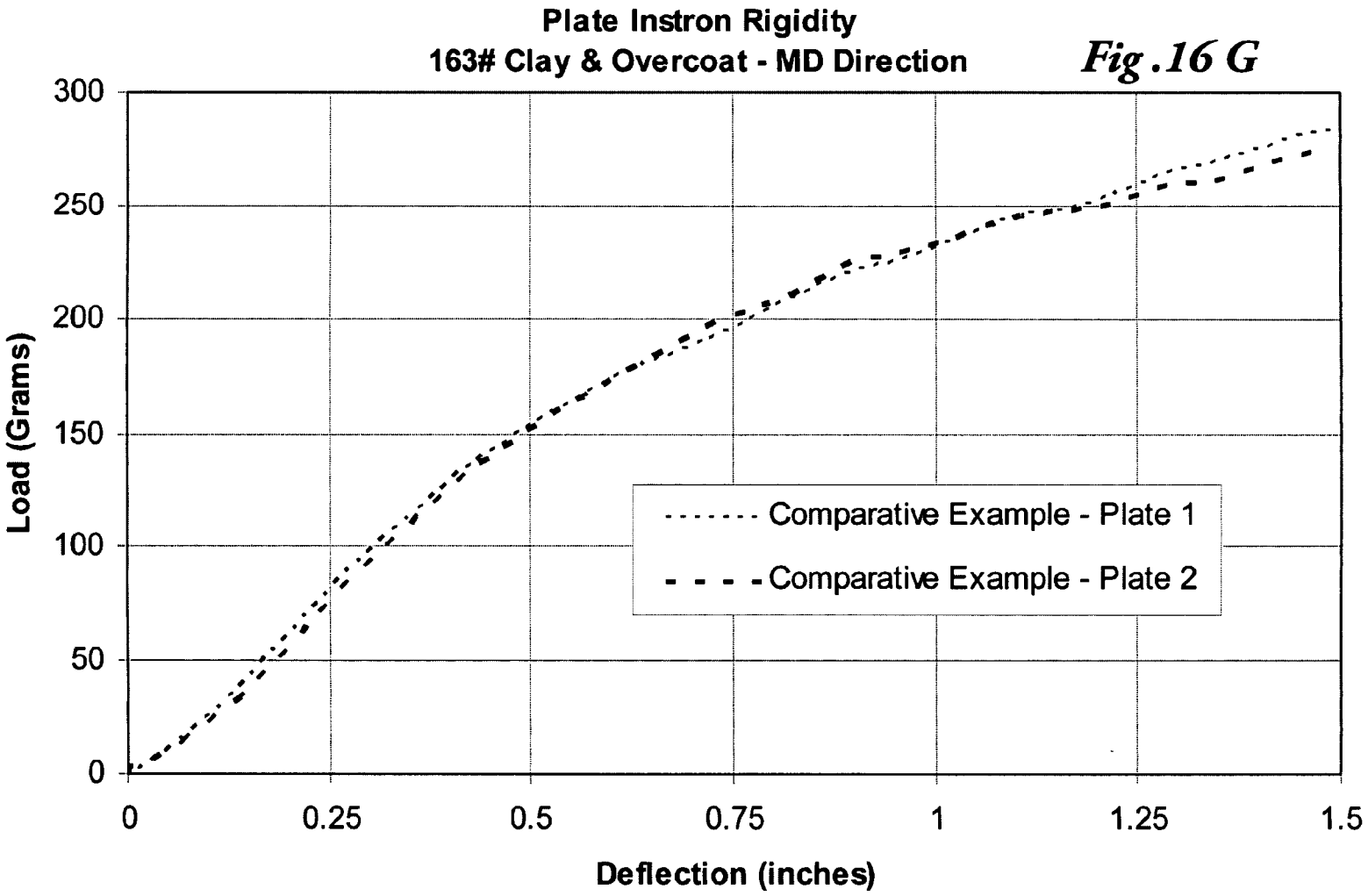
FIGS. 16G and 16H illustrate Instron® rigidity of medium weight plates having an arcuate profile.
Figure 16H:
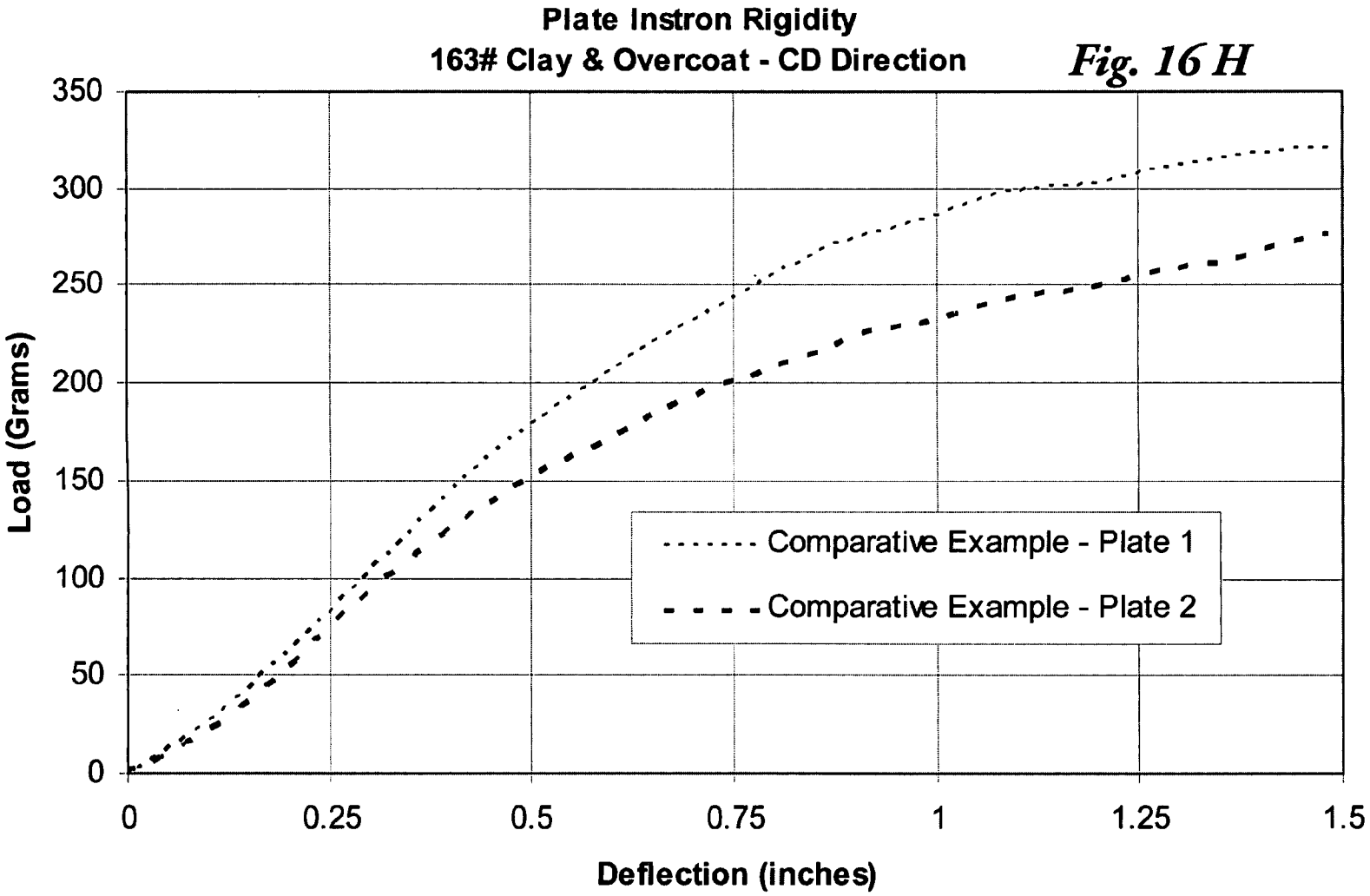

In FIGS. 16G and 16H, a quite surprising result is noted in that the arcuate surface rotation plates made from 163 pound board did not exhibit the buckling phenomenon within the tested range which was limited to reasonable ranges of about 300 g or over half of a pound. This surprising crossover effect wherein buckling seems more pronounced in lightweight plates and ceases in plates made from heavier board is believed to be a phenomenon not previously observed in plateforming.

One factor strongly contributing to the surprising performance of plates of the present invention is how well the plates are pressed in the outer arcuate section of the plate. In particular in FIGS. 19A-19C discussed in Example 18 below, we show the results when 0.625" strips containing well pressed pleats are cut from the outer arcuate section of the plate and subjected to Instron® tensile testing. Even though it can be appreciated that these pleats are capable of sustaining remarkable loads, in some cases exceeding 4 pounds, it is far more significant that the load deflection curves rise very steeply in the initial portion of the test as compared to the load deflection curves shown in FIG. 19D which, rather than climbing steeply, show rather large initial deflections at low loads. As a matter of definition, pleats exhibiting a maximum (zero first derivative, negative second derivative) at over 2 pounds at a deflection of less than 0.02" on the load deflection curves when subjected to this test should be deemed to have substantial resistance to pleat opening. As set forth herein, all pleats strengths are measured in a tensile tester using a sample cut from the outer arcuate rim ⅝" wide×~1 to 1¼" long, set at a jaw span of ¾" using a crosshead speed of 1.00 inch per minute, with care being observed to center the pleat in the crosshead between the jaws without damaging it.

Another reasonable comparison is between medium weight white no print plates and the plates of the present invention. In this case, there are some white no print plates on the market having a basis weight over 160 pounds per ream that provide from fair to reasonable performance dry but are very weak in wet tests. We consider it especially significant that the plates of the present invention made from very light weight board can match or surpass the dry performance of these medium weight white no print plates while using up to around 60 pounds per ream less fiber. As mentioned, this fiber savings makes it possible to "pay for" costly coatings while still maintaining an economy price thus making it possible to achieve an economy plate with both outstanding wet and dry strength.

Figure 17A:
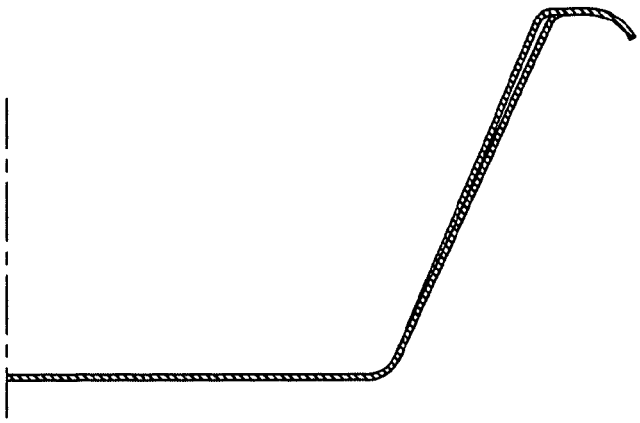
FIGS. 17A-17D are schematic sectional views which illustrate the geometry of the fluting in the interior sidewall of a pressed paperboard bowl of the present invention.
Figure 17B:
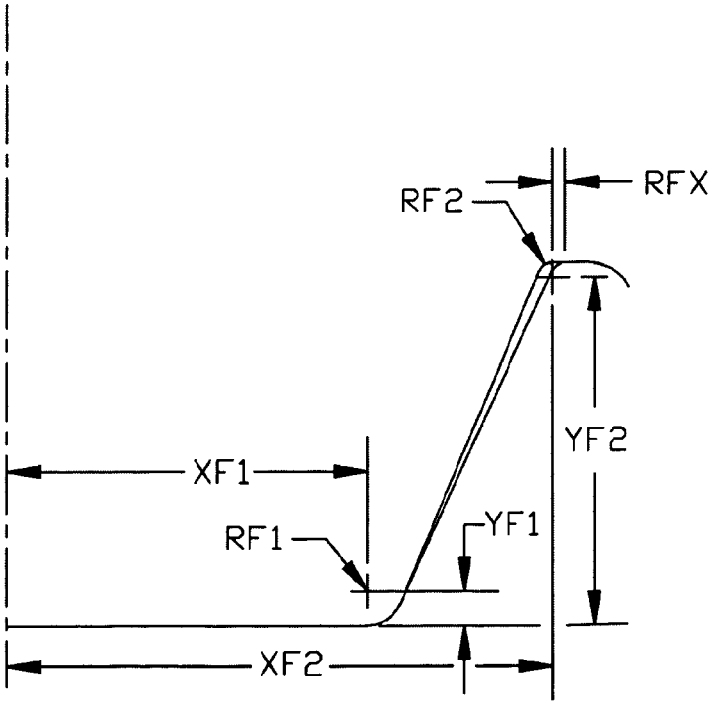
Figure 17C:
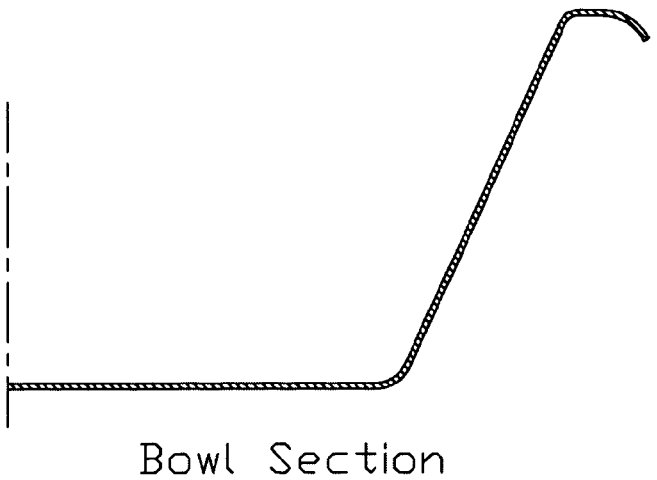
Figure 17D:
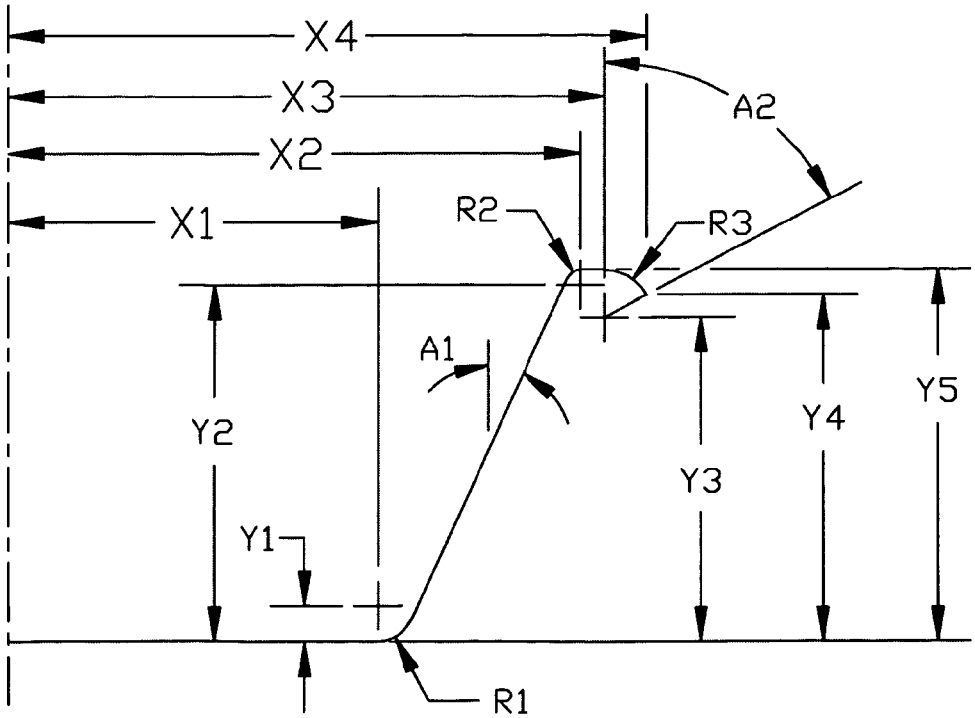
Figure 18A:
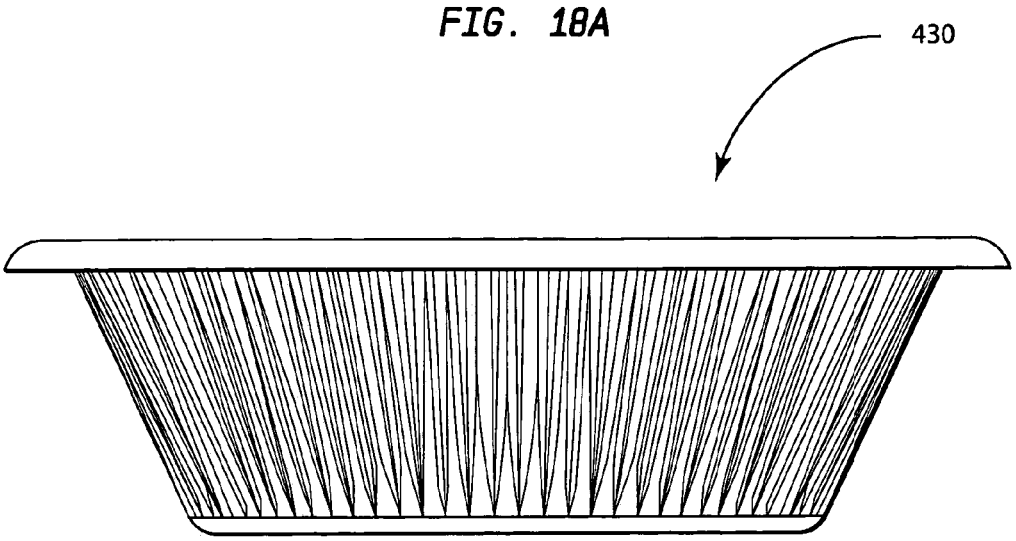
FIGS. 18A-18C illustrate the bowl of FIGS. 17A-17D.
Figure 18B:
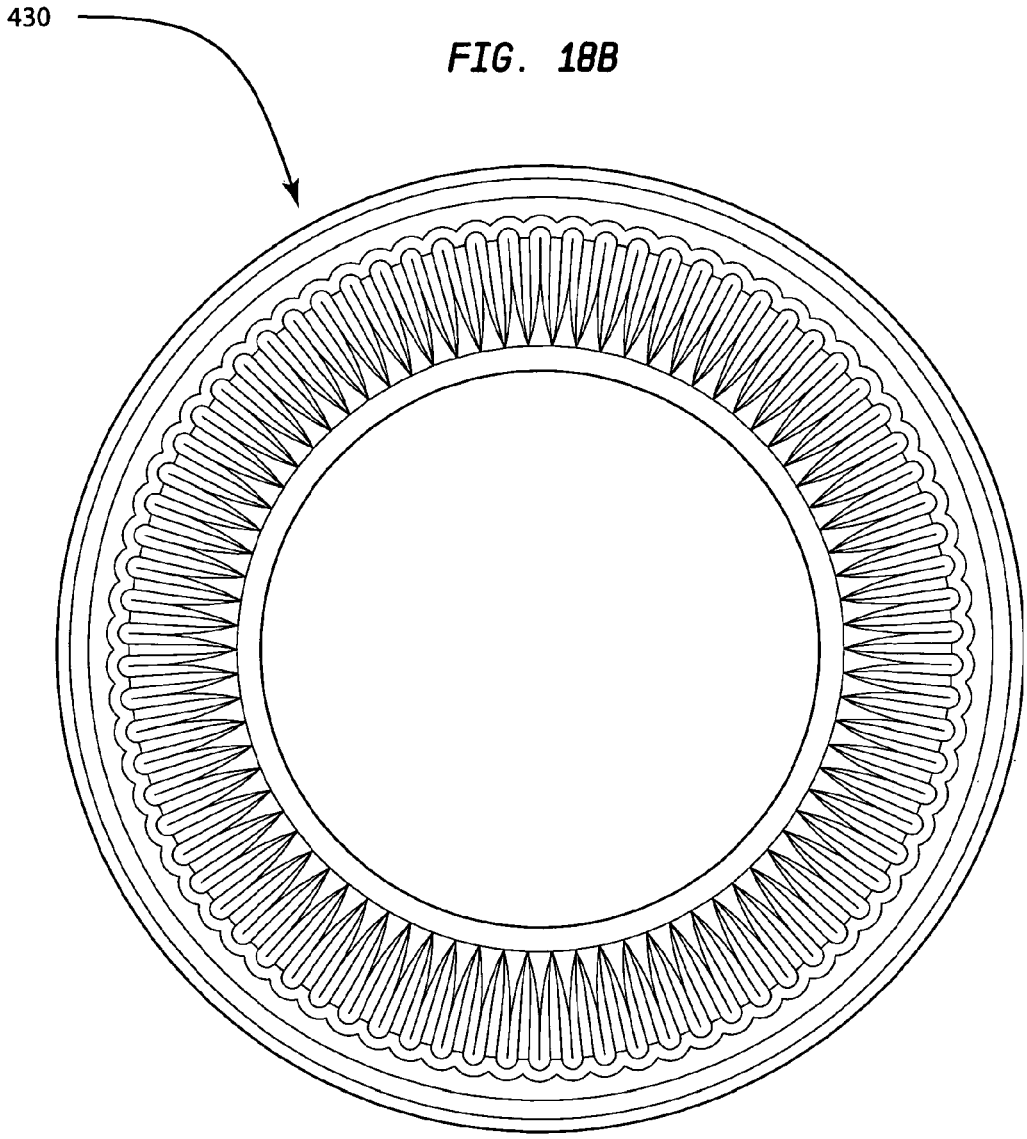
Figure 18C:
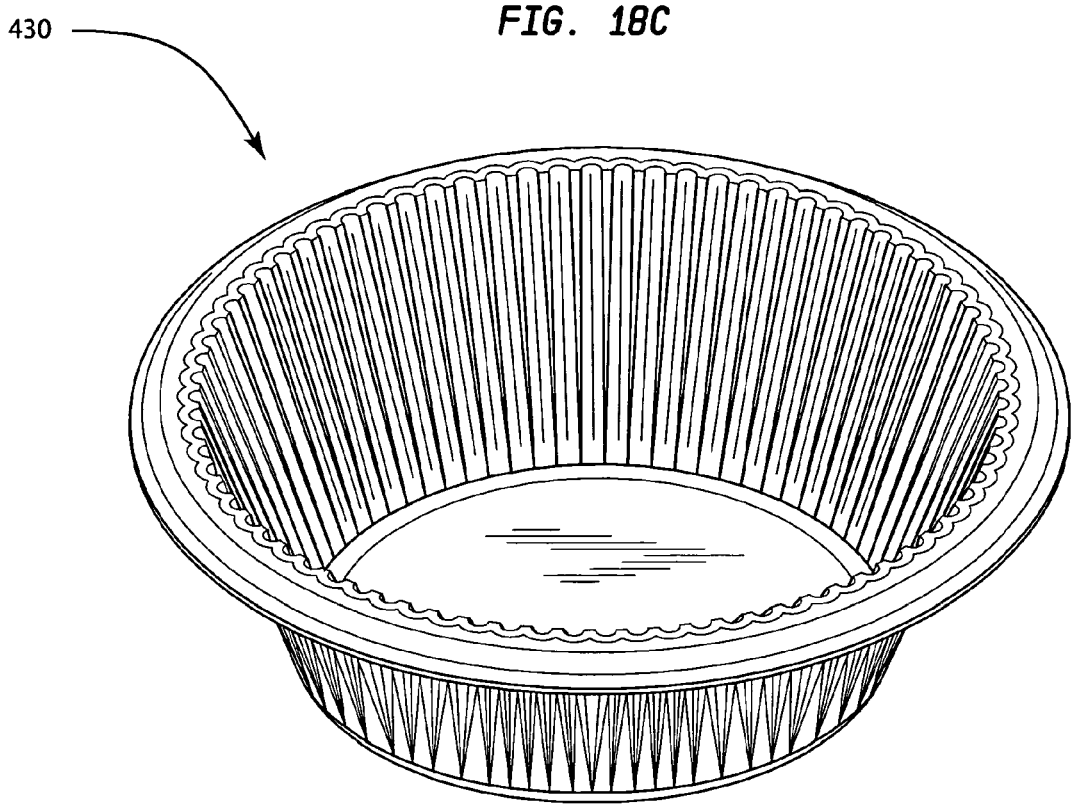

FIGS. 17A-17D illustrate a suitable profile for bowl 430 made using the profile of the present invention in which the dimensions referenced in FIGS. 17B and 17D are as set forth in Table 4. FIGS. 18A-18C illustrate bowl 430. Desirably, in bowls of the present invention, R1 is between 0.1" and 0.8", X1 is between 1.5" and 2.25"; Y1 is between 0.1" and 0.8"; R2 is between 0.025" and 0.15"; X2 is between 2.0" and 3.5"; Y2 is between 1.25" and 2.5"; R3 is between 0.1" and 0.5"; X3 is between 2.5" and 3.5", Y3 is between 0.75" and 2.6"; X4 is between 3.00" and 4.0"; Y4 is between 1.375" and 2.0"; Y5 is between 1.25" and 2.65"; A1 is between 15.0° and 35.0°; A2 is between 55° and 75°; RF1 is between 0.1" and 0.8"; XF1 is between 1.5" and 2.25"; YF1 is between 0.1" and 0.8"; RF2 is between 0.015" and 0.1"; XF2 is between 2.1" and 3.6"; YF2 is between 1.25" and 2.5"; and RFX is between 0.025" and 0.15".

Figure 21A:
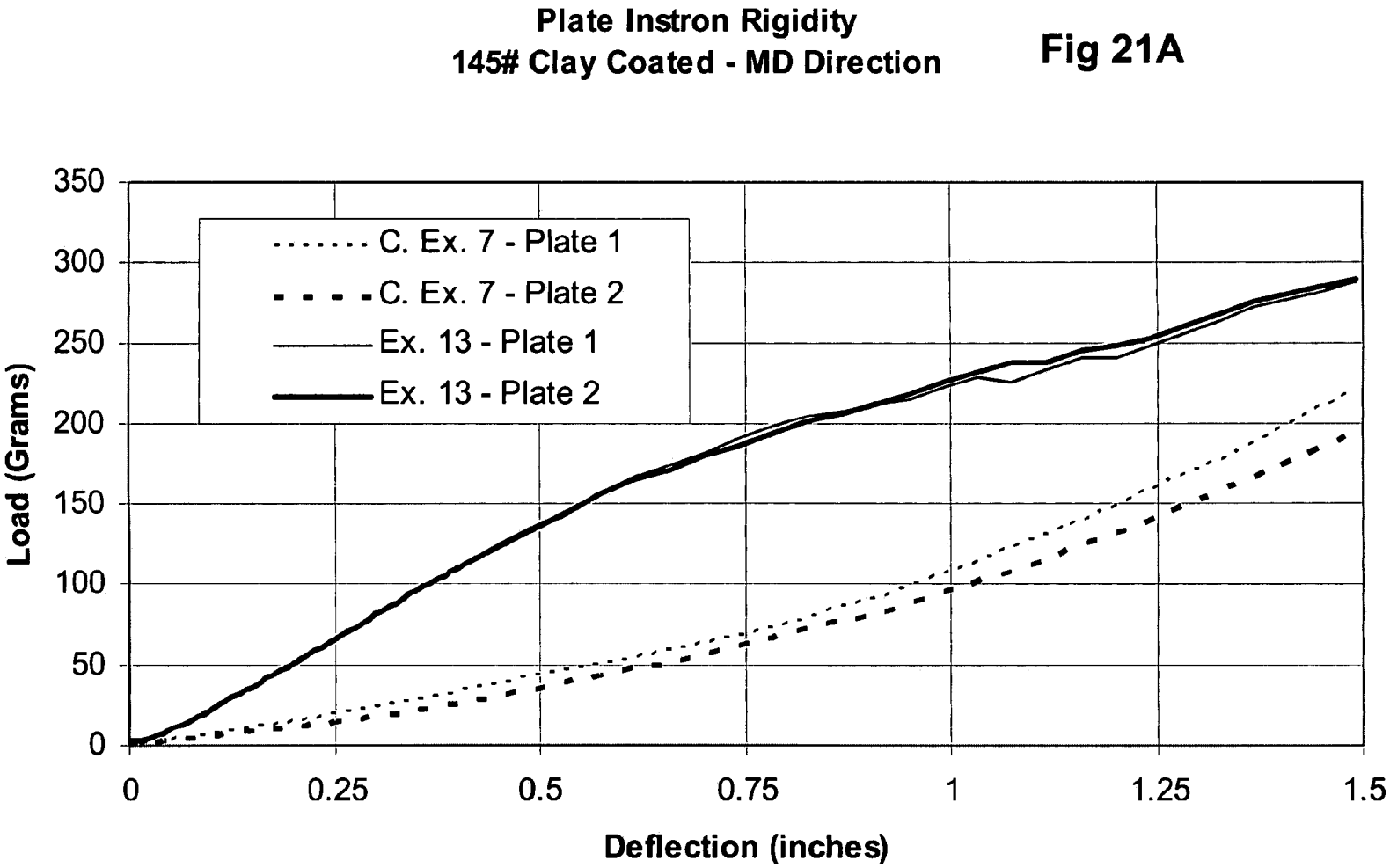
FIGS. 21A-21D illustrate the results of tensile tests performed on ⅝" wide strips of board to demonstrate substantial resistance to pleat opening.
Figure 21B:
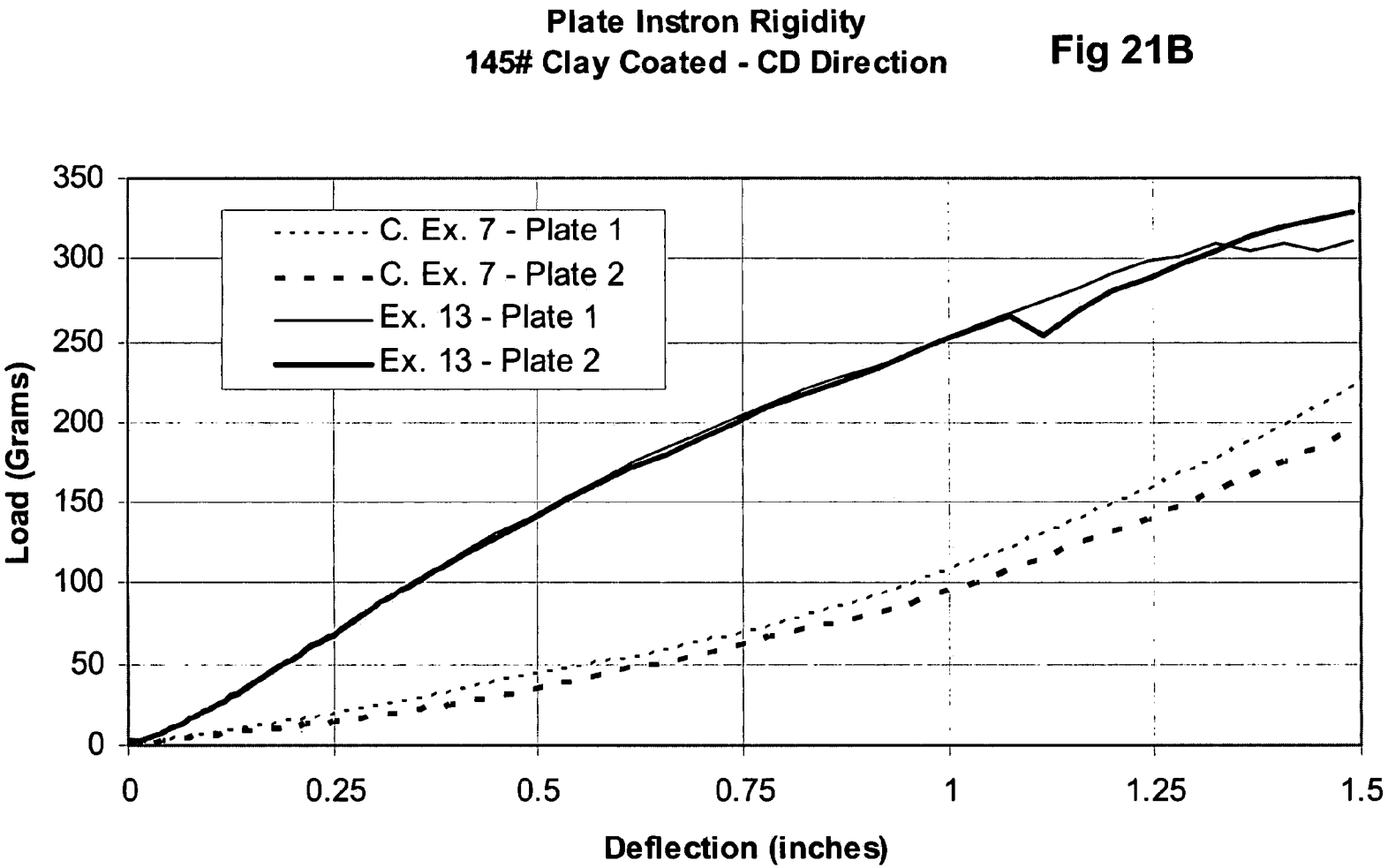

FIGS. 21A and 21B illustrate the construction of the plate holder used for the load to failure testing illustrated in FIGS. 13A and 13B and FIGS. 14A and 14B.

Examples 1-15

Plates having the constructions detailed in Table 2 were tested according to the test protocols set forth above to highlight the differences between plates of this invention and a variety of economy plates found on the market as well as comparing plates of this invention to lightweight arcuate surface rotation plate prototypes constructed during the development of the plates of the present invention.

In particular, Examples 1 and 2 report the results on polystyrene foam plates. It can be appreciated that these plates provide good grease resistance, fair FPI rigidity both wet and dry at the expense of microwavability.

Examples 3 and 4 illustrate the performance of uncoated WNP lightweight plates available on the market. Even though the plate of example 4 provided a fair degree of FPI rigidity, it's wet strength, grease resistance and 1 Hand Hold strength are lowest among the examples tested.

Examples 5-7 represent the results for clay coated medium weight white no print plates such as those illustrated in FIGS. 2B and 2C. It can be appreciated that these plates provide fair FPI rigidity and One Hand Hold strength but again exhibit little grease resistance or wet strength.

Examples 8-10 are prototypes manufactured with arcuate surface of rotation designs having a profile similar to that illustrated in FIG. 2A formed from SBR/$CaCO_3$ coated board, polypropylene coated board and clay coated board respectively. In particular it was observed that the polypropylene coating on the board of Example 9 had pin holes. It can be appreciated that these plates exhibited good FPI rigidity, good wet rigidity, and good one hand hold rigidity. The plate of Example 8 made from SBR/$CaCO_3$ coated board provided both very good FPI rigidity and 1 Hand Hold Rigidity particularly when it's extremely light weight is considered as did the plate 9. Somewhat surprisingly, the wet rigidity of the polypropylene coated plate held up well despite the presence of pinholes. Similarly, the SBR/$CaCO_3$ suffered only minor losses strength when tested wet. Both had some grease failure apparent as seen on the backside of the plate. The medium weight plate of Example 10 exhibited very good FPI and One Hand Hold Strength, fair wet rigidity but close to complete grease failure. As a practical matter, it was noted that even though these plates measured well, they were subject to sudden failure by buckling as described hereinafter.

Examples 11-13 in essence repeat Examples 8-10, with the exception that the plates were formed as called for in the present invention rather than having an arcuate surface of rotation design. It can be appreciated that the very light weight plate of Example 11, did not test as well as the slightly heavier plate of Example 8; and while the measured deficit of the plate of Example 12 as compared to Example 9 is less, it still did not test as well as the comparable surface of rotation plate. Similarly, the plate made from 145 pound per ream clay coated board did not test as well either but did register a fairly impressive One Hand Hold Strength.

Examples 14 and 15 illustrate the performance of plates of the present invention made from slightly heavier 100 pound per ream board. Again it should be noted that the measured performance is not quite as good as the arcuate surface rotation prototypes of Examples 8-10 but the plates of Examples 11-15 are not as subject to sudden drastic failure through buckling in the range of under 300 grams applied load.

TABLE 2

Empirical Results - Physical Test Data (Nominal 9" Inventive and competitive and/or comparative plates):

| | | Basis | | FPI | Wet Plate - Water Rigidity | | 1 Hand Hold (Load to Failure) Max Load- | Grease Resistance | | |
|---|---|---|---|---|---|---|---|---|---|---|
| Plate ID | Material | Weight (lb/ream) | Caliper (mils) | Rigidity (gms/.50") | (gms/.50") | Loss (%) | Dry (lbs) | Failure (percent) | Soak Thru (yes/no) | Microwavable (yes/no/limited) |
| C. Ex. 1 Value Foam Plate #1 | Foam | 68 | 47.9 | 39 | 36 | 8 | 1.42 | 0 | No | Limited |
| C. Ex. 2 Value Foam Plate #2 | Foam | 63 | 47.4 | 63 | 60 | 5 | 1.58 | 0 | No | Limited |
| C. Ex. 3 WNP - Uncoated #1 | Uncoated | 99 | 9.6 | 13 | 0 | 1 | 0.33 | 100 | Yes | Yes |
| C. Ex. 4 WNP - Uncoated #2 | Uncoated | 100 | 10.1 | 39 | 0 | 1 | 0.25 | 100 | Yes | Yes |
| C. Ex. 5 WNP - Clay Coated #1 | Coated | 148 | 12.0 | 29 | 0 | 1 | 0.83 | 100 | Yes | Yes |
| C. Ex. 6 WNP - Clay Coated #2 | Coated | 167 | 13.9 | 37 | 0 | 1 | 1.33 | 100 | Yes | Yes |
| C. Ex. 7 WNP - Clay Coated #3 | Coated | 173 | 14.6 | 38 | 0 | 1 | 2.25 | 72 | No | Yes |
| C. Ex. 8 - 90# SBR/CaCo3 Coated | Coated | 101 | 8.7 | 97 | 73 | 25 | 1.13 | 6 | No | Yes |
| C. Ex. 9 90# + 10# PP Coated | Coated | 115 | 10.0 | 89 | 77 | 14 | 0.75 | 33* | No | Yes |
| C. Ex. 10 145# Clay Coated | Coated | 154 | 12.3 | 192 | 48 | 75 | 2.25 | 100 | No | Yes |
| Ex. 11 - 90# SBR/CaCo3 Coated | Coated | 95 | 7.3 | 49 | 31 | 37 | 0.58 | 12 | No | Yes |
| Ex. 12 - 90# + 10# PP Coated | Coated | 106 | 9.4 | 64 | 58 | 9 | 0.92 | 34* | No | Yes |
| Ex. 13 - 145# Clay Coated | Coated | 154 | 12.2 | 125 | 49 | 61 | 1.50 | 100 | No | Yes |
| Ex. 14 - 100# SBR/CaCo3 Coated | Coated | 110 | 9.8 | 59 | 34 | 42 | 1.17 | 96* | No | Yes |
| Ex. 15 - 100# + 15# PP Coated | Coated | 117 | 10.6 | 72 | 71 | 1 | 1.50 | 7 | No | Yes |

*pin holes observed in coating

Example 16

Example 16 compares the FPI rigidity of plates of the present invention as compared to arcuate surface of rotation plates made from comparable board upon repeated stressing. In Table 3, it should be noted that plates the present invention were quite durable while repeated stressing of the arcuate surface rotation plates resulted in some slight loss or rigidity. Again, we view this as an example of the arcuate surface of rotation plates testing well.

TABLE 3

| Durability Testing: FPI Rigidity Test Conducted 20 times (MD only) on same plate | | | | | | | | |
|---|---|---|---|---|---|---|---|---|
| | FPI Rigidity (grams/ .5" defl.) 145# Clay Coated | | | FPI Rigidity (grams/ .5" defl.) 90# + 10# PP Coated | | | FPI Rigidity (grams/ .5" defl.) 90# SBR/CaCo3 Coated | |
| Test # | C. Ex. 10 "Arcuate" | Ex. 13 "Fluted" | Test # | C. Ex. 9 "Arcuate" | Ex. 12 "Fluted" | Test # | C. Ex. 8 "Arcuate" | Ex. 11 "Fluted" |
| 1 | 172 (Ref.) | 113 (Ref.) | 1 | 85 (Ref.) | 69 (Ref.) | 1 | 106 (Ref.) | 56 (Ref.) |
| 2 | 173 | 114 | 2 | 87 | 70 | 2 | 107 | 56 |
| 3 | 173 | 114 | 3 | 86 | 69 | 3 | 106 | 56 |
| 4 | 171 | 114 | 4 | 82 | 69 | 4 | 106 | 56 |
| 5 | 170 | 114 | 5 | 82 | 69 | 5 | 105 | 56 |
| 6 | 169 | 114 | 6 | 81 | 69 | 6 | 105 | 56 |
| 7 | 168 | 113 | 7 | 81 | 69 | 7 | 105 | 56 |
| 8 | 167 | 113 | 8 | 81 | 69 | 8 | 105 | 56 |
| 9 | 167 | 113 | 9 | 81 | 69 | 9 | 104 | 56 |
| 10 | 165 | 113 | 10 | 81 | 70 | 10 | 104 | 55 |
| 11 | 161 | 113 | 11 | 81 | 70 | 11 | 104 | 56 |
| 12 | 161 | 113 | 12 | 81 | 70 | 12 | 104 | 56 |
| 13 | 162 | 113 | 13 | 80 | 70 | 13 | 104 | 57 |
| 14 | 160 | 113 | 14 | 80 | 70 | 14 | 104 | 57 |
| 15 | 160 | 113 | 15 | 80 | 70 | 15 | 104 | 56 |
| 16 | 160 | 113 | 16 | 80 | 70 | 16 | 103 | 56 |
| 17 | 159 | 113 | 17 | 80 | 70 | 17 | 103 | 56 |
| 18 | 159 | 113 | 18 | 80 | 70 | 18 | 103 | 56 |
| 19 | 157 | 113 | 19 | 80 | 70 | 19 | 103 | 56 |
| 20 | 157 (−8.7%) | 112 (−0.9%) | 20 | 80 (−5.9%) | 70 (+1.5%) | 20 | 103 (−2.8%) | 56 (−0%) |

TABLE 4

| Exemplary Dimensions for 20 fluid oz Bowl Forming die (Blank Diameter = 9.375 inches) | | | |
|---|---|---|---|
| Die Profile Dimensions: Base profile in cross-sections between flutes of example bowl of the present in present invention | | Die Flute Dimensions Base profile - flutes, measured at maximum depth of scallop | |
| R1 | 0.1875" | RF1 | 0.1875" |
| X1 | 1.9400" | XF1 | 1.9400" |
| Y1 | 0.1875" | YF1 | 0.1875" |
| R2 | 0.0800" | RF2 | 0.0800" |
| X2 | 2.9453" | XF2 | 3.0135" |
| Y2 | 1.8800" | YF2 | 1.8800" |
| R3 | 0.2500" | RFX | 0.0682" |
| X3 | 3.1400" | | |
| Y3 | 1.7100" | | |
| X4 | 3.3614" | | |
| Y4 | 1.8261" | | |
| Y5 | 1.9600" | | |
| A1 | 22.9° | | |
| A2 | 62.3° | | |

Example 17

FIGS. 16A-16D compare performance of plates of the present invention to analogous arcuate surface of rotation plates when subjected to the plate Instron® rigidity test described herein above. FIGS. 16A and 16B demonstrate that even though the arcuate surface of rotation plates of Example 9 have good rigidity as measured at one half inch deflection, the plates are subject to sudden failure due to buckling as indicated by the leveling out of the load deflection curves at approximately 0.75 inches deflection in FIG. 16A and at about 1 inch deflection in the case of Figure B whereas the plates of the present invention comparable to Example 12 exhibit steadily increasing deflection as the load is increased and accordingly are not subject to sudden failure due to buckling.

Similarly in FIGS. 16C and 16D, it can be appreciated that the arcuate surface of rotation plates corresponding to Example 8 are subject to failure to buckling whereas the plates of the present invention comparable to Example 11 exhibit steadily increasing deflection as the load is increased and accordingly are not subject to sudden failure due to buckling.

FIGS. 16E and 16F illustrate the relative performance of plates of the present invention as described in Example 13 when prepared from medium weight board as compared to arcuate surface rotation plates from comparable board as described in Example 10. In this case, it can be observed that the deflection curves are largely comparable except that the arcuate surface of rotation plates level out within the commonly encountered load range indicating susceptibility to sudden failure to buckling.

FIGS. 16G and 16H illustrate the performance of prototype arcuate surface of rotation plates made from medium weight board (163 pound per ream) when subjected to Instron® Plate Rigidity testing as described above. It is considered particularly significant that, in the under 300 gram portion of the graph, the load deflection curves in this case do not exhibit the leveling out observed with lighter weight board.

Example 18

Figure 19A:
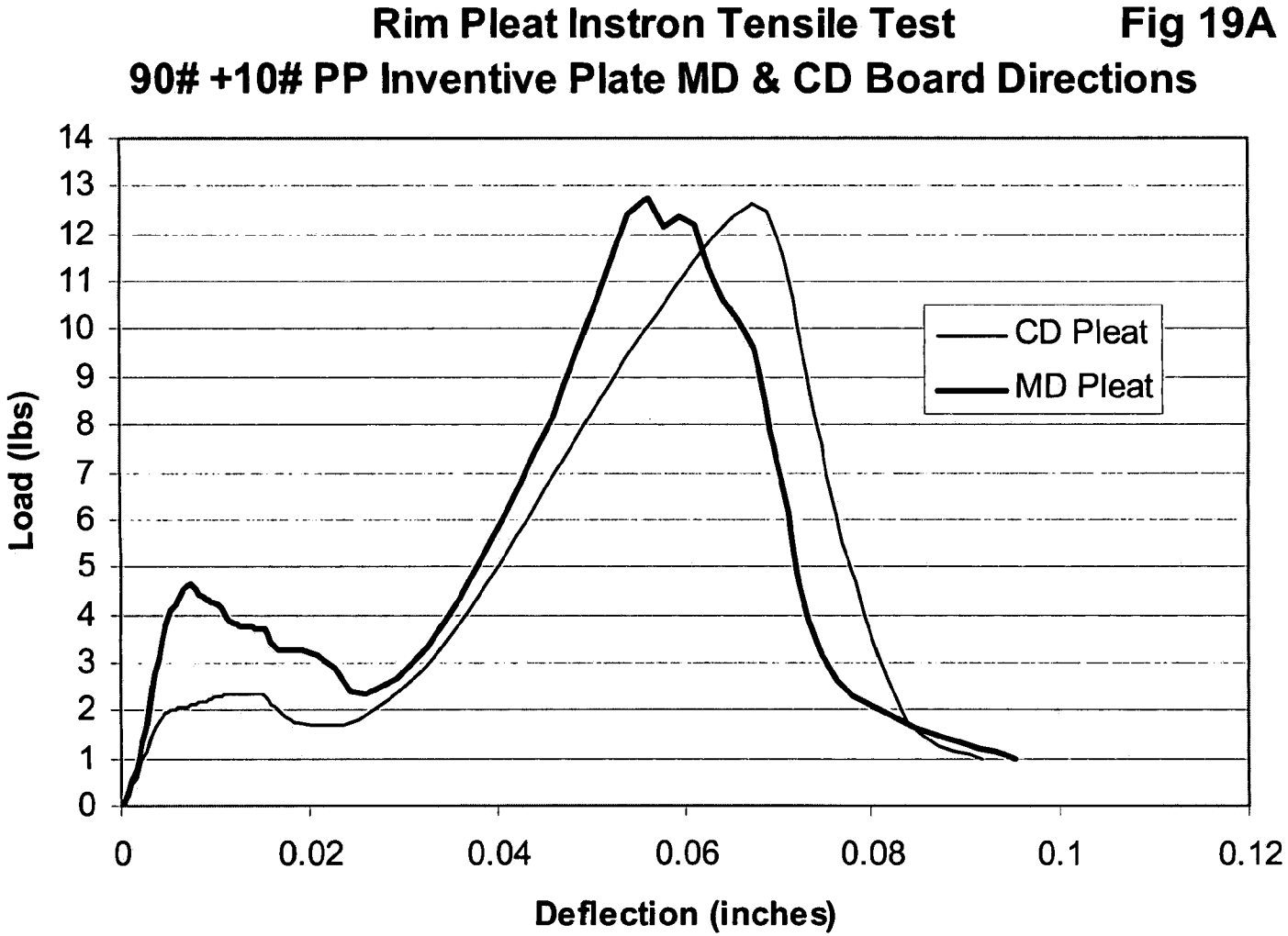
FIGS. 19A-19C illustrate the performance under load of pleats in plates of the present invention wherein the pleats exhibit substantial resistance to opening.

FIGS. 19A-19D illustrates the tensile performance of pleats taken from the outer arcuate rim of a variety of plates. In FIG. 19A, ⅝ inch strips taken from the arcuate outer rim of the plate made from 90 pound per ream board coated with polypropylene having a profile described the present claims were subjected to the Rim Pleat Instron® tensile test. It is observed that both the MD and CD pleats show a very small deflection well under 0.01" at a load of 2 pounds, the CD pleat resisting a load of over two pounds before yielding while the MD pleat sustained a load of over four pounds before yielding. In each case, the strip tested exhibited a local maximum (zero first derivative, negative second derivative) in the first 0.02" of deflection which was followed by a local minimum (zero first derivative, positive second derivative) before increasing. This shape of curve is indicative of a pleat which has substantial resistance to opening, which then yields at the maximum and then only begins increasing again after the "take up" of the pleat has been pulled out.

Figure 19B:
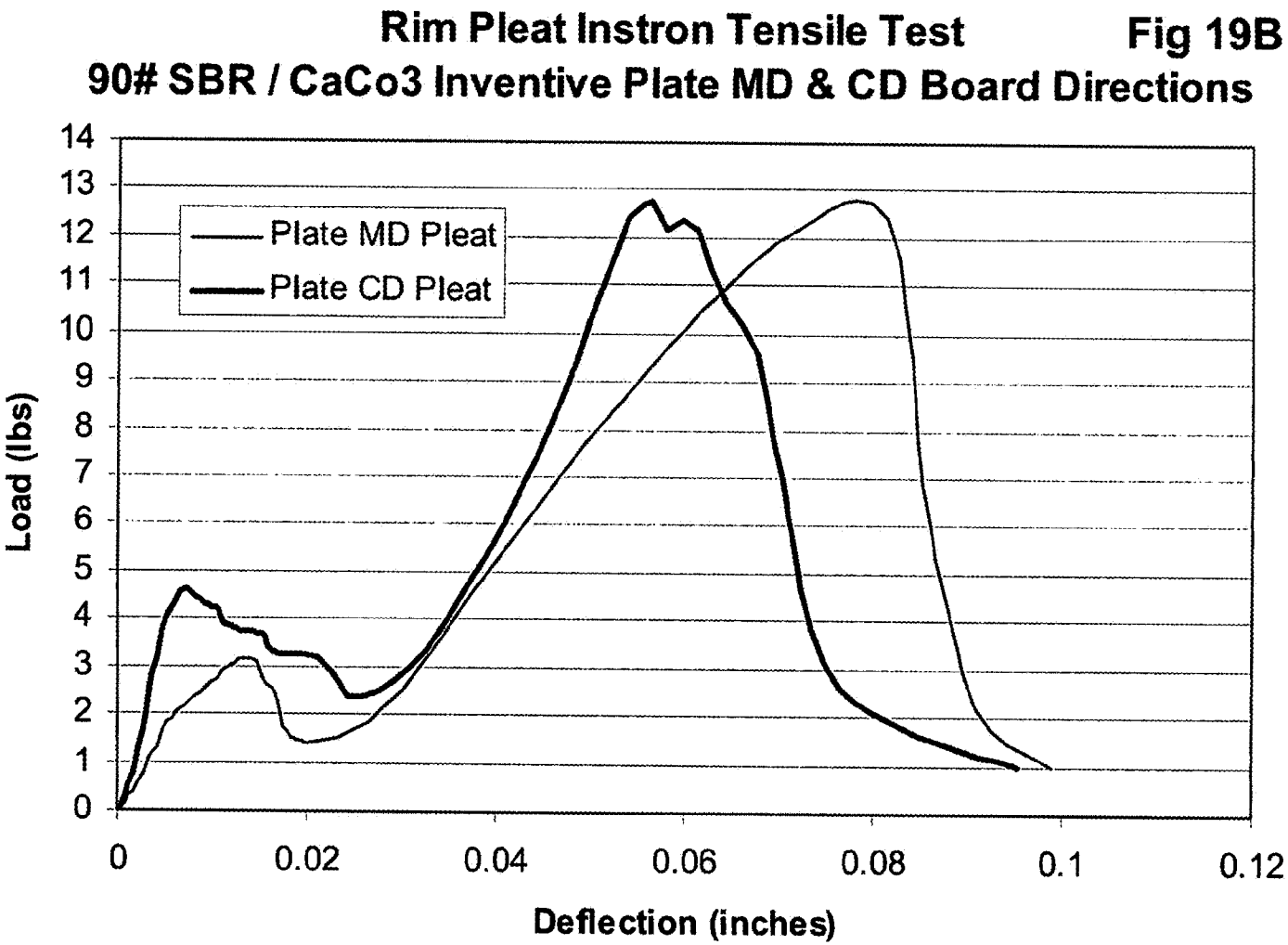

Similarly in FIG. 19B, ⅝ inch strips taken from the arcuate outer rim of the plate made from 90 pound per ream board coated with SBR/$CaCO_3$ exhibit local maxima in the first 0.02" of deflection, in this case the MD pleat sustained a load of over three pounds while the CD pleat sustained a load of over 4 pounds.

Figure 19C:
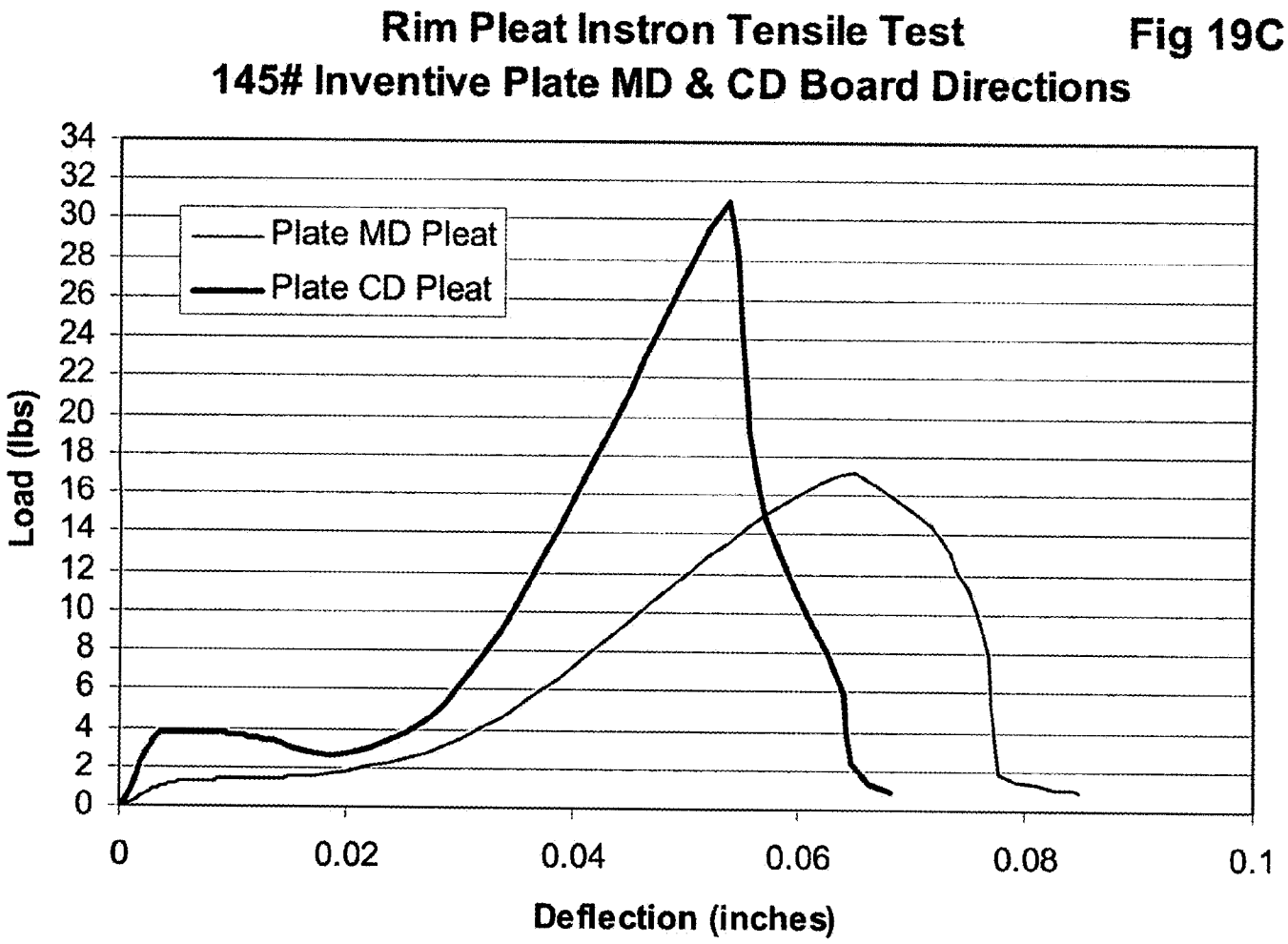

Similarly in FIG. 19C, only the CD ⅝ inch strips taken from the arcuate outer rim of the plate made from 145 pound per ream clay coated board exhibit a local maximum in the first 0.02" of deflection, while in this case the MD pleat exhibited a steadily increasing deflection with load, while the CD pleat sustained a load of almost 4 pounds. In this case, the CD pleat should be deemed to have substantial resistance to opening but the MD pleat did not.

Figure 19D:
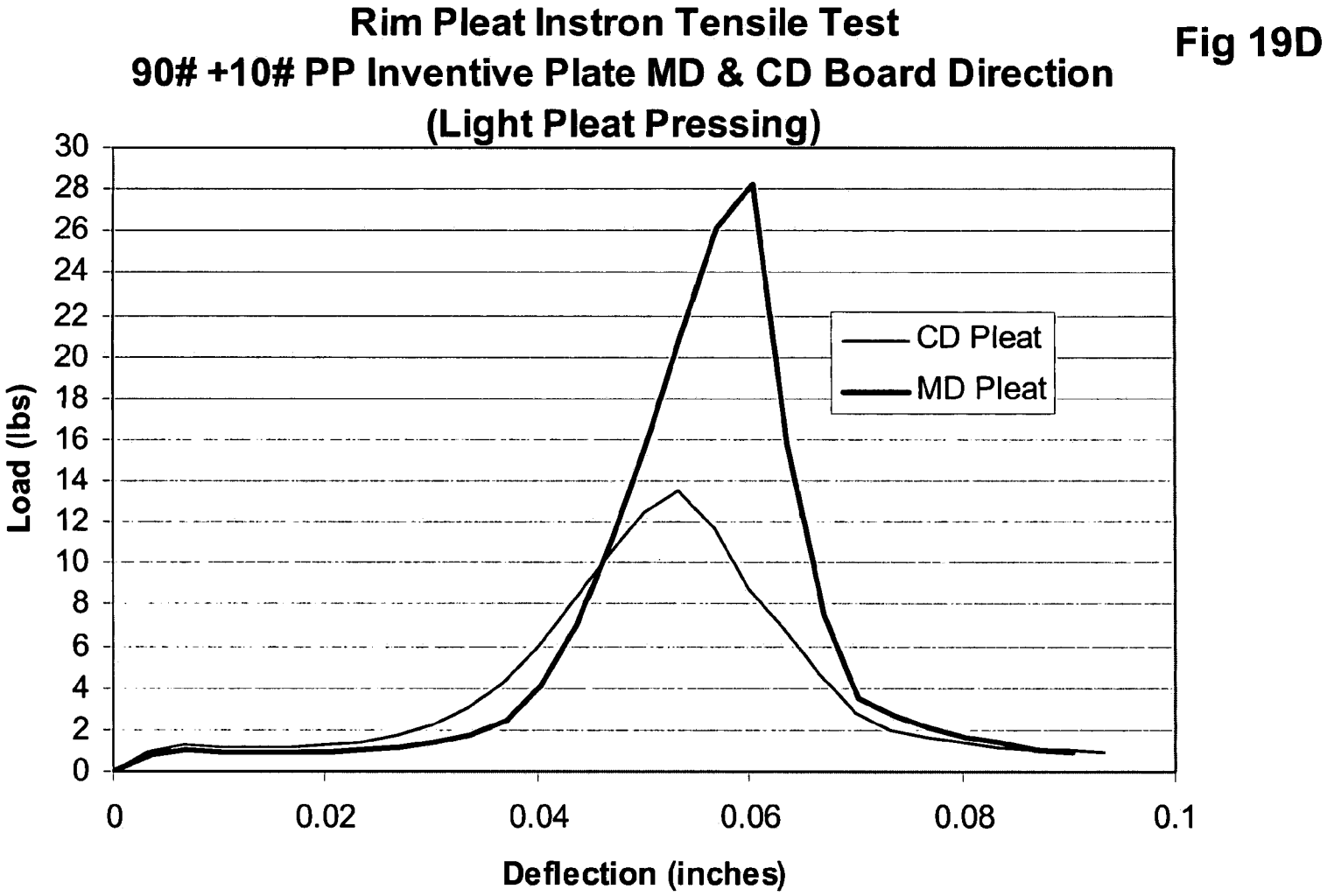
FIG. 19D illustrates the performance under load of pleats in plates wherein the pleats lack substantial resistance to opening.

In FIG. 19D, neither pleat exhibited substantial resistance to opening. It is believed that this resulted from the application of too little pressing force to the outer arcuate region of the plate due to improper clearances which were slightly tight in the upwardly and outwardly flaring interior fluted sidewall of the plate. However, it is important to note that even though the pleats in this plate were not as well pressed as desired, these plates still had adequate strength to be competitive in this market segment.

Example 19

Figure 20A:
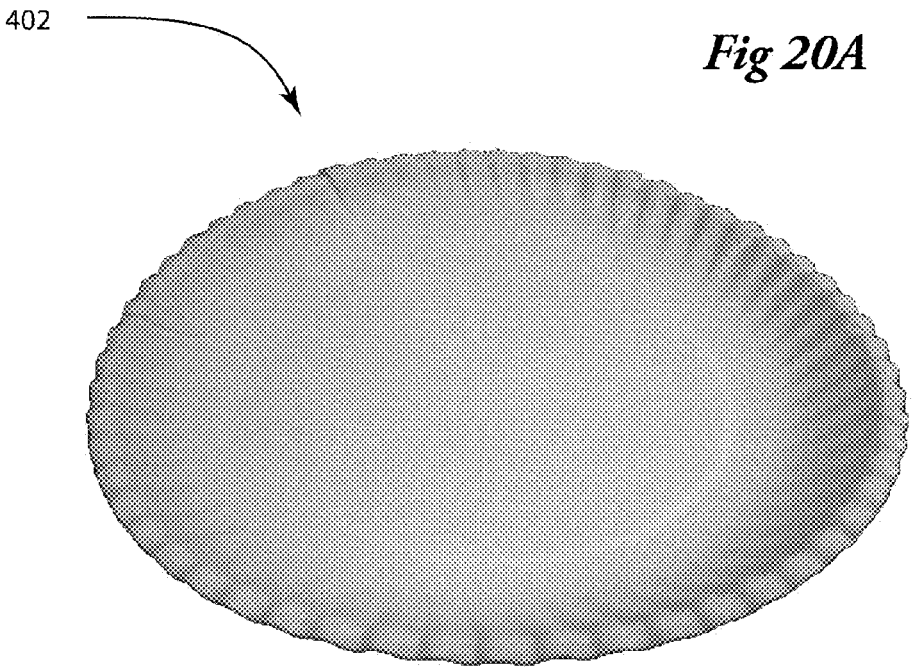
FIGS. 20A and 20B illustrate a prior art white no print plate made from board having a basis weight of 173 pounds per 3000 square foot ream which is used to illustrate the relative performance of the plates of the present invention to a competitive plate made from medium weight board.
Figure 20B:
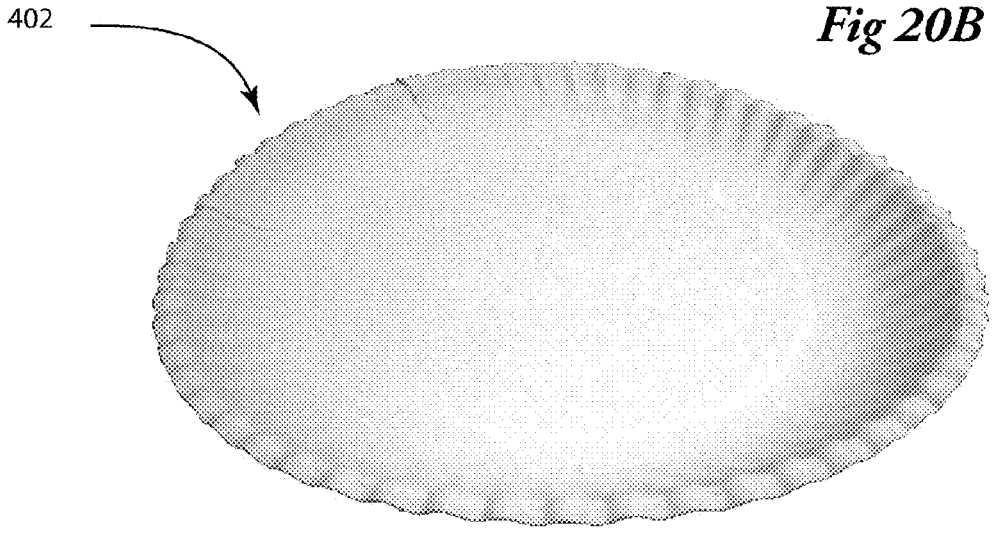
Figure 21C:
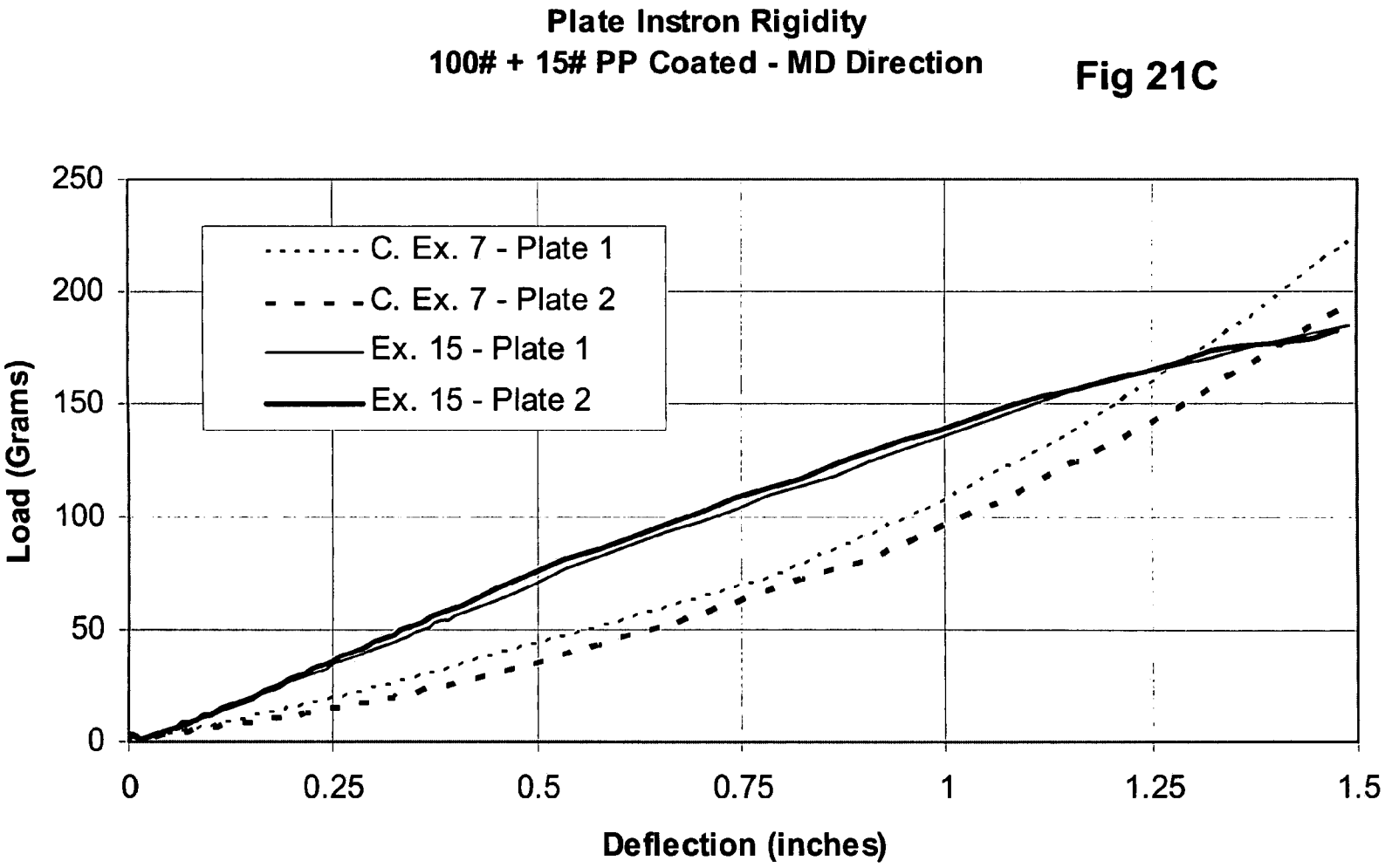
Figure 21D:
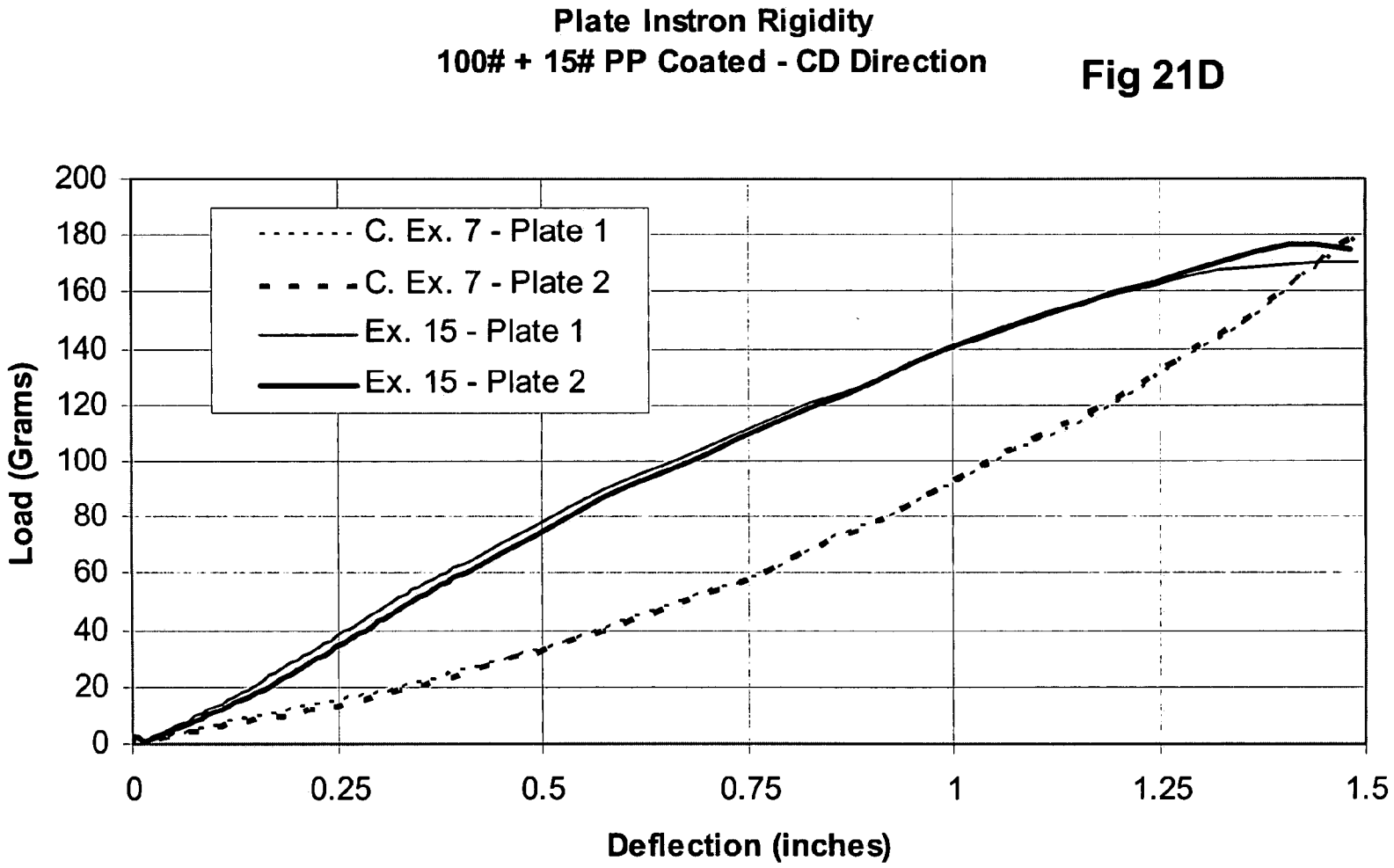

FIGS. 20A and 20B are two photographs which illustrate a competitive white no print plate as described in Comparative Example 7 having a basis weight of approximately 173 pounds per ream. Two photographs of the same plate with slightly differing exposures are presented to make the contours of the plate clearer. FIGS. 21A-21C illustrate performance of this competitive white no print plate to various plates of the present invention having well pressed pleats. In FIGS. 21A and 21B, it can be appreciated that the plate of the present invention made from 145 pound clay coated board possesses substantially improved rigidity as compared to the competitive plate. Inasmuch as rigidity should be expected to vary with a power of the basis weight or caliper of greater than one, in many cases between 1.8 and 2, this is considered quite a respectable showing. In FIG. 21C, the rigidity of this plate is compared to a plate of the present invention made from only 100 pound board and coated with 15 pounds per ream of polypropylene. In this case, it is considered absolutely remarkable to surpass the performance of the far heavier plate with a plate made from such light board.

We claim:

1. A disposable platter, comprising:
a bottom panel made of paper;
a sidewall that extends upwardly from the bottom panel;
an outer flange that extends outwardly from the sidewall;
a first transition extending upwardly and outwardly from the bottom panel to a first end of the sidewall; and
a second transition extending outwardly from a second end of the sidewall to a first end of the outer flange, defining a radius of curvature, R2, therebetween, wherein the platter has at least two sides of different lengths, a characteristic diameter, D, that is an average length of the sides, and a ratio of R2/D that is 0.0125 or less.

2. The disposable platter of claim 1, wherein R2 is about 0.125 inches or less.

3. The disposable platter of claim 1, wherein R2 is about 0.025 inches to about 0.125 inches.

4. The disposable platter of claim 1, wherein the paper has a basis weight of greater than 155 pounds per 3,000 square feet ream.

5. The disposable platter of claim 1, wherein the characteristic diameter is about 6 inches to about 11 inches.

6. The disposable platter of claim 1, wherein the characteristic diameter is about 11 inches.

7. The disposable platter of claim 1, wherein the sidewall has a height of about 0.6 inch to about 0.7 inch.

8. The disposable platter of claim 1, wherein the sidewall has a height of about 0.6 inch.

9. The disposable platter of claim 1, wherein the characteristic diameter is about 6 inches to about 11 inches and the sidewall has a height of about 0.6 inch to about 0.7 inch.

10. The disposable platter of claim 1, further comprising a protective coating disposed on an upper surface of the platter.

11. The disposable platter of claim 10, wherein the protective coating comprises clay, polypropylene, styrene butadiene rubber, or calcium carbonate.

12. The disposable platter of claim 10, wherein the protective coating comprises clay and has a weight of about 8 pounds per 3,000 square foot ream to about 15 pounds per 3,000 square foot ream.

13. The disposable platter of claim 10, wherein the protective coating comprises polypropylene and has a weight of about 10 pounds per 3,000 square foot ream to about 15 pounds per 3,000 square foot ream.

14. The disposable platter of claim 10, wherein the protective coating comprises styrene butadiene rubber and calcium carbonate.

15. A disposable platter, comprising:
a bottom panel made of paper;
a sidewall that extends upwardly from the bottom panel;
an outer flange that extends outwardly from the sidewall;
a first transition extending upwardly and outwardly from the bottom panel to a first end of the sidewall; and
a second transition extending outwardly from a second end of the sidewall to a first end of the outer flange, defining a radius of curvature, R2, therebetween, wherein the platter has a major axis and a minor axis, a characteristic diameter, D, that is an average length of the major axis and the minor axis, and a ratio of R2/D that is 0.0125 or less.

16. A disposable platter, comprising:
a bottom panel made of paper;
a sidewall that extends upwardly from the bottom panel, wherein the sidewall has a height of about 0.6 inch to about 0.7 inch;
an outer flange that extends outwardly from the sidewall;
a first transition extending upwardly and outwardly from the bottom panel to a first end of the sidewall; and
a second transition extending outwardly from a second end of the sidewall to a first end of the outer flange, defining a radius of curvature, R2, therebetween, wherein R2 is about 0.025 inches to about 0.125 inches;
wherein the platter has at least two sides of different lengths, and a characteristic diameter, D, that is an average length of the sides and is about 6 inches to about 11 inches.

17. The disposable platter of claim 16, wherein the paper has a basis weight of greater than 155 pounds per 3,000 square feet ream.

18. The disposable platter of claim 16, wherein the characteristic diameter is about 11 inches.

19. The disposable platter of claim 16, further comprising a protective coating disposed on an upper surface of the platter.

20. The disposable platter of claim 19, wherein the protective coating comprises clay, polypropylene, styrene butadiene rubber, or calcium carbonate.

* * * * *